US010421577B2

(12) United States Patent
Al-Housseiny

(10) Patent No.: US 10,421,577 B2
(45) **Date of Patent: *Sep. 24, 2019**

(54) BLANK USED FOR MAKING A RAPIDLY ERECTED AND COLLAPSIBLE CONTAINER

(71) Applicant: Talal T. Al-Housseiny, Princeton, NJ (US)

(72) Inventor: Talal T. Al-Housseiny, Princeton, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/971,381

(22) Filed: May 4, 2018

(65) Prior Publication Data

US 2018/0251255 A1 Sep. 6, 2018

Related U.S. Application Data

(63) Continuation-in-part of application No. 15/911,767, filed on Mar. 5, 2018, now Pat. No. 10,160,567, (Continued)

(51) Int. Cl.
*B65D 5/36* (2006.01)
*B65D 5/42* (2006.01)
(Continued)

(52) U.S. Cl.
CPC ..... *B65D 5/3621* (2013.01); *B65D 5/4266* (2013.01); *B31B 2100/0022* (2017.08);
(Continued)

(58) Field of Classification Search
CPC ..... B65D 5/3621; B65D 5/02; B65D 5/4266; B65D 2571/00487; B65D 71/0022; B65D 2571/00524; B65D 2571/00839
(Continued)

(56) References Cited

U.S. PATENT DOCUMENTS 728,749 A 5/1903 McCord
1,158,130 A 10/1915 Hawkins
(Continued)

FOREIGN PATENT DOCUMENTS

GB 1315598 A 5/1973

OTHER PUBLICATIONS

International Search Report and Written Opinion dated Jan. 19, 2018; International Application No. PCT/US2017/060565; International Filing Date Nov. 8, 2017; 6 pages.

*Primary Examiner* — Christopher R Demeree
(74) *Attorney, Agent, or Firm* — Blank Rome LLP; Matthew J. Esserman

(57) ABSTRACT

A blank used for making a rapidly erected and collapsible container is disclosed. The container is movable between a flat configuration and a box configuration. The blank comprises a primary panel and a secondary panel, which are hingedly coupled to each other. The secondary panel is hingedly coupled to a secondary flap. The secondary flap is hingedly coupled to a terminal portion. The terminal portion is hingedly coupled to a tab. The tab is configured to fold towards the terminal portion. The secondary flap is configured to fold towards the secondary panel. The tab is configured to connect to the primary panel. Embodiments foster a blank used for making a container that rapidly, easily, and conveniently transitions from a flat configuration to being ready for use in a box configuration. Moreover, the container provides speed and efficiency without compromising cost effectiveness and structural integrity.

8 Claims, 40 Drawing Sheets

Related U.S. Application Data which is a continuation-in-part of application No. 15/358,840, filed on Nov. 22, 2016, now Pat. No. 10,118,725.

(51) Int. Cl.

| | |
|---|---|
| *B31B 150/00* | (2017.01) |
| *B65D 5/10* | (2006.01) |
| *B31B 120/30* | (2017.01) |
| *B31B 110/35* | (2017.01) |
| *B31B 100/00* | (2017.01) |
| *B31B 120/10* | (2017.01) |

(52) U.S. Cl.

CPC ..... *B31B 2110/35* (2017.08); *B31B 2120/102* (2017.08); *B31B 2120/302* (2017.08); *B31B 2150/001* (2017.08); *B31B 2150/003* (2017.08); *B65D 5/10* (2013.01)

(58) Field of Classification Search

USPC ..... 229/117.05, 117.01, 120.09, 120.18, 229/120.21, 120.14, 120.15, 165, 103, 229/103.3, 108.1, 108, 117, 120.08, 229/120.16; 206/180, 190, 175, 184, 206/186; 493/51, 59

See application file for complete search history.

(56) References Cited

U.S. PATENT DOCUMENTS

| | | | | |
|---|---|---|---|---|
| 2,795,352 | A | 6/1957 | Ringler | |
| 3,119,547 | A | 1/1964 | Nute | |
| 3,194,480 | A | 7/1965 | Maindron | |
| 3,199,762 | A | 8/1965 | Coons | |
| 3,549,081 | A | 12/1970 | Nelson | |
| 3,642,192 | A | 2/1972 | Wilcox, Jr. et al. | |
| 3,850,362 | A | 11/1974 | Stollberg et al. | |
| 3,917,060 | A | 11/1975 | Wood | |
| 3,960,313 | A * | 6/1976 | Sax | B65D 5/10 229/117 |
| 4,219,147 | A * | 8/1980 | Kohler | B65D 5/4204 229/120.17 |
| 4,830,270 | A | 5/1989 | Holmes | |
| 4,981,258 | A | 1/1991 | Blanke | |
| 5,096,114 | A | 3/1992 | Higginbotham | |
| 5,285,957 | A | 2/1994 | Halsell | |
| 5,664,726 | A | 9/1997 | Opper | |
| 6,109,513 | A | 8/2000 | Dugan | |
| 8,622,282 | B2 | 1/2014 | Brundage | |
| 8,960,527 | B2 | 2/2015 | Hui | |
| 2005/0006446 | A1 | 1/2005 | Stafford, Jr. | |
| 2007/0218756 | A1 | 9/2007 | Takemoto et al. | |
| 2013/0026215 | A1 | 1/2013 | Lenhard et al. | |
| 2016/0039560 | A1 | 2/2016 | Sharp | |

* cited by examiner

BLANK USED FOR MAKING A RAPIDLY ERECTED AND COLLAPSIBLE CONTAINER

CROSS-REFERENCE TO RELATED APPLICATION(S)

This application is a Continuation-In-Part of U.S. patent application Ser. No. 15/911,767, filed Mar. 5, 2018, which is a Continuation-In-Part of U.S. patent application Ser. No. 15/358,840, filed Nov. 22, 2016, both of which are hereby incorporated herein by reference in their entireties.

FIELD OF THE INVENTION

Embodiments are in the field of containers. More particularly, embodiments disclosed herein relate to blanks used for making rapidly erected and/or collapsible containers which, inter alia, foster a container that rapidly, easily, and conveniently transitions from a flat configuration to being ready for use in a box configuration. The container provides speed and efficiency without compromising cost effectiveness and structural integrity.

BACKGROUND OF THE INVENTION

There are several challenges that are associated with common containers used in packaging, shipping, moving, etc. A typical container uses flaps, which overlap and interlock with each other, to: (i) provide structural rigidity to the container; and to (ii) serve as a bottom side or as a base panel of the container. Interlocking or interconnecting these flaps consumes by far most of the time required to erect a typical container, so that it is ready for use. Furthermore, excess material is required to produce a typical container due to the requirement of, inter alia, an abundance of material for the overlapping flaps, which: (i) have a total aggregate area greater than the area of the base of the container and (ii) are often required to be thicker in order to provide sufficient structural rigidity.

To address the previous challenges, a number of alternative containers (e.g., cartons, boxes, packages, etc.) have been proposed. These alternative containers either rely on additional side walls (e.g., a container with six side walls) or require having folding side walls, which can be folded onto the base of the container. However, these features usually compromise structural integrity. For example, it is difficult to maintain these alternative containers fully erected (i.e., in a box configuration) without substantially filling them. Moreover, the folding side walls of these alternative containers often collapse when other containers or heavy loads are stacked on top.

Thus, it is desirable to provide a blank for making a container that is able to overcome the above disadvantages.

Advantages of the present invention will become more fully apparent from the detailed description of the invention hereinbelow.

SUMMARY OF THE INVENTION

Embodiments are directed to a blank used for making a container. The container is movable between a flat configuration and a box configuration. The blank comprises a primary panel and a secondary panel, which are hingedly coupled to each other. The secondary panel is hingedly coupled to a secondary flap. The secondary flap is hingedly coupled to a terminal portion. The terminal portion is hingedly coupled to a tab. The tab is configured to fold towards the terminal portion. The secondary flap is configured to fold towards the secondary panel. The tab is configured to connect to the primary panel.

Additional embodiments and additional features of embodiments for the blanks used for making containers are described below and are hereby incorporated into this section.

BRIEF DESCRIPTION OF THE DRAWINGS

The detailed description will refer to the following drawings, wherein like reference numerals refer to like elements, and wherein.

DETAILED DESCRIPTION OF THE INVENTION

Figure 1A:
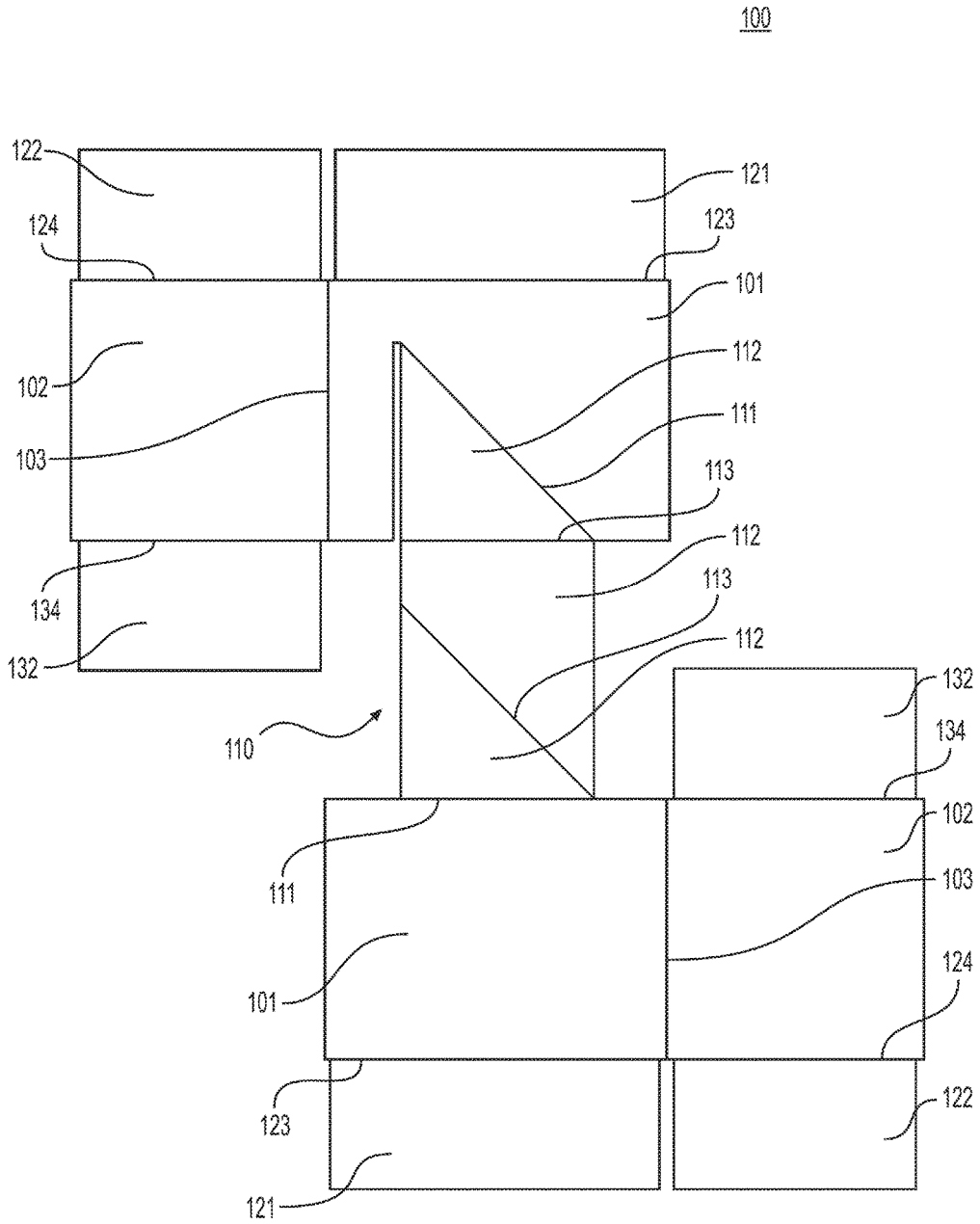
FIG. 1A is a diagram illustrating a plan view of an embodiment of a container, wherein the container is unassembled and two of four panel hinges are not connected for purposes of illustration and explanation only. The container includes two primary panels, two secondary panels, a main link part movably coupled to the two primary panels, and at least one secondary bottom flap.

It is to be understood that the figures and descriptions of the present invention may have been simplified to illustrate elements that are relevant for a clear understanding of the present invention, while eliminating, for purposes of clarity, other elements found in a typical container or typical method of using a container. Those of ordinary skill in the art will recognize that other elements may be desirable and/or required in order to implement the present invention. However, because such elements are well known in the art, and because they do not facilitate a better understanding of the present invention, a discussion of such elements is not provided herein. It is also to be understood that the drawings included herewith only provide diagrammatic representations of the presently preferred structures of the present invention and that structures falling within the scope of the present invention may include structures different than those shown in the drawings. Reference will now be made to the drawings wherein like structures are provided with like reference designations.

For purposes of this disclosure, the term "planar" refers to an element or combination of elements that may have any thickness, and having sides defining the thickness that are parallel with each other.

For purposes of this disclosure, the expression "A is hingedly coupled to B" refers to an element A being movably coupled to an element B via a hinge. A hinge may comprise a perforation, a crease, a score, a bend, a section with less thickness than surrounding material, a section with less density than surrounding material, and a combination thereof.

For purposes of this disclosure, the expression "A is configured to fold towards B" refers to at least a portion of element A being configured to fold towards at least a portion of element B via a hinge.

For purposes of this disclosure, the expression "A is configured to connect to B" refers to at least a portion of element A being configured to face, touch, and/or connect to at least a portion of element B.

For purposes of this disclosure, the term "connect" refers to any mechanism for connecting two elements such as glue, epoxy, adhesive, welding, crimping, stapling, magnetic coupling, hook and loop fasteners, nails, brads, tacks, or a combination thereof.

Embodiments are directed to a container movable between a flat configuration and a box configuration different from the flat configuration. The container comprises two primary panels, two secondary panels, and a main link part. The main link part is movably coupled to the two primary panels via primary-link hinges. The main link part comprises at least three link portions movably coupled to each other via link-link hinges. The two primary panels are configured to move away and sideways from each other when the container is moved from the flat configuration to the box configuration. The two primary panels face each other across a gap, and the two secondary panels face each other across the gap, when the container is in the box configuration.

The two primary panels and the two secondary panels may serve as the side panels of the container. Furthermore, the main link part may serve, at least partly, as a base panel and may provide support/rigidity when the container is in the box configuration. When the container is in the flat configuration, the container may lie substantially in a single plane.

The container may be used for packaging (e.g., consumer products, electronics, cosmetics, pharmaceuticals, food, etc.), for shipping (e.g., mail, domestic shipping, overseas shipping, transfers, deliveries, etc.), for moving (e.g., residential, commercial, etc.), and for storage (e.g., products, belongings, tools, material, etc.), or other suitable uses. The uses of the container are abundant and the wide spectrum of users may include manufacturers, packaging companies, distributors (e.g., fulfillment centers, warehouses, storage facilities, etc.), shipping companies, and the end-consumers (e.g., to store belongings, to move contents of an end-consumer's residence, to ship items via a mail shipping or delivery company, etc.).

The composition of the container may vary. The container is foldable, movable, and collapsible. Moreover, portions and various hinges of the container may be required to bend when the container is moved from the flat configuration to the box configuration, or moved from the box configuration to the flat configuration. Thus, portions or all of the container may comprise a suitable flexible material that allows for folding, collapsing, and moving such as cardboard, paperboard, paper, corrugated carton, plastic, corrugated plastic, polymers, metal, or combinations thereof. In addition, the container may comprise a plurality of different suitable materials. For example, the material of the main link part may be different than the material of the two primary panels or the material of the two secondary panels. The material of any portion of the container may be chosen for reusability of the container, or, alternatively, the material may be chosen based on a disposable (i.e., a one-time or limited use) variation.

The size, dimensions, thickness, shape, and weight of the container or portions of the container may vary. The two primary panels, the two secondary panels, and the main link part may be configured based on the desired overall features of the container and/or contents to be contained within the container. Hence, the size, dimensions, thickness, shape and weight of the two primary panels, of the two secondary panels, and of the main link part may vary. Moreover, the position, the length and the orientation of the primary-link hinges and of the link-link hinges may be configured based on the desired overall features of the container.

The manufacturing and the assembly of the container may vary. Desired objectives for the manufacturing and assembly processes may include reducing material costs, reducing manufacturing costs, reducing material waste, reducing manufacturing complexity, reducing shipping costs, or a combination thereof. The container may be assembled by coupling (e.g., connecting or attaching) various portions of a single sheet of material (e.g., via hinge(s) and/or without a hinge). Alternatively, the container may be assembled by coupling (e.g., connecting or attaching) various portions of a plurality of independent sheets of material (e.g., via hinge(s) and/or without a hinge). Furthermore, portions or all of the container may comprise more than one layer of material. For example, multiple layers of material may be attached or glued to each other to form at least one of the two primary panels, at least one of the two secondary panels, and/or any other portion of the container.

Biasing towards the box configuration may be employed and may be provided by the elastic energy generated by bending portions of the container when the container is moved from a flat configuration to a box configuration. Initially, the container provides resistance when a user moves the container from a flat configuration to a box configuration. Then, the container snaps towards the box configuration. Similarly, biasing towards the flat configuration may be provided by the elastic energy generated by bending portions of the container when the container is moved from a box configuration to a flat configuration. Initially, the container provides resistance when a user moves the container from a box configuration to a flat configuration. Then, the container snaps towards the flat configuration. Alternatively, to effect biasing, the container may, for example, be manufactured or assembled with an amount of pre-stress. Such manufacturing methods capable of providing the pre-stressing or biasing may comprise, for example, pressing, creasing, etc. Other biasing mechanisms may include special hinges (e.g., binary hinges, spring hinges, etc.). Any of the hinges mentioned throughout this description may be replaced by these biasing-type hinges.

The box configuration of the container may be maintained, at least partially, by using an optional interlock mechanism. Alternatively, to maintain the box configuration, two or more portions of the container may be fixed to each other, for example, using a mechanism such as interconnecting flaps, using slits to insert and lock portions of the container, using friction-fit, etc. Furthermore, two different portions of the container may be connected via a fastening mechanism to maintain the container in the box configuration.

Exemplary Embodiments

FIG. 1A is a diagram illustrating a plan view of an embodiment of a container 100, wherein the container is unassembled and two of four panel hinges 103 are not connected for purposes of illustration and explanation only. The container includes two primary panels 101, two secondary panels 102, a main link part 110 movably coupled to the two primary panels 101, and at least one secondary bottom flap 132.

Figure 1B:
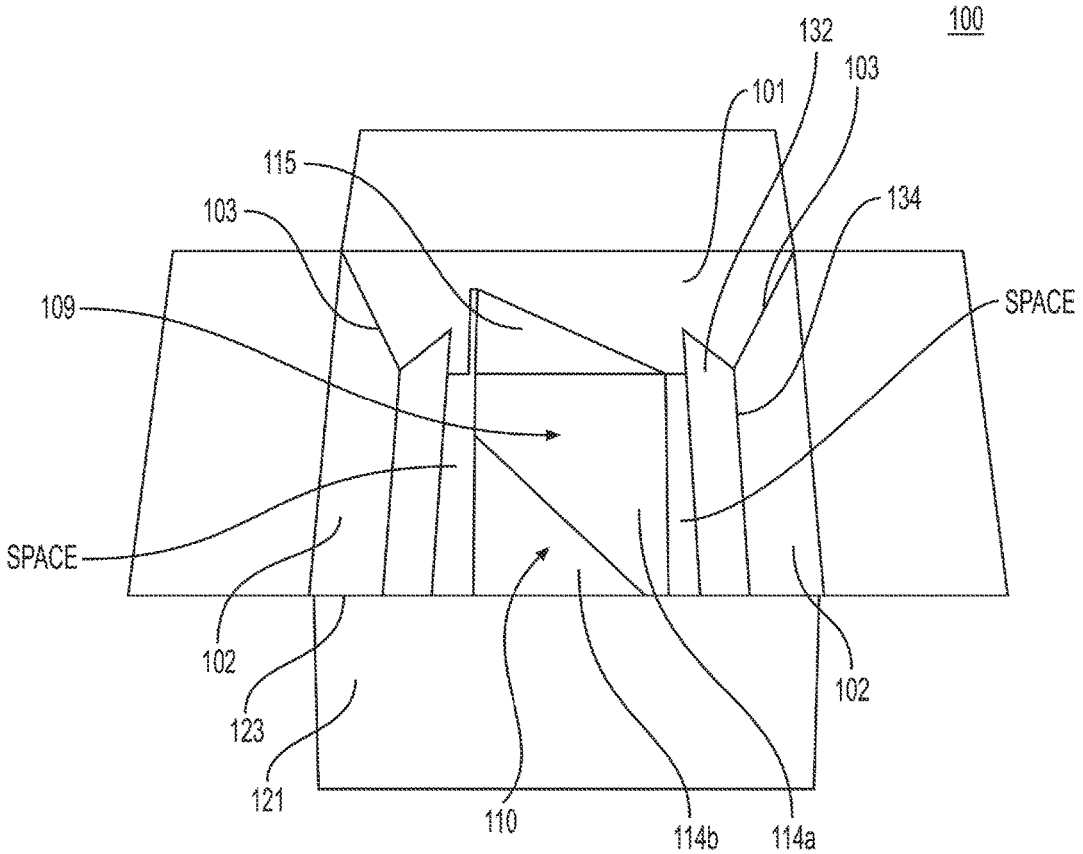
FIG. 1B is a diagram illustrating a perspective view of the container shown in FIG. 1A, wherein the container is assembled and in a box configuration. The at least one secondary bottom flap is not placed against the main link part for purposes of illustration and explanation only.

FIG. 1B is a diagram illustrating a perspective view of the container 100 shown in FIG. 1A, wherein the container is assembled and in a box configuration. The at least one secondary bottom flap 132 is not placed against the main link part 110 for purposes of illustration and explanation only.

Figure 1C:
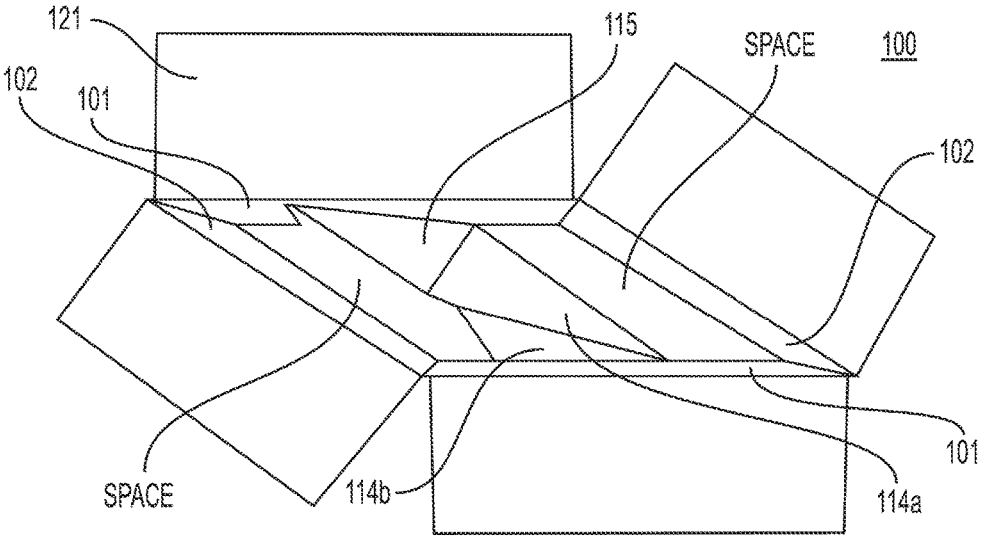
FIG. 1C is a diagram illustrating a plan view of the container shown in FIG. 1B, wherein the container is in a configuration that is between a flat configuration and a box configuration. The at least one secondary bottom flap is not shown for purposes of illustration and explanation only.

FIG. 1C is a diagram illustrating a plan view of the container 100 shown in FIG. 1B, wherein the container is in a configuration that is between a flat configuration and a box configuration. The at least one secondary bottom flap 132 is not shown for purposes of illustration and explanation only.

Figure 1D:
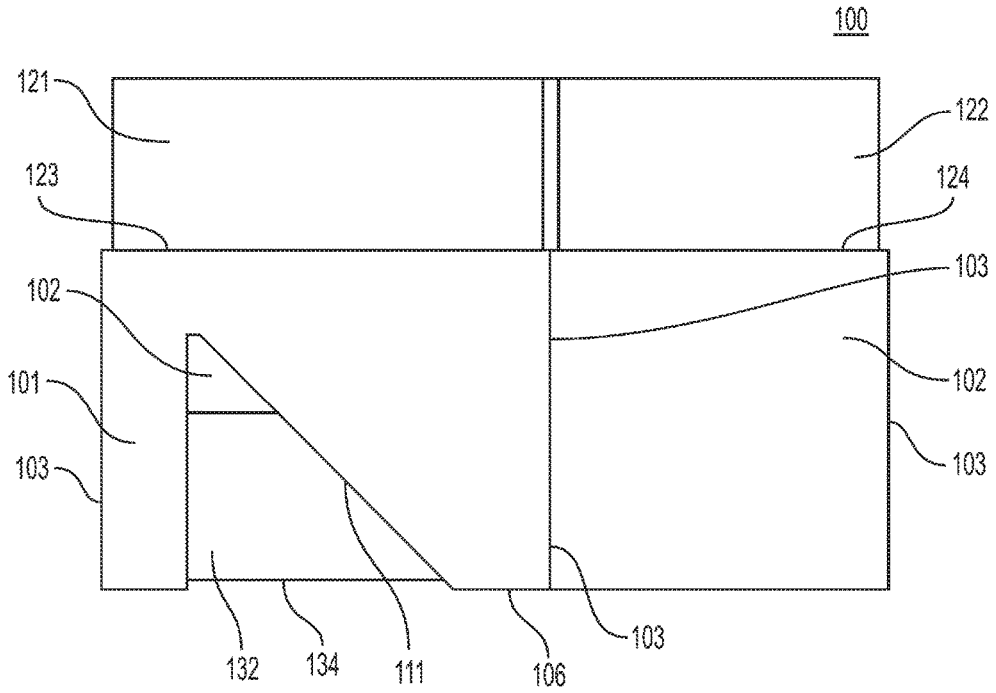
FIG. 1D is a diagram illustrating a side view of the container shown in FIG. 1B, wherein the container is in a flat configuration.

FIG. 1D is a diagram illustrating a side view of the container 100 shown in FIG. 1B, wherein the container 100 is in a flat configuration.

Figure 1E:
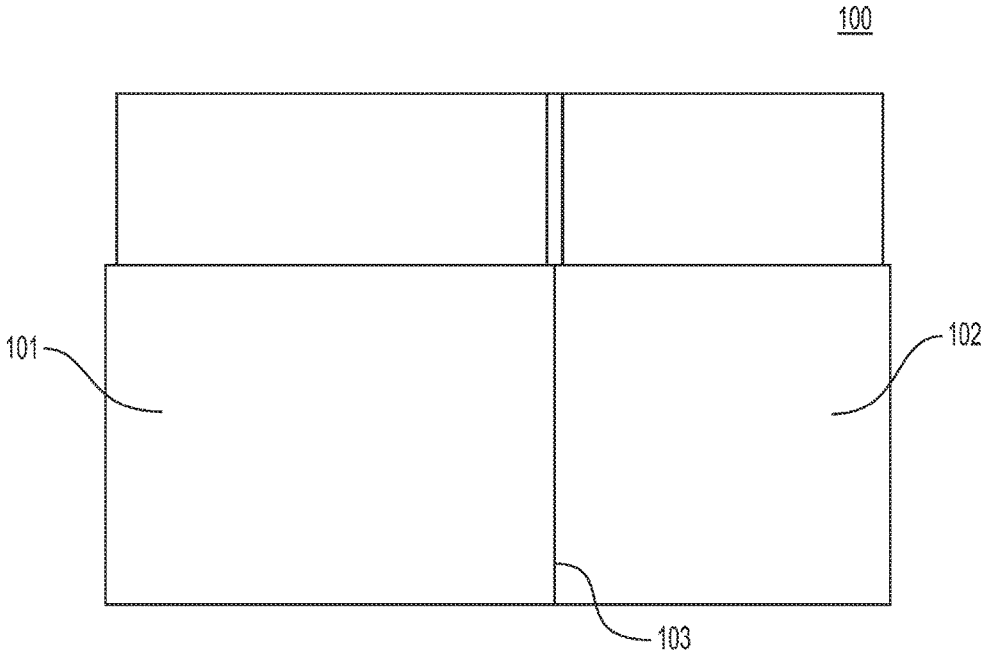
FIG. 1E is a diagram illustrating the other side view of the container shown in FIG. 1D.

FIG. 1E is a diagram illustrating the other side view of the container 100 shown in FIG. 1D.

Figure 1F:
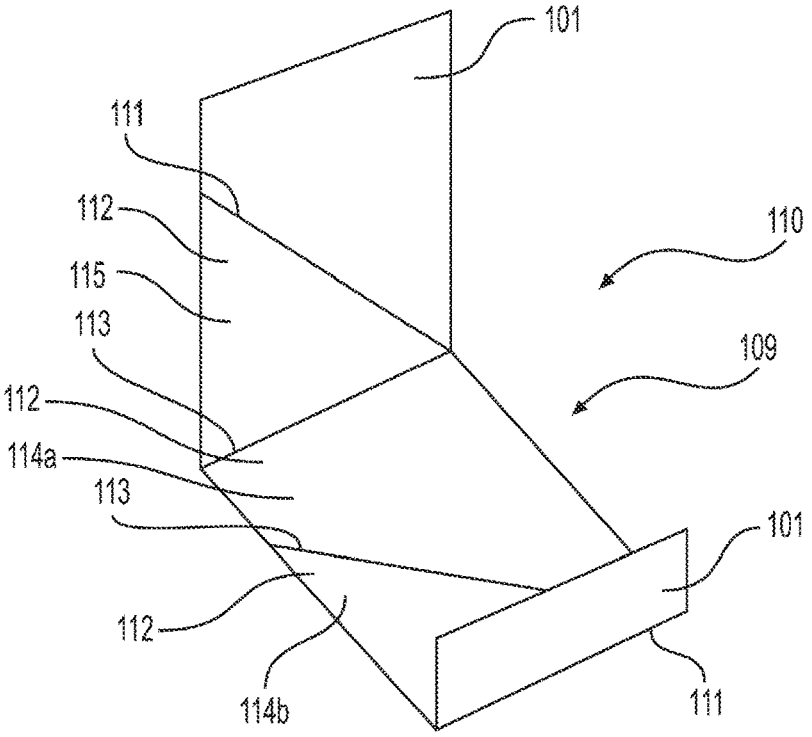
FIG. 1F is a diagram illustrating a perspective view of the main link part and portions of the two primary panels of the container shown in FIG. 1B.

FIG. 1F is a diagram illustrating a perspective view of the main link part 110 and portions of the two primary panels 101 of the container 100 shown in FIG. 1B.

Figure 1G:
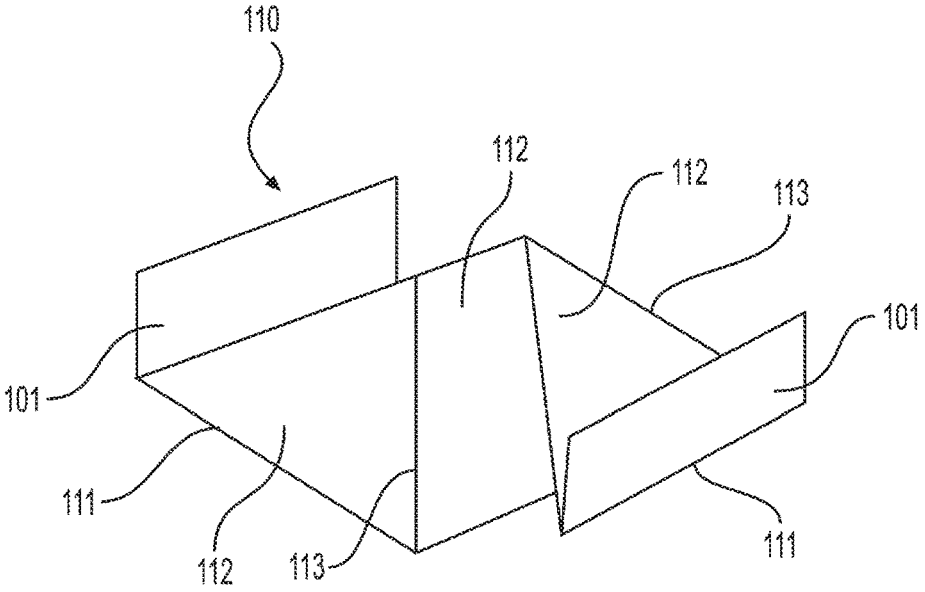
FIG. 1G is a diagram illustrating a perspective view of the main link part and portions of the two primary panels of the container shown in FIG. 1E, wherein the container is in a substantially flat configuration.

FIG. 1G is a diagram illustrating a perspective view of the main link part 110 and portions of the two primary panels 101 of the container 100 shown in FIG. 1E, wherein the container is in a substantially flat configuration.

With reference to FIGS. 1B-1G, the container 100 starts in a flat configuration, wherein the container 100 lies substantially in a single plane. The main link part 110 is folded and positioned between the two primary panels 101 which are movably coupled to the main link part 110 via primary-link hinges 111. The main link part 110 comprises at least three link portions 112 (which are also referred to as terminal portion 115, first link portion 114*a*, and second link portion 114*b*) movably coupled to each other via link-link hinges 113. Specifically, in the flat configuration, the terminal portion 115 and the first link portion 114*a* of the at least three link portions are aligned substantially within the same plane, while the second link portion 114*b* is folded onto the first link portion 114*a*. As the container is moved from the flat configuration to a box configuration, the two primary panels 101 move away and sideways from each other. In particular, the two primary panels 101 move clockwise with respect to each other when viewing the container from above (i.e., a plan view). The direction of motion of the two primary panels 101 may be reversed by suitably modifying the configuration and/or orientation of various components of the container. Also, as the container is moved from the flat configuration to the box configuration, the terminal portion 115 of the at least three link portions rotates clockwise for half a circle with respect to the adjacent primary panel via a primary-link hinge 111 when viewing the container from above (i.e., a plan view). Further, as the container is moved from the flat configuration to the box configuration, the link-link hinges 113 rotate towards the base of the container. In particular, the link-link hinge adjacent to the terminal portion 115 becomes a base or bottom edge of the container when the container is in the box configuration. Yet further, as the container is moved from the flat configuration to the box configuration, the first link portion 114*a* and second link portion 114*b* of the at least three link portions unfold from each other via a link-link hinge 113 and rotate towards the base of the container, thereby forming, at least partly, a base (or bottom) panel of the container. When the container is in the box configuration, the terminal portion 115 is aligned substantially within the same plane as its adjacent primary panel 101. Specifically, in the box configuration, the first link portion 114*a* and second link portion 114*b* of the at least three link portions form at least a portion of the base panel of the container, are aligned substantially within the same plane, and are substantially perpendicular to the terminal portion 115. Also, when the container is in the box configuration, the at least one secondary bottom flap 132 may be extended via at least one secondary-bottom hinge 134 and may be placed against the main link part 110, thereby forming an additional base section of the container. The at least one secondary bottom flap 132 may enable maintaining, at least partly, the container in the box configuration.

Figure 2A:
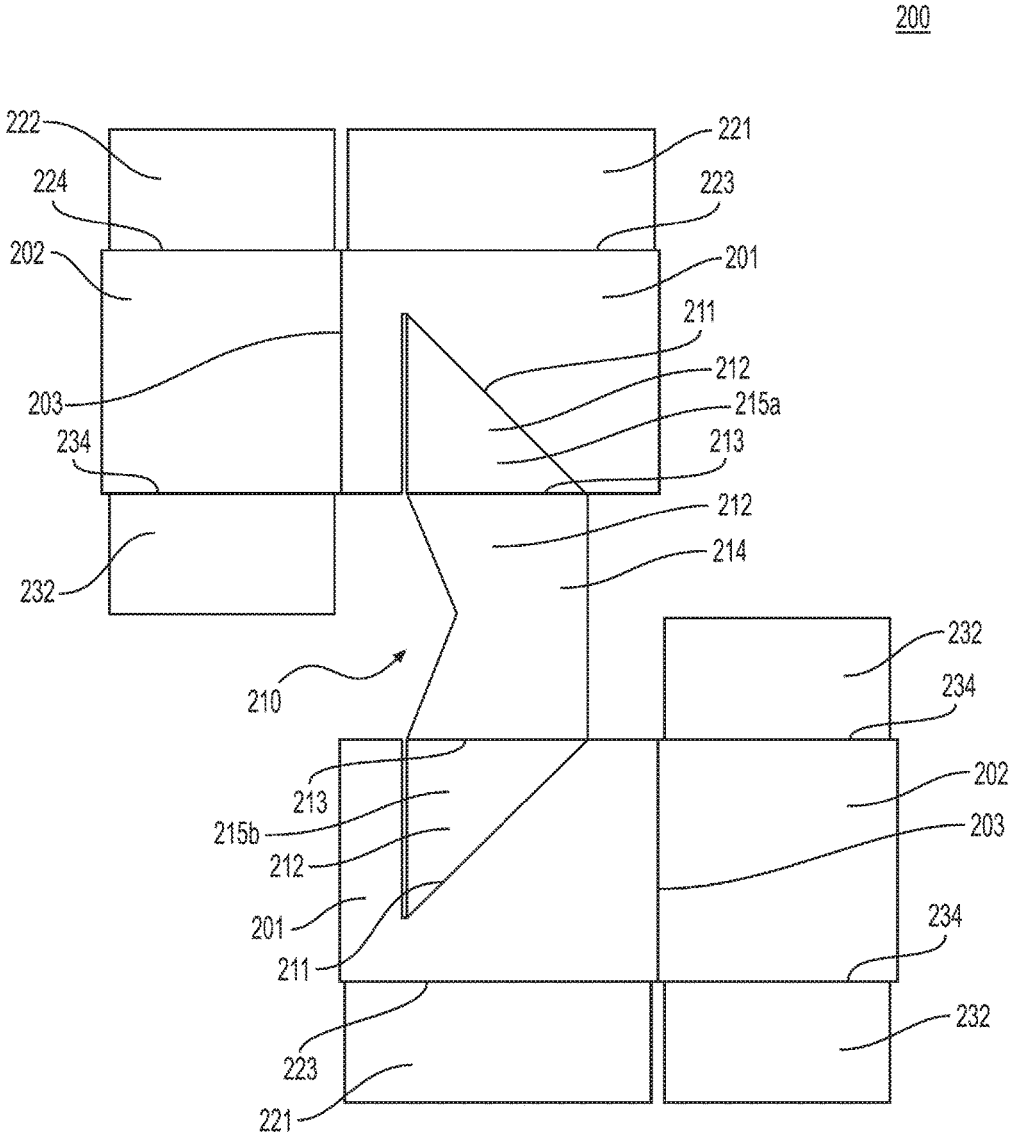
FIG. 2A is a diagram illustrating a plan view of an embodiment of a container, wherein the container is unassembled and two of four panel hinges are not connected for purposes of illustration and explanation only. The container includes two primary panels, two secondary panels, a main link part movably coupled to the two primary panels, and at least one secondary bottom flap.

FIG. 2A is a diagram illustrating a plan view of an embodiment of a container 200, wherein the container is unassembled and two of four panel hinges 203 are not connected for purposes of illustration and explanation only. The container includes two primary panels 201, two secondary panels 202, a main link part 210 movably coupled to the two primary panels 201, and at least one secondary bottom flap 232.

Figure 2B:
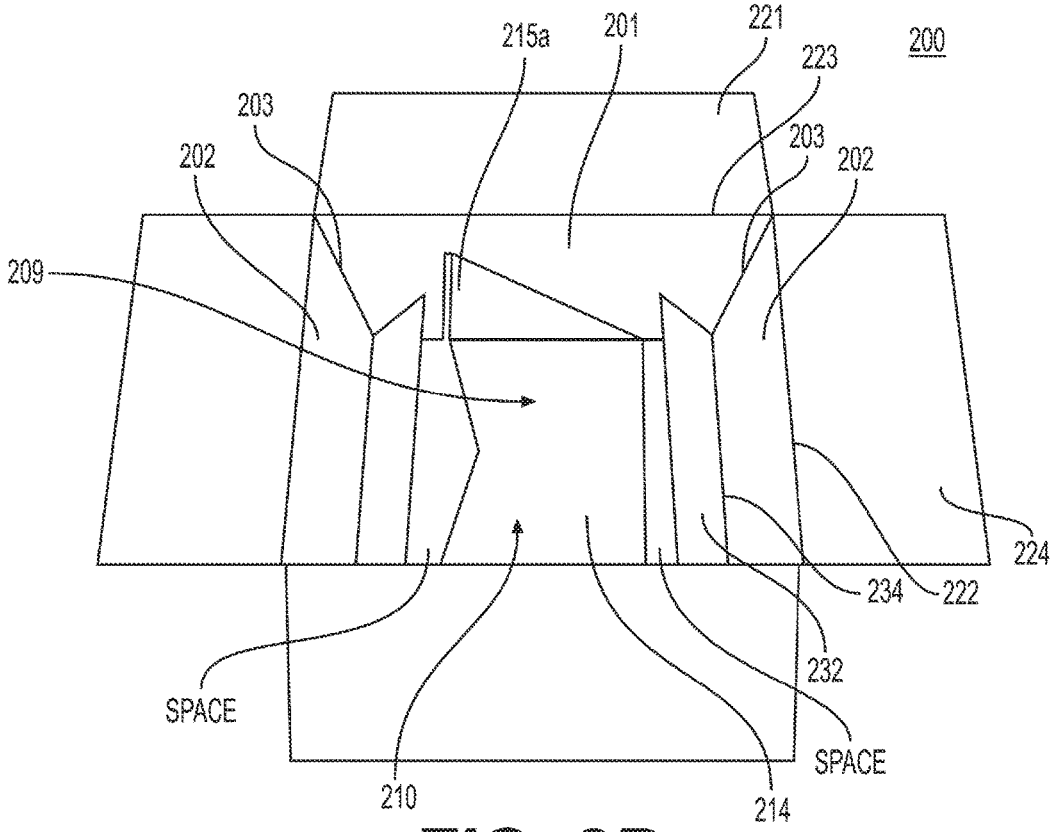
FIG. 2B is a diagram illustrating a perspective view of the container shown in FIG. 2A, wherein the container is assembled and in a box configuration. The at least one secondary bottom flap is not placed against the main link part for purposes of illustration and explanation only.

FIG. 2B is a diagram illustrating a perspective view of the container 200 shown in FIG. 2A, wherein the container is assembled and in a box configuration. The at least one secondary bottom flap 232 is not placed against the main link part 210 for purposes of illustration and explanation only.

Figure 2C:
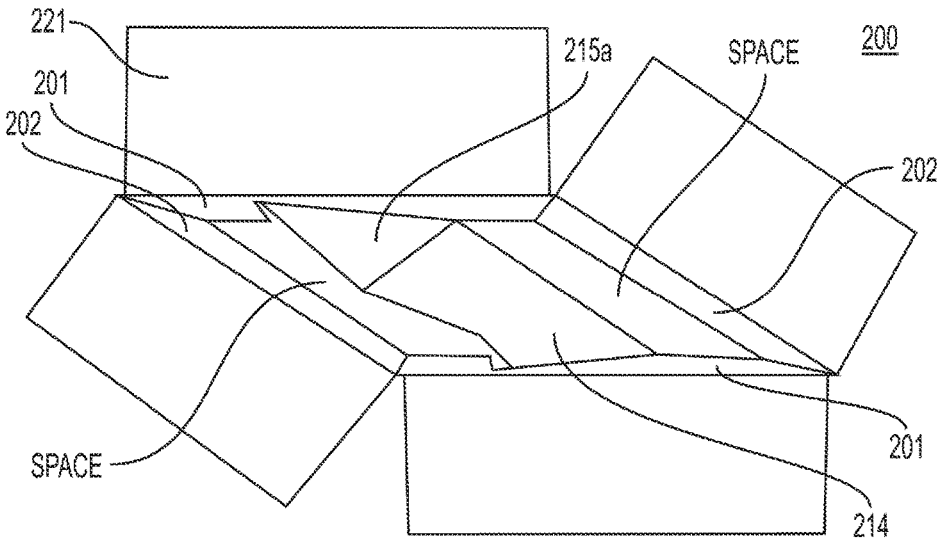
FIG. 2C is a diagram illustrating a plan view of the container shown in FIG. 2B, wherein the container is in a configuration that is between a flat configuration and a box configuration. The at least one secondary bottom flap is not shown for purposes of illustration and explanation only.

FIG. 2C is a diagram illustrating a plan view of the container 200 shown in FIG. 2B, wherein the container is in a configuration that is between a flat configuration and a box configuration. The at least one secondary bottom flap 232 is not shown for purposes of illustration and explanation only.

Figure 2D:
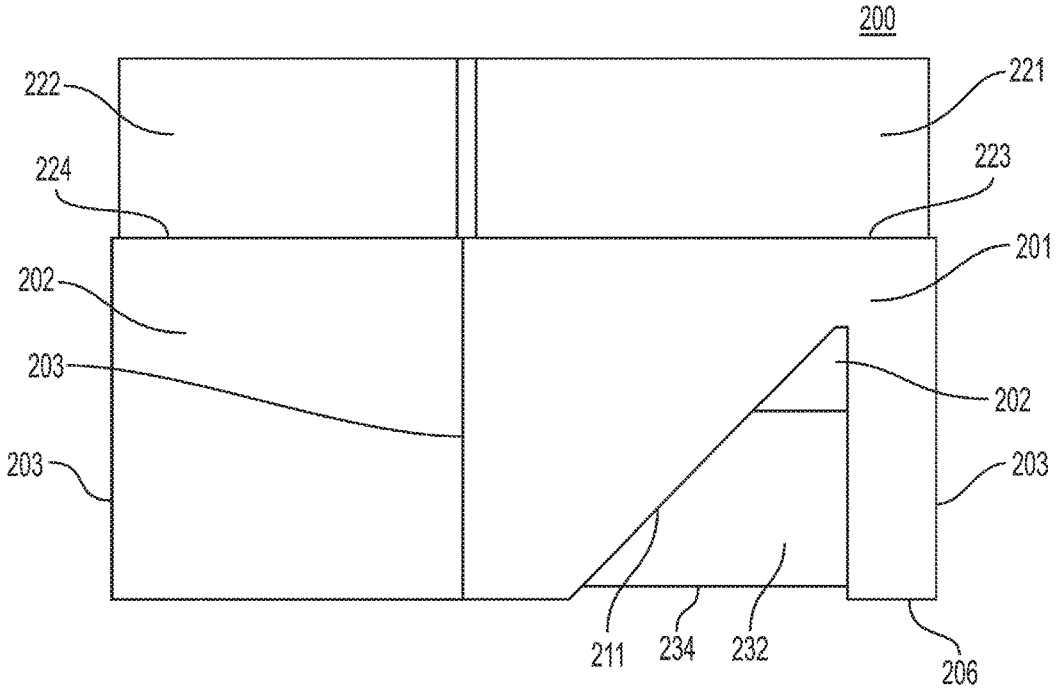
FIG. 2D is a diagram illustrating a side view of the container shown in FIG. 2B, wherein the container is in a flat configuration.

FIG. 2D is a diagram illustrating a side view of the container 200 shown in FIG. 2B, wherein the container is in a flat configuration.

Figure 2E:
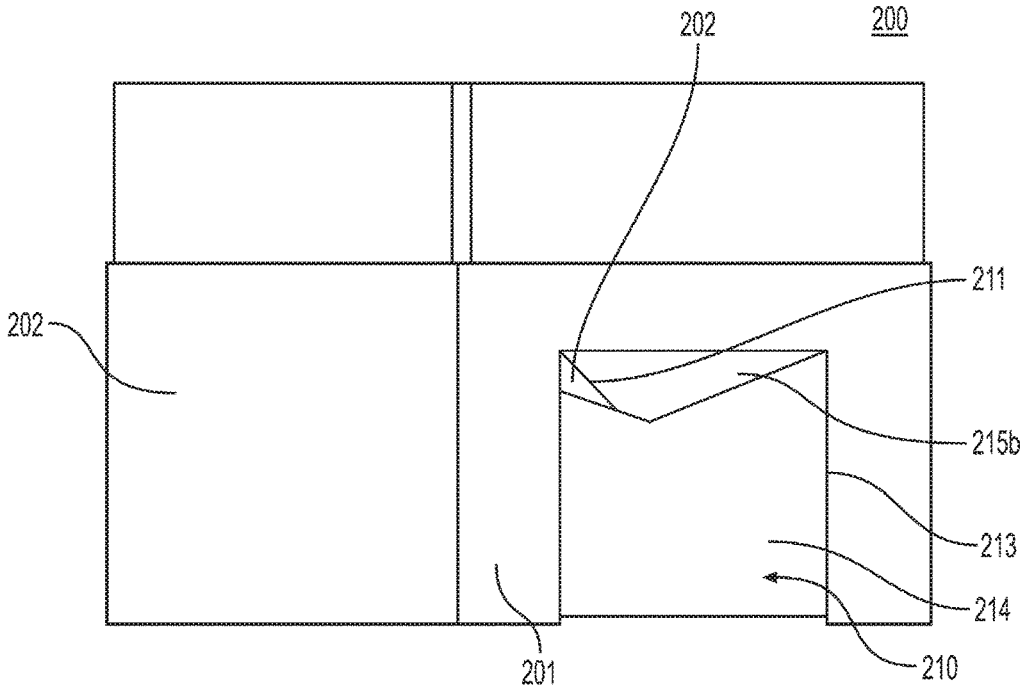
FIG. 2E is a diagram illustrating the other side view of the container shown in FIG. 2D.

FIG. 2E is a diagram illustrating the other side view of the container 200 shown in FIG. 2D.

Figure 2F:
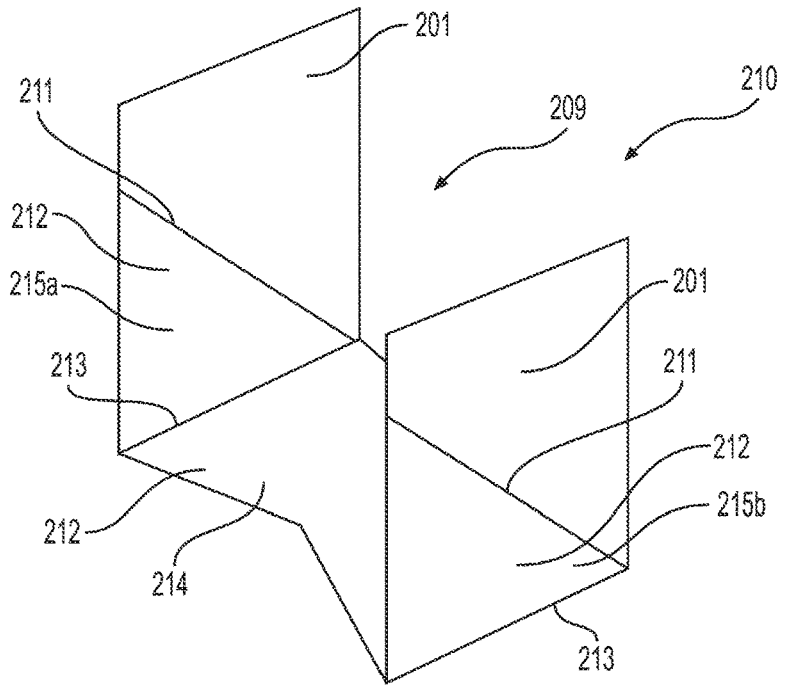
FIG. 2F is a diagram illustrating a perspective view of the main link part and portions of the two primary panels of the container shown in FIG. 2B.

FIG. 2F is a diagram illustrating a perspective view of the main link part 210 and portions of the two primary panels 201 of the container 200 shown in FIG. 2B.

Figure 2G:
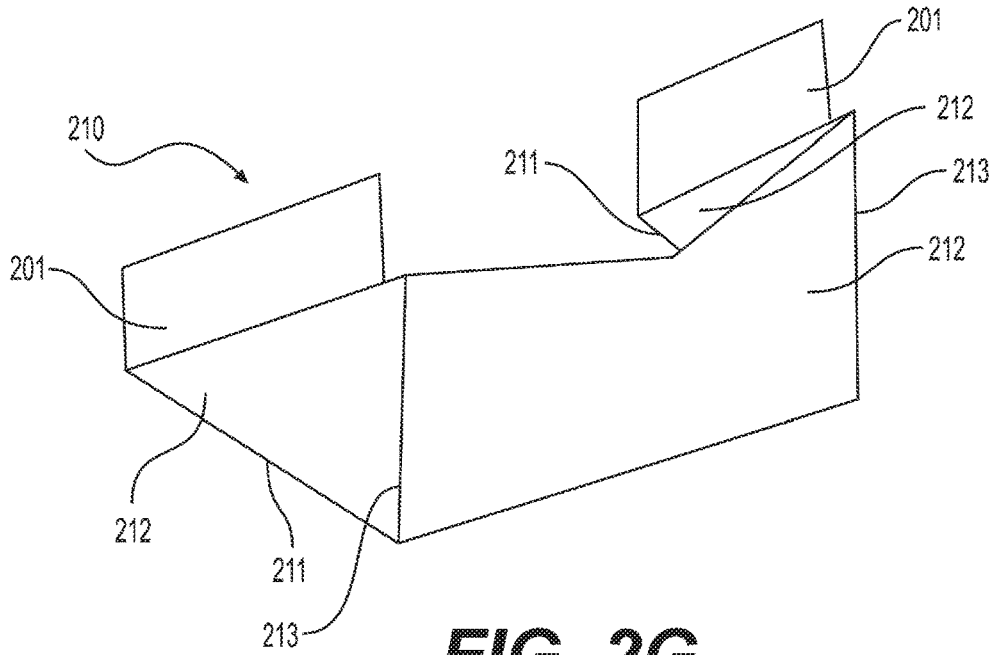
FIG. 2G is a diagram illustrating a perspective view of the main link part and portions of the two primary panels of the container shown in FIG. 2E, wherein the container is in a substantially flat configuration.

FIG. 2G is a diagram illustrating a perspective view of the main link part 210 and portions of the two primary panels 201 of the container 200 shown in FIG. 2E, wherein the container is in a substantially flat configuration.

With reference to FIGS. 2B-2G, the container 200 starts in a flat configuration, wherein the container 200 lies substantially in a single plane. The two primary panels 201 are movably coupled to the main link part 210 via primary-link hinges 211. The main link part 210 comprises at least three link portions 212 (which are also referred to as terminal portion 215*a*, link portion 214, and terminal portion 215*b*) movably coupled to each other via link-link hinges 213. Specifically, in the flat configuration, the link portion 214 and the terminal portion 215*a* of the at least three link portions are aligned substantially within the same plane, while the terminal portion 215*b* is folded onto the link portion 214. As the container is moved from the flat configuration to a box configuration, the two primary panels 201 move away and sideways from each other. In particular, the two primary panels 201 move clockwise with respect to each other when viewing the container from above (i.e., a plan view). Owing to the symmetry of the container 200, the direction of motion of the two primary panels 201 may simply be reversed (i.e., made to move counter-clockwise when viewing the container from above (i.e., a plan view)). Also, as the container is moved from the flat configuration to the box configuration, the terminal portion 215*a* of the at least three link portions rotates clockwise for half a circle with respect to a first of the two primary panels 201 via a primary-link hinge 211 when viewing the container from above (i.e., a plan view). Further, as the container is moved from the flat configuration to the box configuration, the link-link hinges 213 rotate towards the base of the container. The link-link hinges 213 form base or bottom edges of the container when the container is in the box configuration. Terminal portion 215*b* of the at least three link portions, which is folded onto the exterior of a second of the two primary panels 201 (i.e., not between the two primary panels 201) when the container is in the flat configuration, rotates clockwise for half a circle with respect to the second of the two primary panels 201 via another primary-link hinge 211 when viewing the container from above (i.e., a plan view) as the container is moved from the flat configuration to the box configuration. Yet further, as the container is moved from the flat configuration to the box configuration, the link portion 214 of the at least three link portions unfolds from the terminal portion 215*b* via a link-link hinge 213 and rotates towards the base of the container, thereby forming, at least partly, a base panel of the container. Also, when the container is in the box configuration, the terminal portions 215*a*, 215*b* are substantially parallel to each other and are each aligned substantially within the same plane as their respectively adjacent primary panel 201. Specifically, in the box configuration, the link portion 214 of the at least three link portions forms at least a portion of the base panel of the container and is substantially perpendicular to the terminal portions 215*a*, 215*b*. Further, when the container is in the box configuration, the at least one secondary bottom flap 232 may be extended via at least one secondary-bottom hinge 234 and may be placed against the main link part 210, thereby forming an additional base section of the container. The at least one secondary bottom flap 232 may enable maintaining, at least partly, the container in the box configuration.

Figure 3A:
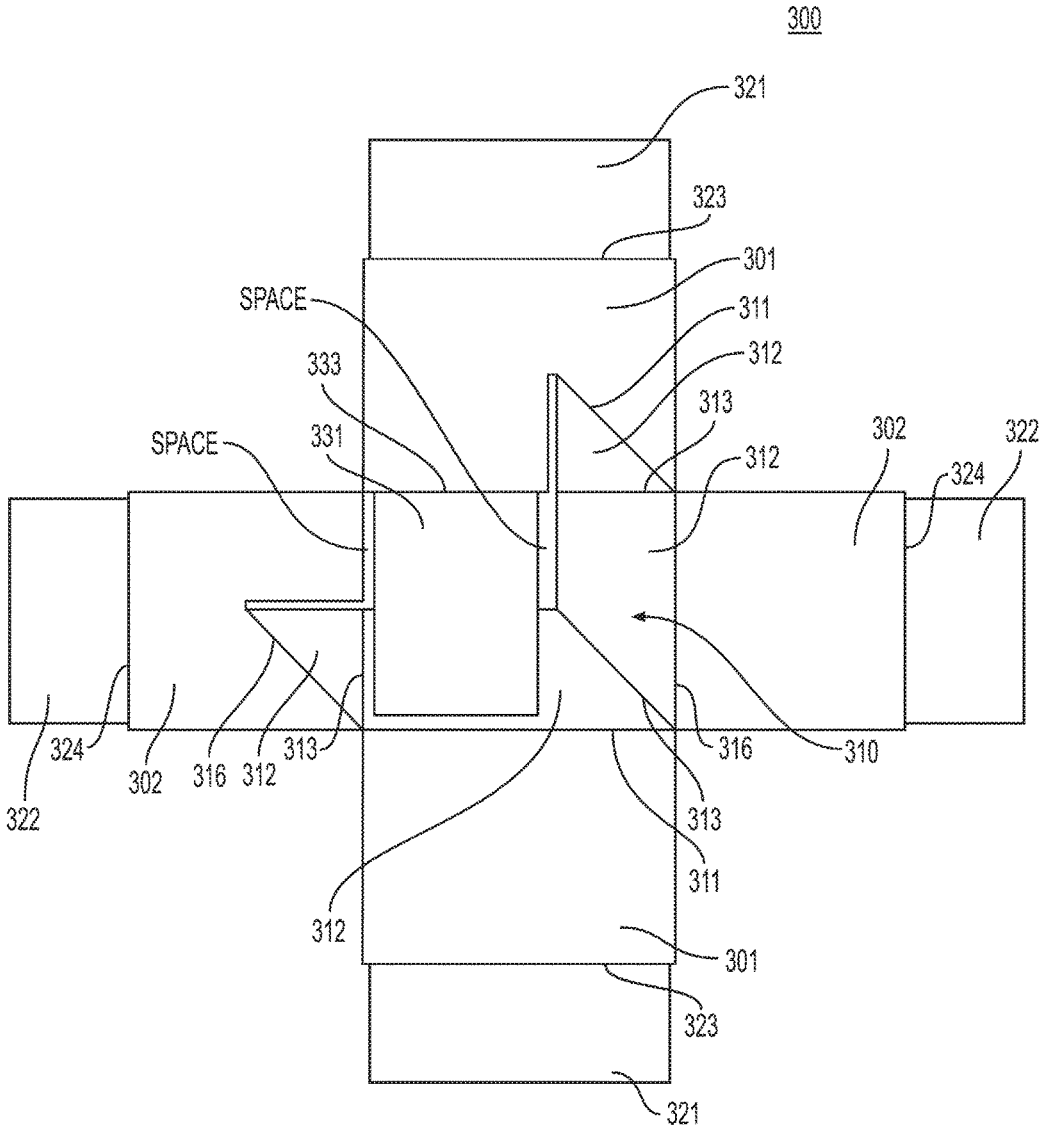
FIG. 3A is a diagram illustrating a plan view of an embodiment of a container, wherein the container is unassembled and four panel hinges are not connected for purposes of illustration and explanation only. The container includes two primary panels, two secondary panels, a main link part movably coupled to the two primary panels and to the two secondary panels, and a primary bottom flap.
Figure 3B:
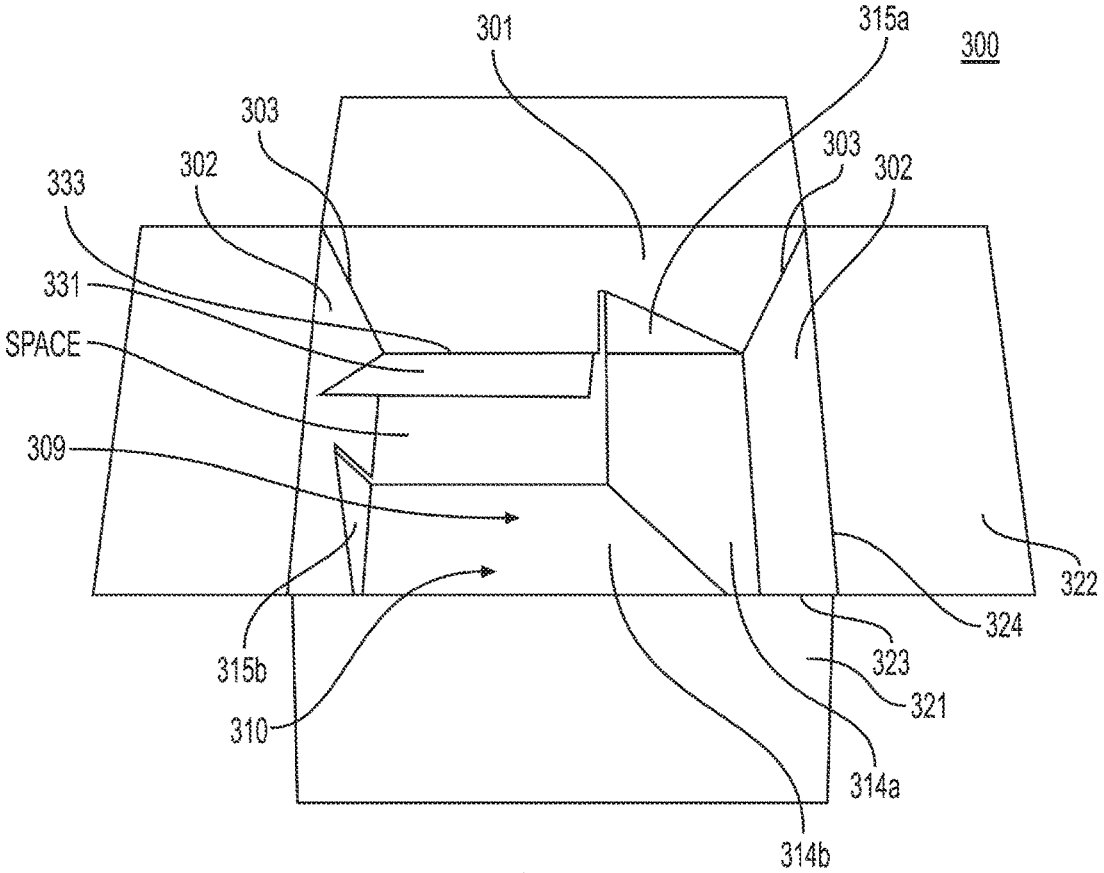
FIG. 3B is a diagram illustrating a perspective view of the container shown in FIG. 3A, wherein the container is assembled and in a box configuration. The primary bottom flap is not placed against the main link part for purposes of illustration and explanation only.

FIG. 3A is a diagram illustrating a plan view of an embodiment of a container 300, wherein the container is unassembled and four panel hinges 303 are not connected for purposes of illustration and explanation only (refer to FIG. 3B). The container includes two primary panels 301, two secondary panels 302, a main link part 310 movably coupled to the two primary panels 301 and to the two secondary panels 302, and a primary bottom flap 331.

FIG. 3B is a diagram illustrating a perspective view of the container 300 shown in FIG. 3A, wherein the container is assembled and in a box configuration. The primary bottom flap 331 is not placed against the main link part 310 for purposes of illustration and explanation only.

Figure 3C:
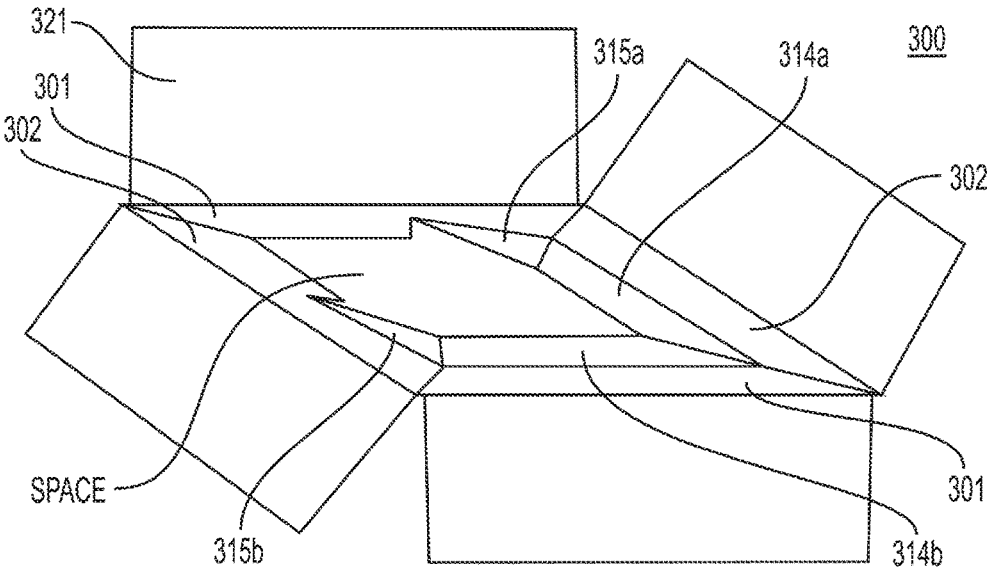
FIG. 3C is a diagram illustrating a plan view of the container shown in FIG. 3B, wherein the container is in a configuration that is between a flat configuration and a box configuration. The primary bottom flap is not shown for purposes of illustration and explanation only.

FIG. 3C is a diagram illustrating a plan view of the container 300 shown in FIG. 3B, wherein the container is in a configuration that is between a flat configuration and a box configuration. The primary bottom flap 331 is not shown for purposes of illustration and explanation only.

Figure 3D:
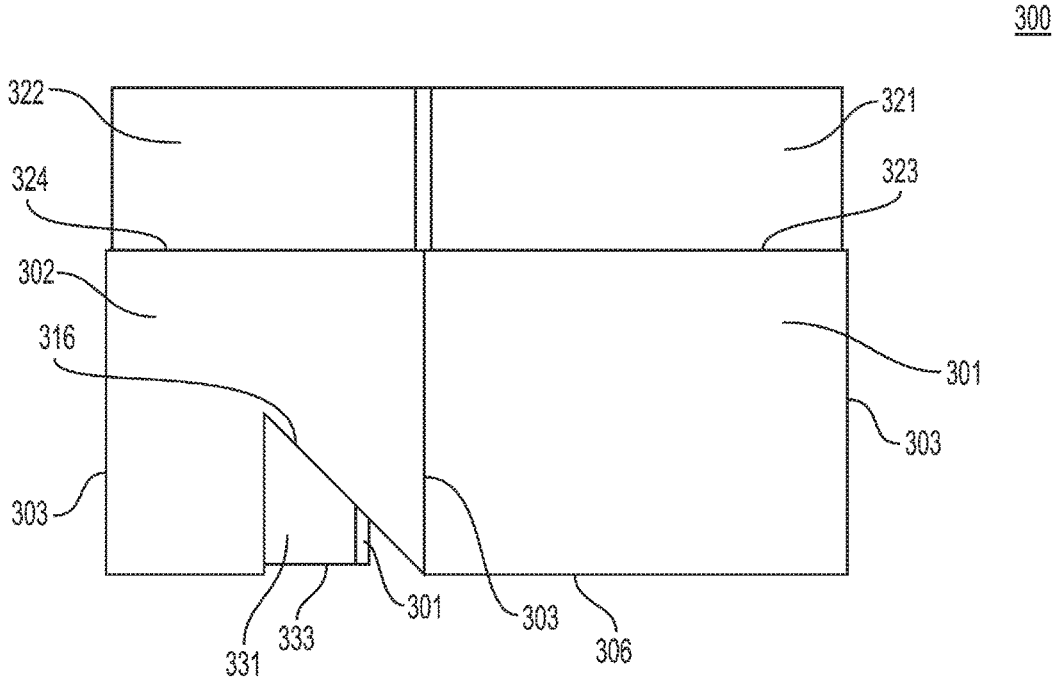
FIG. 3D is a diagram illustrating a side view of the container shown in FIG. 3B, wherein the container is in a flat configuration.

FIG. 3D is a diagram illustrating a side view of the container 300 shown in FIG. 3B, wherein the container is in a flat configuration.

Figure 3E:
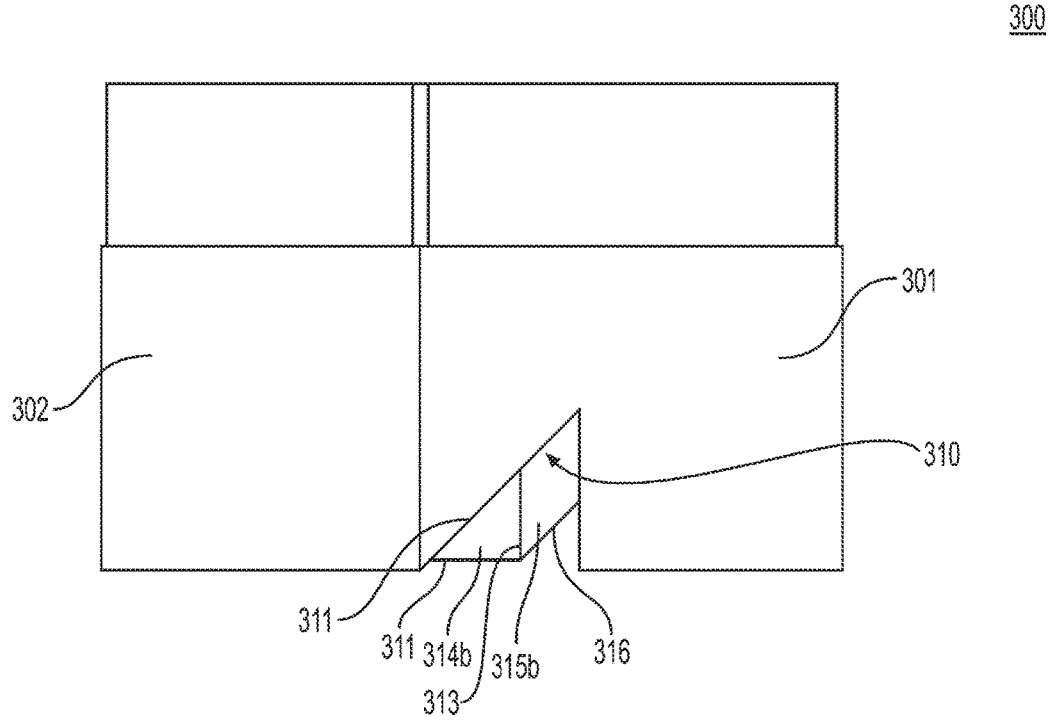
FIG. 3E is a diagram illustrating the other side view of the container shown in FIG. 3D.

FIG. 3E is a diagram illustrating the other side view of the container 300 shown in FIG. 3D.

With reference to FIGS. 3B-3E, the container 300 starts in a flat configuration, wherein the container 300 lies substantially in a single plane. The main link part 310 is folded and positioned between the two primary panels 301 which are movably coupled to the main link part 310 via primary-link hinges 311. The main link part 310 comprises at least four link portions 312 (which are also referred to as terminal portion 315*a*, first link portion 314*a*, second link portion 314*b*, and terminal portion 315*b*) movably coupled to each other via link-link hinges 313. The main link part 310 is movably coupled to the two secondary panels 302 via secondary-link hinges 316. Specifically, in the flat configuration, the terminal portion 315*a* and the first link portion 314*a* of the at least four link portions are aligned substantially within the same plane, while the terminal portion 315*b* and the second link portion 314*b* are aligned substantially within the same plane. As the container is moved from the flat configuration to a box configuration, the two primary panels 301 move away and sideways from each other. In particular, the two primary panels 301 move clockwise with respect to each other when viewing the container from above (i.e., a plan view). The direction of motion of the two primary panels 301 may be reversed by suitably modifying the configuration and/or orientation of various components of the container. Also, as the container is moved from the flat configuration to the box configuration, the terminal portion 315*a* of the at least four link portions rotates clockwise for half a circle with respect to the adjacent primary panel 301 via a primary-link hinge 311 when viewing the container from above (i.e., a plan view). Further, as the container is moved from the flat configuration to the box configuration, the link-link hinges 313 rotate towards the base of the container. Two of the link-link hinges 313 form base or bottom edges of the container when the container is in the box configuration. Yet further, as the container is moved from the flat configuration to the box configuration, the first link portion 314*a* that is movably coupled to a first of the two secondary panels 302 via a secondary-link hinge 316 rotates away from the first of the two secondary panels 302. Yet further, as the container is moved from the flat configuration to the box configuration, the terminal portion 315*b* rotates counter-clockwise for half a circle with respect to a second of the two secondary panels 302 (i.e., essentially rotating away and then towards the second of the two secondary panels 302) via a secondary-link hinge 316 when viewing the container from above (i.e., a plan view). Yet further, as the container is moved from the flat configuration to the box configuration, the link portions 314*a*, 314*b* of the at least four link portions 312 unfold from each other via a link-link hinge 313 and rotate towards the base of the container, thereby forming, at least partly, a base panel of the container. When the container is in the box configuration, the terminal portions 315*a*, 315*b* are substantially perpendicular to each other, while terminal portion 315*a* is aligned substantially within the same plane as its adjacent primary panel 301, and while terminal portion 315*b* is aligned substantially within the same plane as its adjacent secondary panel 302. Specifically, in the box configuration, the link portions 314*a*, 314*b* of the at least four link portions are aligned substantially within the same plane, and are substantially perpendicular to the terminal portions 315*a*, 315*b*. Further, when the container is in the box configuration, the primary bottom flap 331 may be extended via a primary-bottom hinge 333 and may be placed against the main link part 310, thereby forming an additional base section of the container. The primary bottom flap 331 may enable maintaining, at least partly, the container in the box configuration.

Figure 4A:
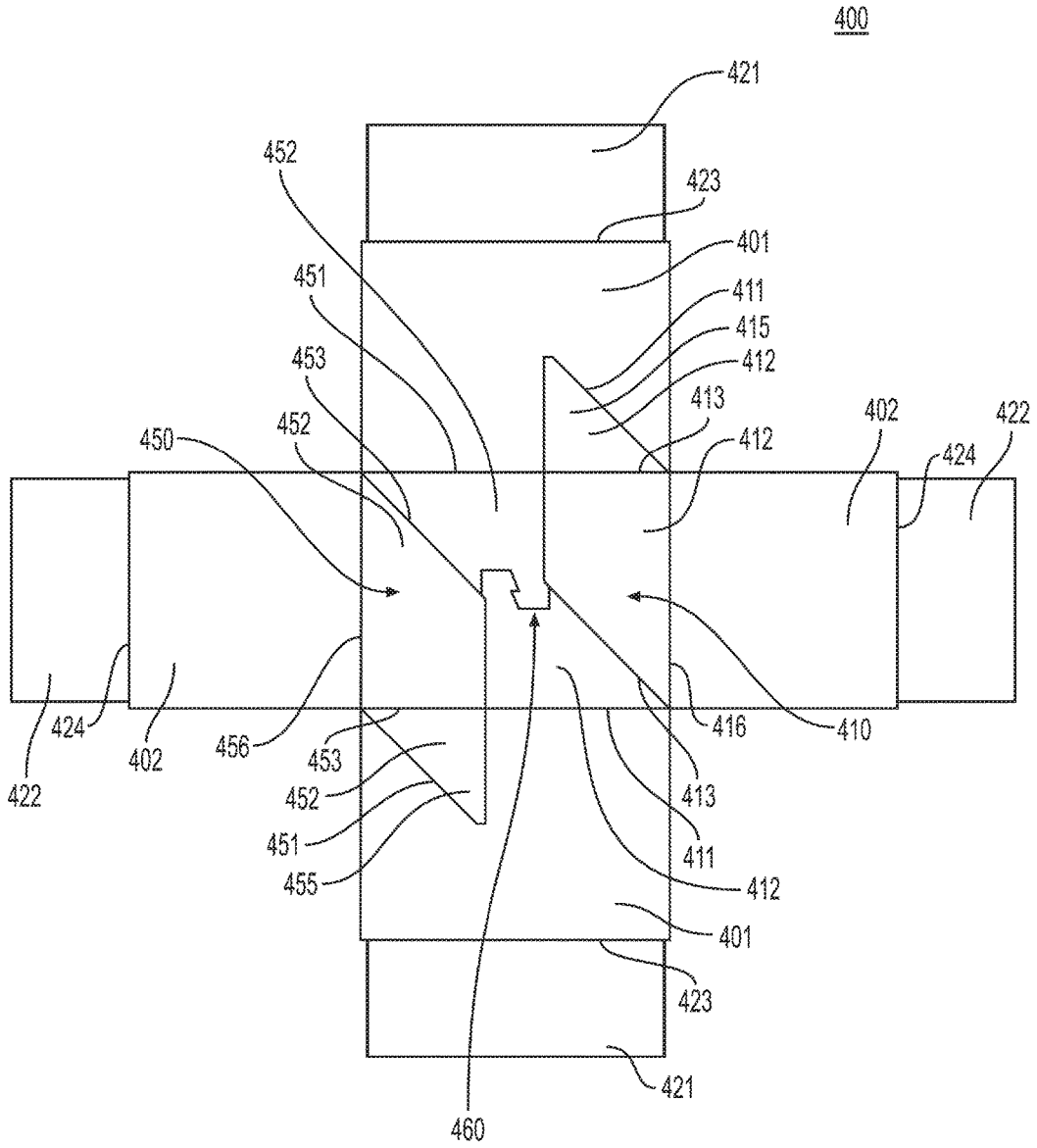
FIG. 4A is a diagram illustrating a plan view of an embodiment of a container, wherein the container is unassembled and four panel hinges are not connected for purposes of illustration and explanation only. The container includes two primary panels, two secondary panels, a main link part movably coupled to the two primary panels and to one of the two secondary panels, an additional link part movably coupled to the two primary panels and to the other one of the two secondary panels, and an optional interlock mechanism.
Figure 4B:
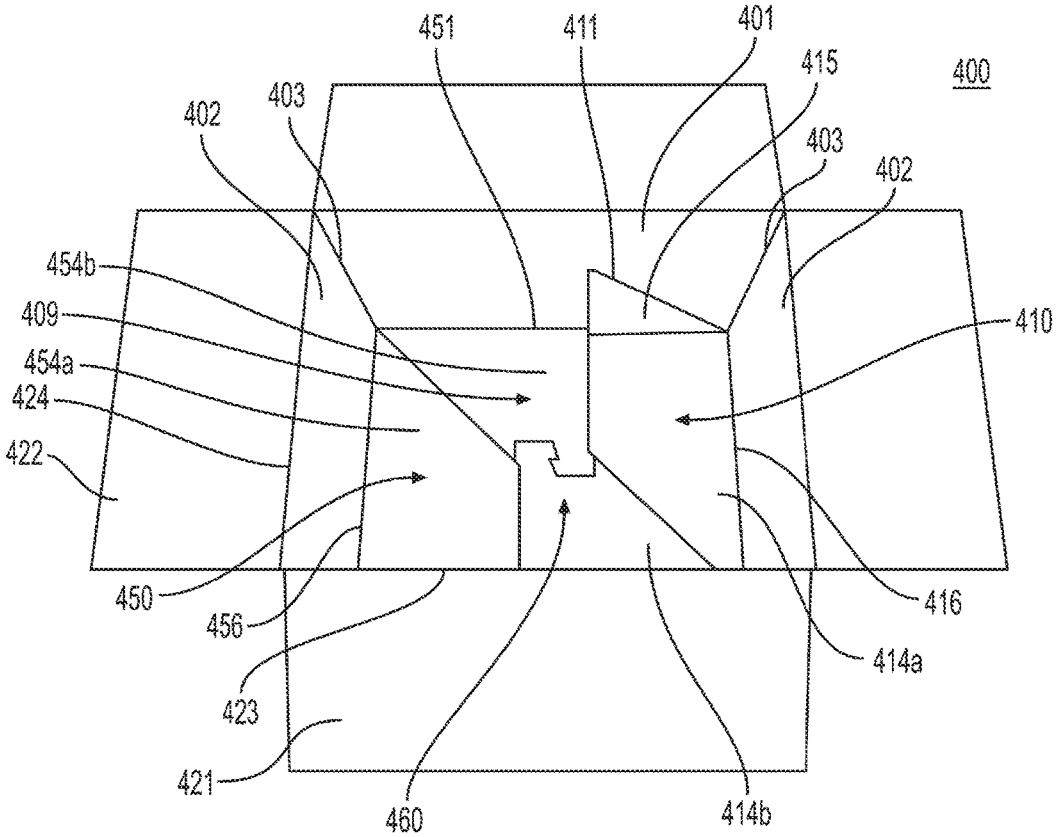
FIG. 4B is a diagram illustrating a perspective view of the container shown in FIG. 4A, wherein the container is assembled and in a box configuration.

FIG. 4A is a diagram illustrating a plan view of an embodiment of a container 400, wherein the container is unassembled and four panel hinges 403 are not connected for purposes of illustration and explanation only (refer to FIG. 4B). The container includes two primary panels 401, two secondary panels 402, a main link part 410 movably coupled to the two primary panels 401 and to one of the two secondary panels 402, an additional link part 450 movably coupled to the two primary panels 401 and to the other one of the two secondary panels 402, and an optional interlock mechanism 460.

FIG. 4B is a diagram illustrating a perspective view of the container 400 shown in FIG. 4A, wherein the container is assembled and in a box configuration.

Figure 4C:
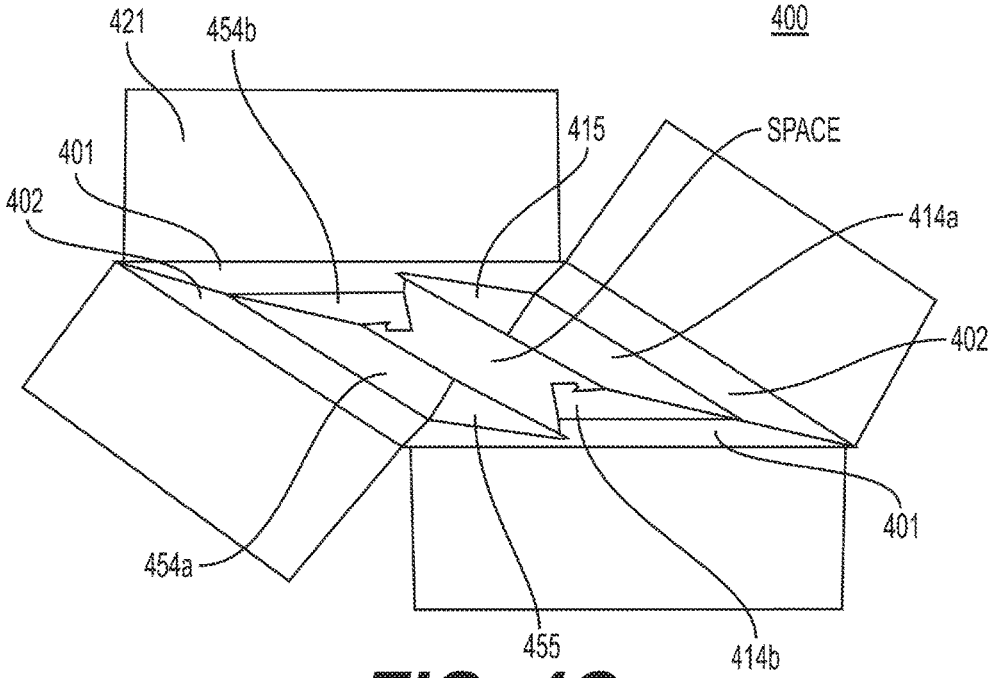
FIG. 4C is a diagram illustrating a plan view of the container shown in FIG. 4B, wherein the container is in a configuration that is between a flat configuration and a box configuration.

FIG. 4C is a diagram illustrating a plan view of the container 400 shown in FIG. 4B, wherein the container is in a configuration that is between a flat configuration and a box configuration.

Figure 4D:
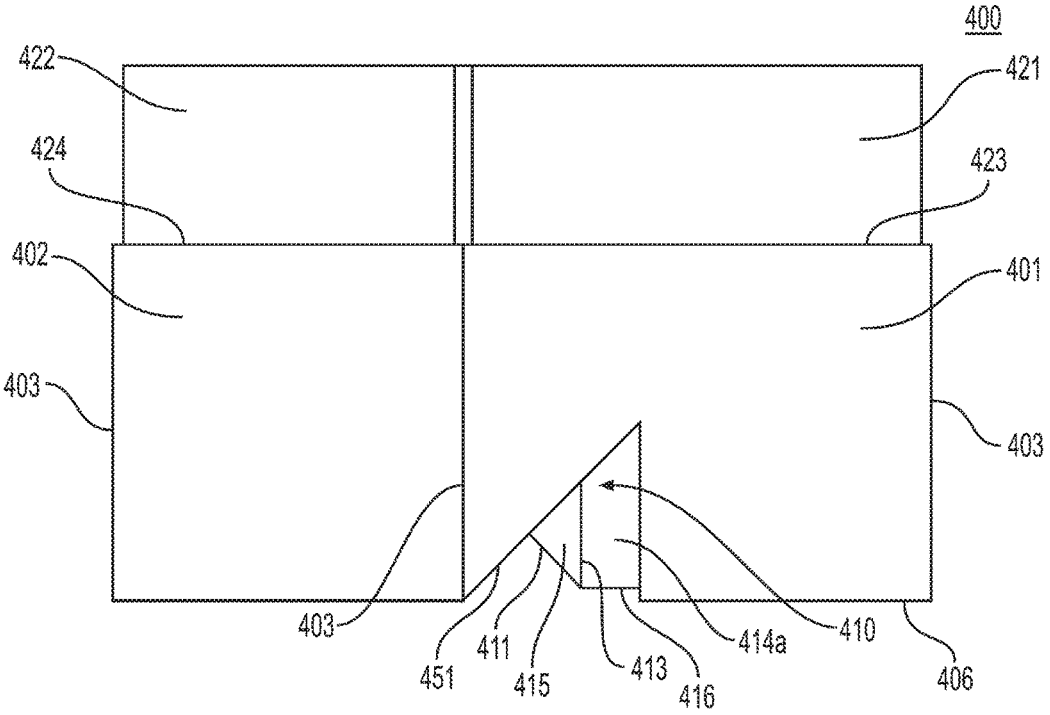
FIG. 4D is a diagram illustrating a side view of the container shown in FIG. 4B, wherein the container is in a flat configuration.

FIG. 4D is a diagram illustrating a side view of the container 400 shown in FIG. 4B, wherein the container is in a flat configuration.

Figure 4E:
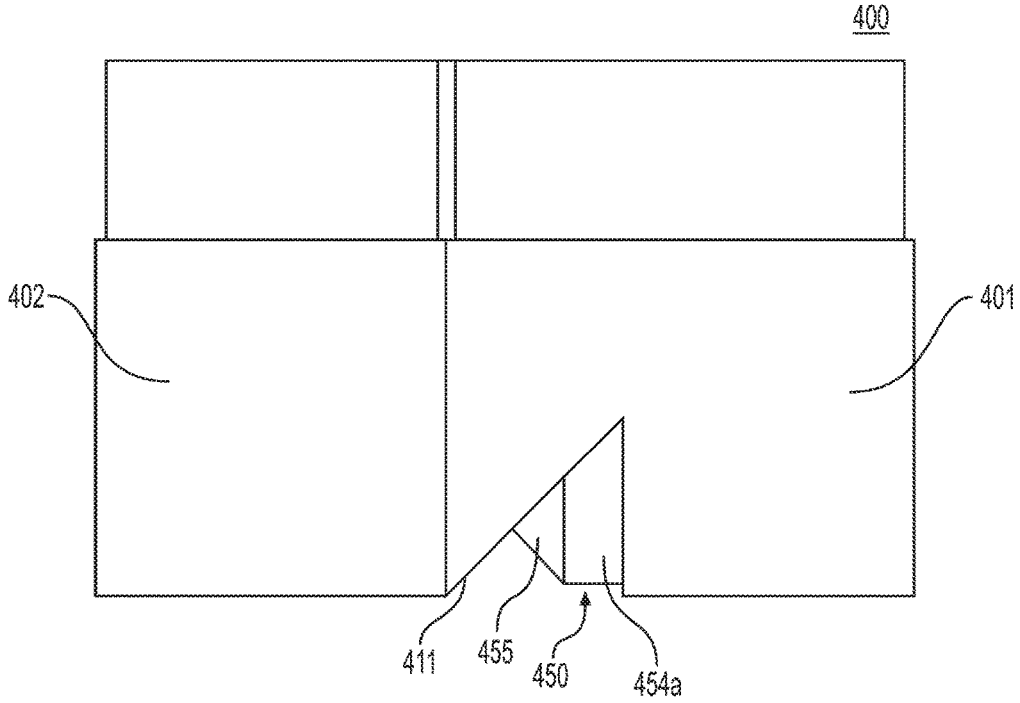
FIG. 4E is a diagram illustrating the other side view of the container shown in FIG. 4D.

FIG. 4E is a diagram illustrating the other side view of the container 400 shown in FIG. 4D.

Figure 4F:
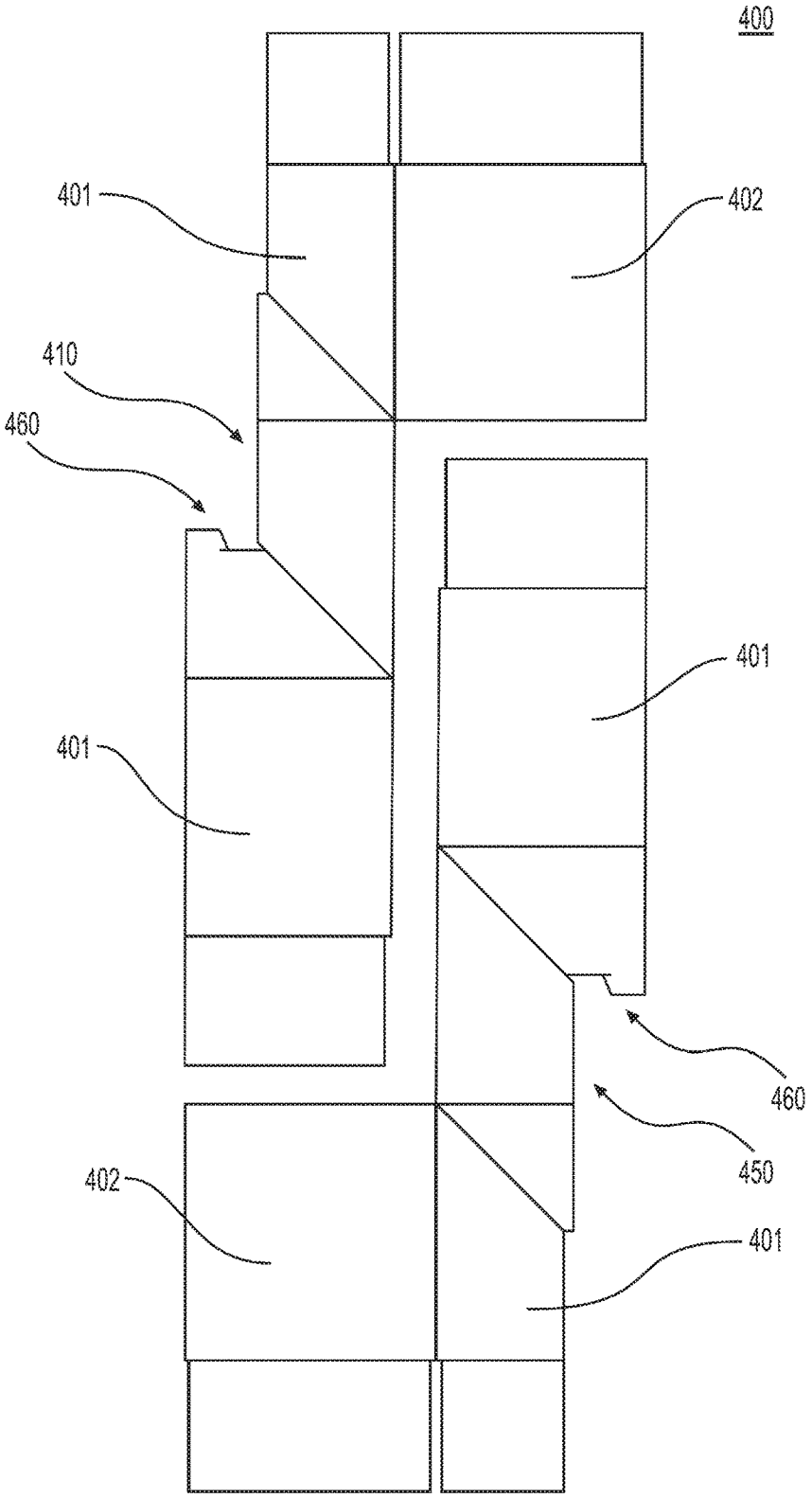
FIG. 4F is a diagram illustrating an alternative unassembled plan view of the container shown in FIG. 4B, wherein the container is assembled from a plurality of sheets of material.

FIG. 4F is a diagram illustrating an alternative unassembled plan view of the container 400 shown in FIG. 4B, wherein the container is assembled from a plurality of sheets of material.

Figure 4G:
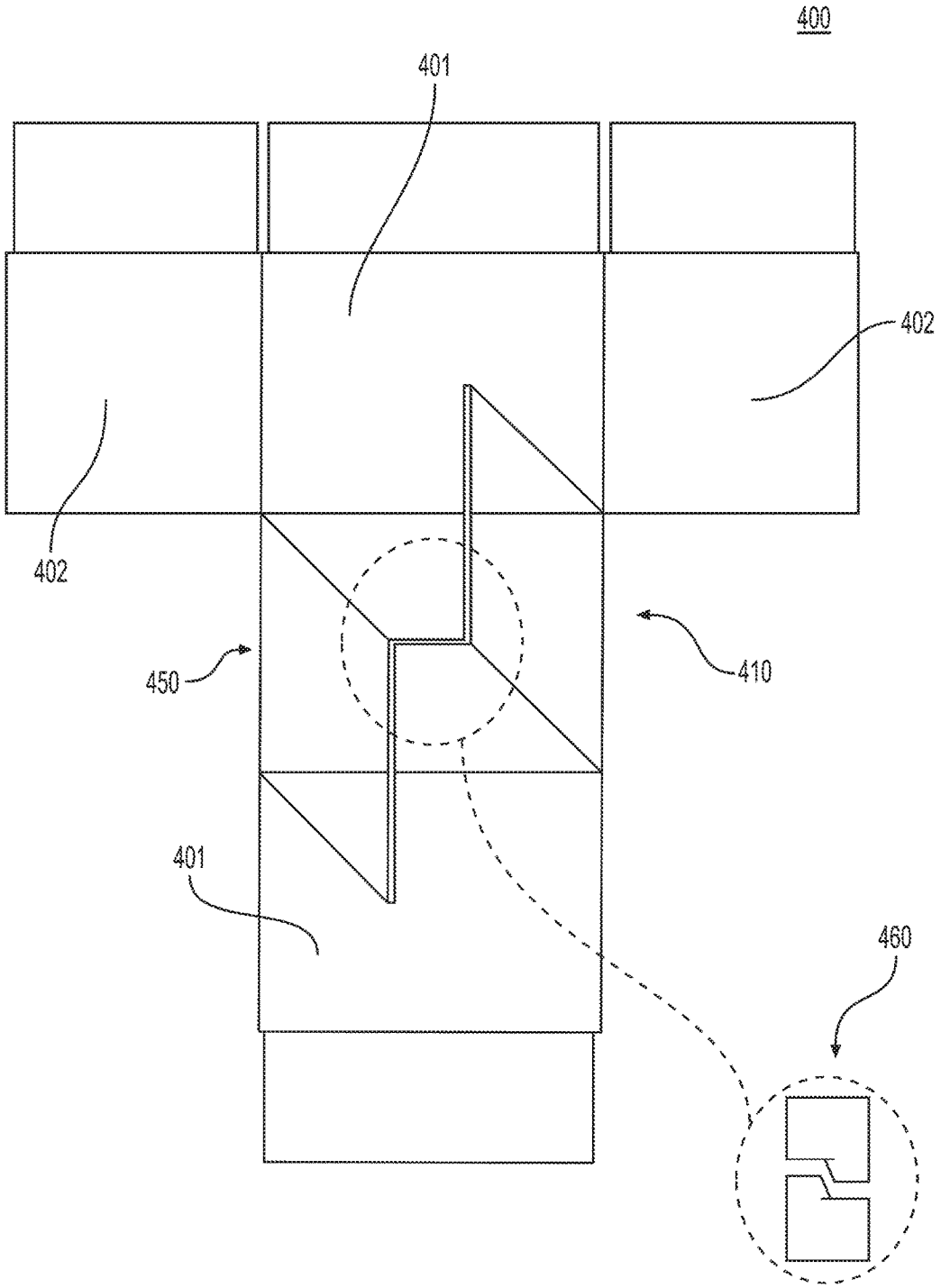
FIG. 4G is a diagram illustrating another alternative unassembled plan view of the container shown in FIG. 4B, wherein the optional interlock mechanism is an additional component coupled to the main link part and to the additional link part.

FIG. 4G is a diagram illustrating another alternative unassembled plan view of the container 400 shown in FIG. 4B, wherein the optional interlock mechanism 460 is an additional component coupled to the main link part 410 and to the additional link part 460.

Figure 4H:
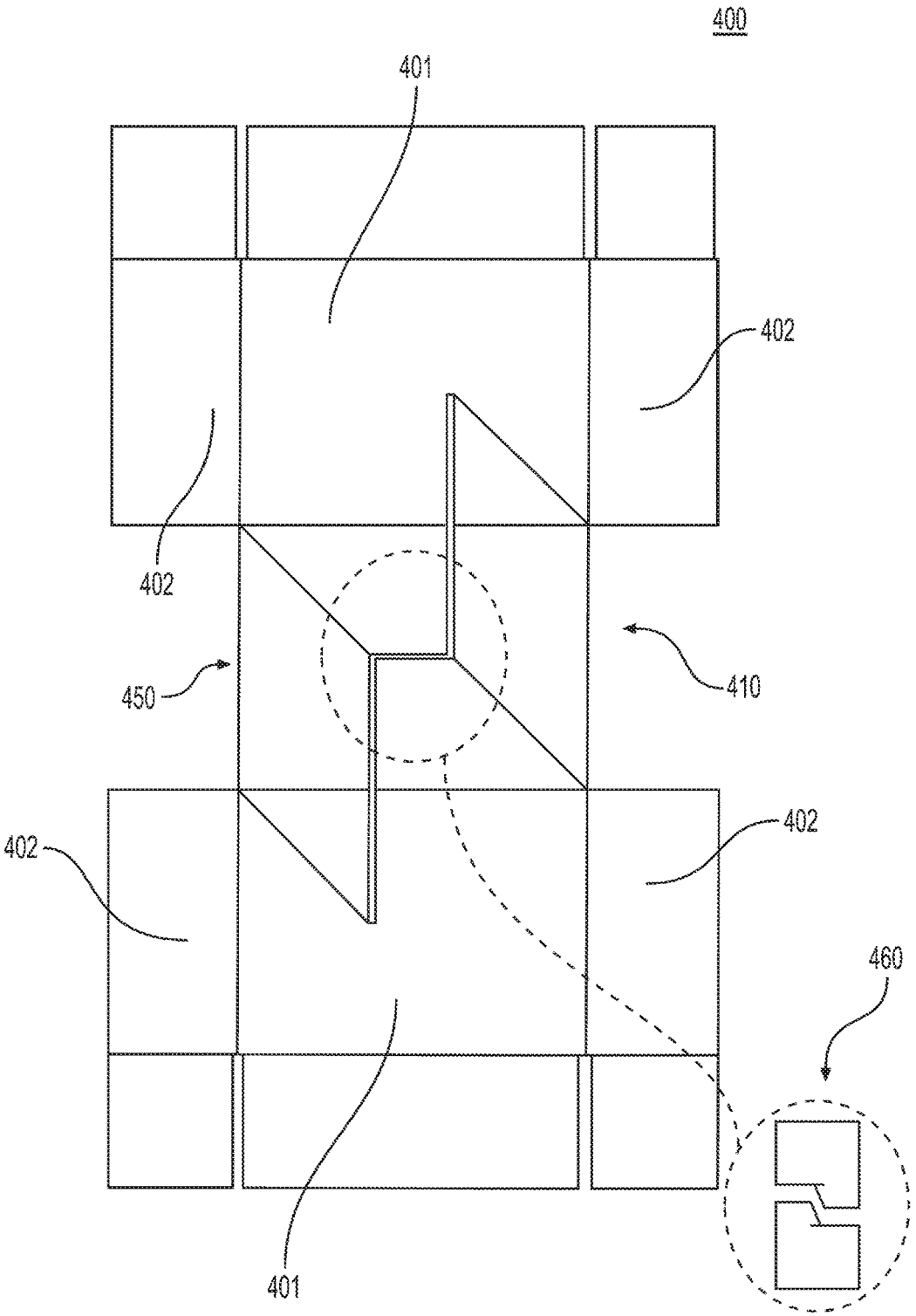
FIG. 4H is a diagram illustrating a further alternative unassembled plan view of the container shown in FIG. 4B, wherein the optional interlock mechanism is an additional component coupled to the main link part and to the additional link part, and wherein each of the two secondary panels comprises a plurality of portions.
Figure 4I:
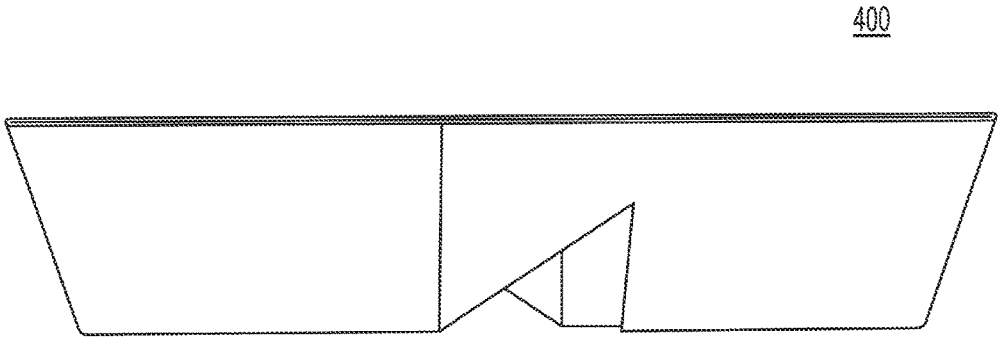
FIGS. 4I-4P is a sequence of diagrams illustrating two perspective views of four different stages of the container shown in FIG. 4G, i.e., when the container is assembled and moved from the flat configuration (FIGS. 4I and 4J), to the transition configurations (FIGS. 4K-4N), and to the box configuration (FIGS. 4O and 4P). The optional interlock mechanism and the top flaps are omitted for purposes of illustration and explanation only. And the height of the two primary panels and the height of the two secondary panels is smaller than the respective panel heights shown in FIG. 4G (once assembled) for purposes of illustration and explanation only.
Figure 4J:
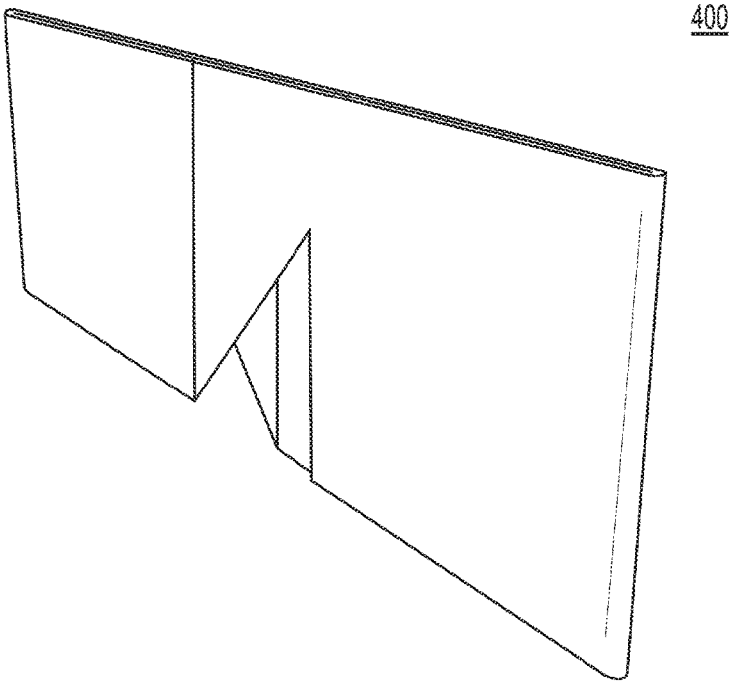
Figure 4K:
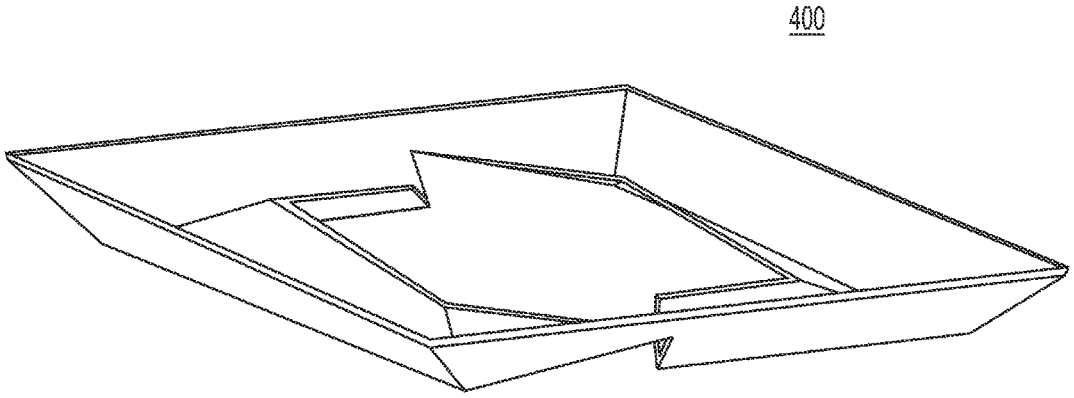
Figure 4L:
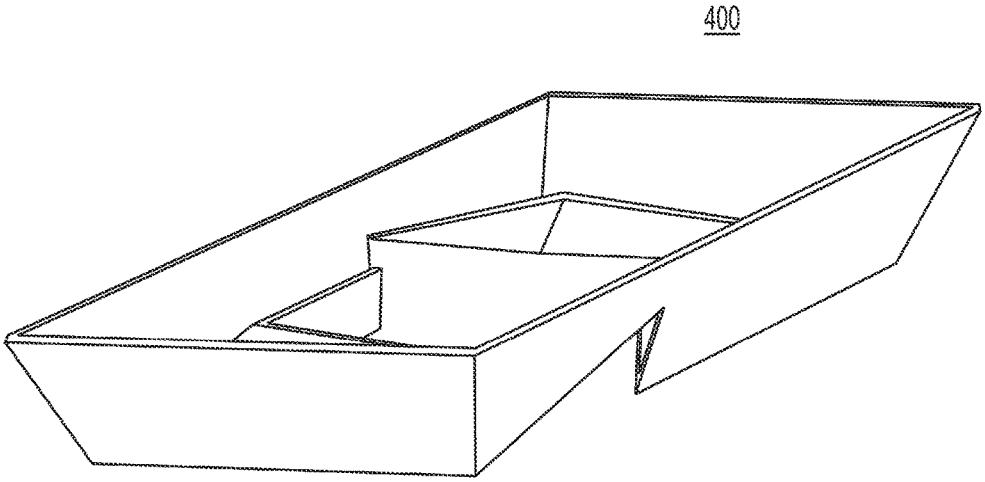
Figure 4M:
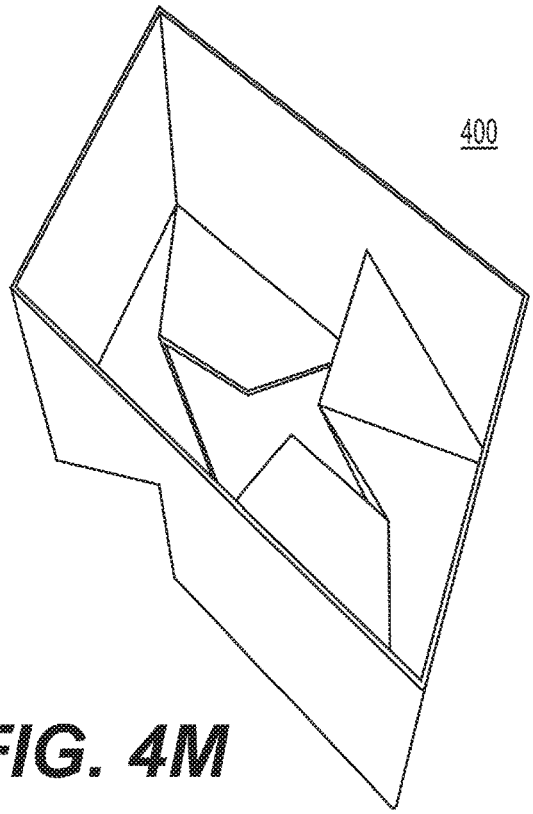
Figure 4N:
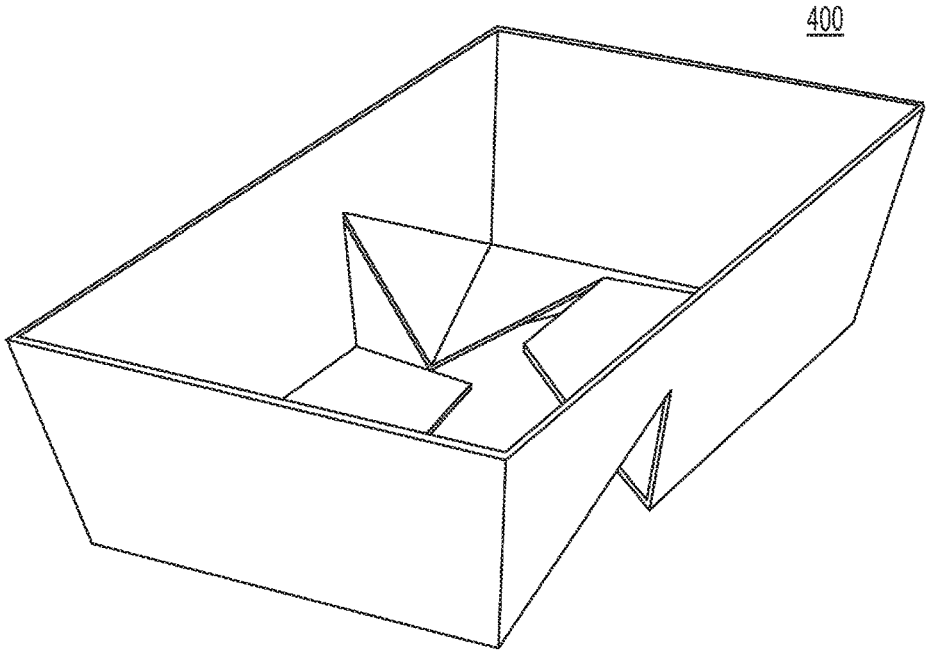

FIG. 4H is a diagram illustrating a further alternative unassembled plan view of the container 400 shown in FIG. 4B, wherein the optional interlock mechanism 460 is an additional component coupled to the main link part 410 and to the additional link part 460, and wherein each of the two secondary panels 402 comprises a plurality of portions.

Figure 4O:
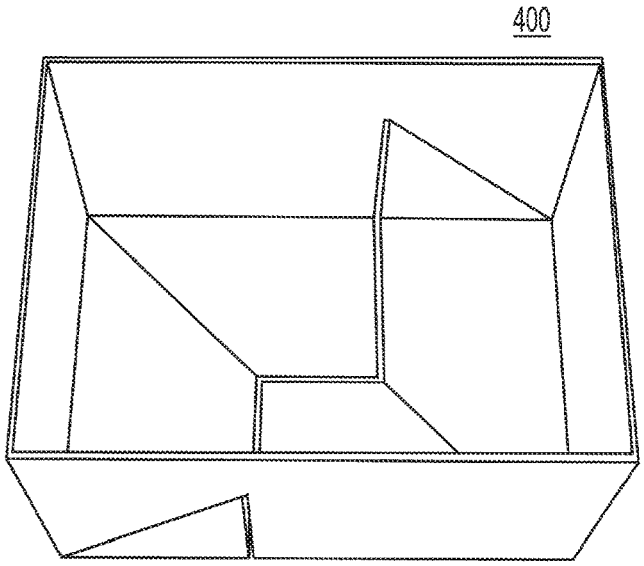
Figure 4P:
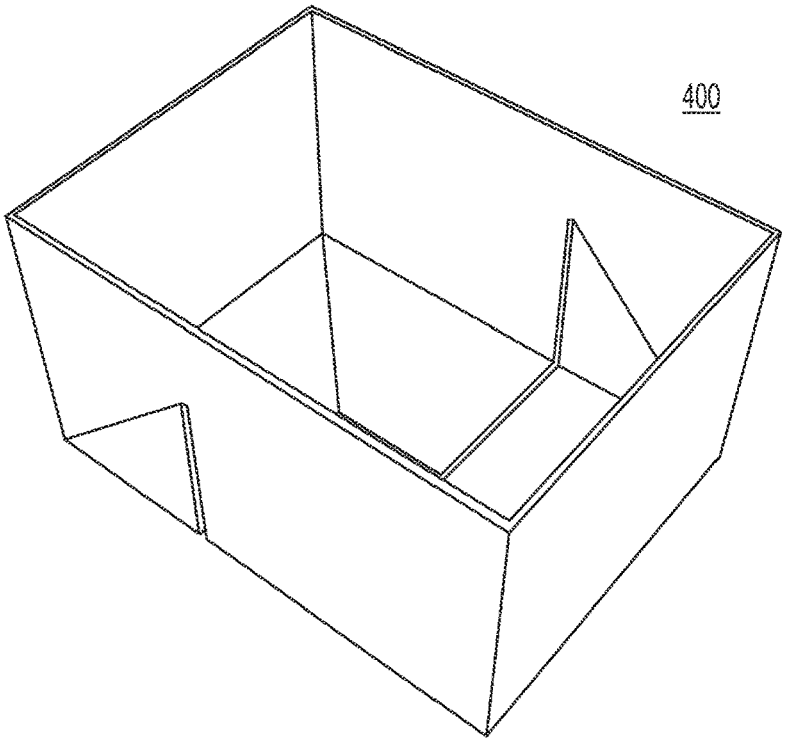

FIGS. 4I-4P is a sequence of diagrams illustrating two perspective views of four different stages of the container 400 using the (unassembled) version of the container shown in FIG. 4G, i.e., when the container is assembled and moved from the flat configuration (FIGS. 4I and 4J), to the transition configurations (FIGS. 4K-4N), and to the box configuration (FIGS. 4O and 4P). The optional interlock mechanism 460, the primary top flaps 421, and the secondary top flaps 422 are omitted for purposes of illustration and explanation only. And the height of the two primary panels 401 and the height of the two secondary panels 402 is smaller than the respective panel heights shown in FIG. 4G (once assembled) for purposes of illustration and explanation only.

With reference to FIGS. 4B-4P, the container 400 starts in a flat configuration, wherein the container 400 lies substantially in a single plane. The main link part 410 is folded and positioned between the two primary panels 401 which are movably coupled to the main link part 410 via primary-link hinges 411. The main link part 410 comprises at least three link portions 412 (which are also referred to as terminal portion 415, first link portion 414*a*, and second link portion 414*b*) movably coupled to each other via link-link hinges 413. The main link part 410 is movably coupled to one of the two secondary panels 402 via a secondary-link hinge 416. An additional link part 450 is also folded and positioned between the two primary panels 401 which are also movably coupled to the additional link part 450 via additional primary-link hinges 451. The additional link part 450 comprises at least three additional link portions 452 (which are also referred to as additional terminal portion 455, first additional link portion 454*a*, and second additional link portion 454*b*) movably coupled to each other via additional link-link hinges 453. The additional link part 450 is movably coupled to the other secondary panel 402 via an additional secondary-link hinge 456. Specifically, in the flat configuration, the terminal portion 415 and the first link portion 414*a* of the at least three link portions are aligned substantially within the same plane, while the second link portion 414*b* is folded onto the first link portion 414*a*. As the container is moved from the flat configuration to a box configuration, the two primary panels 401 move away and sideways from each other. In particular, the two primary panels 401 move clockwise with respect to each other when viewing the container from above (i.e., a plan view). The direction of motion of the two primary panels 401 may be reversed by suitably modifying the configuration and/or orientation of various components of the container. Also, as the container is moved from the flat configuration to the box configuration, the terminal portion 415 of the at least three link portions rotates clockwise for half a circle with respect to the adjacent primary panel 401 via a primary-link hinge 411 when viewing the container from above (i.e., a plan view). Further, as the container is moved from the flat configuration to the box configuration, the link-link hinges 413 rotate towards the base of the container. One of the link-link hinges becomes a base or bottom edge of the container when the container is in the box configuration. Yet further, as the container is moved from the flat configuration to the box configuration, the first link portion 414*a* that is movably coupled to an adjacent one of the two secondary panels 402 rotates away from the adjacent secondary panel 402 towards the base of the container via the secondary-link hinge 416. Yet further, as the container is moved from the flat configuration to the box configuration, the link portions 414*a*, 414*b* of the at least three link portions unfold from each other via a link-link hinge 413 and rotate towards the base of the container, thereby forming, at least partly, a base panel of the container. When the container is in the box configuration, the terminal portion 415 and the additional terminal portion 455 are substantially parallel to each other and are each aligned substantially within the same plane as their respectively adjacent primary panel 401. Specifically, in the box configuration, the link portions 414*a*, 414*b* of the at least three link portions are aligned substantially within the same plane and are substantially perpendicular to the terminal portion 415. Owing to the symmetry of the container, the additional link part 450 behaves and functions similarly (i.e., in an opposing manner) to the main link part 410 when the container is in the flat configuration and in the box configuration, and when the container is moved from the flat configuration to the box configuration. The previous description of the main link part 410 (including its coupling to the two primary panels and to one of the two secondary panels) is applicable, in an opposing manner, to the additional link part 450 (including coupling of the additional link part 450 to the two primary panels and to the other secondary panel). The main link part 410 and the additional link part 450 may be interconnected to maintain, at least partly, the container in the box configuration. Alternatively, the main link part 410 may interlock with the additional link part 450 via an interlock mechanism 460 to maintain, at least partly, the container in the box configuration.

With reference to FIGS. 1A-4P, embodiments are directed to a container 100, 200, 300, 400 movable between a flat configuration and a box configuration different from the flat configuration. The container comprises two primary panels 101, 201, 301, 401, two secondary panels 102, 202, 302, 402, and a main link part 110, 210, 310, 410 movably coupled to the two primary panels via primary-link hinges 111, 211, 311, 411. The main link part comprises at least three link portions 112, 212, 312, 412 movably coupled to each other via link-link hinges 113, 213, 313, 413. The two primary panels 101, 201, 301, 401 are configured to move away and sideways from each other when the container is moved from the flat configuration to the box configuration. The two primary panels 101, 201, 301, 401 face each other across a gap 109, 209, 309, 409 when the container is in the box configuration. The two secondary panels 102, 202, 302, 402 also face each other across the gap 109, 209, 309, 409 when the container is in the box configuration (e.g., FIGS. 1B, 1F, 2B, 2F, 3B, and 4B).

In an embodiment, each of the two primary panels 101, 201, 301, 401 is movably coupled to the two secondary panels 102, 202, 302, 402 via panel hinges 103, 203, 303, 403 (e.g., FIGS. 1B, 2B, 3B, and 4B).

In an embodiment, the two primary panels 101, 201, 301, 401 are substantially parallel to each other when the container is in the flat configuration and in the box configuration (e.g., FIGS. 1F, 1G, 2F, and 2G). It is noted that in FIGS. 1F and 1G, only portions of the primary panels 101 are shown for purposes of illustration and explanation only. Similarly, it is noted that in FIGS. 2F and 2G, only portions of the primary panels 201 are shown for purposes of illustration and explanation only.

In an embodiment, the two primary panels 101, 201, 301, 401 are substantially parallel to each other when the container is moved between the flat configuration and the box configuration (e.g., FIGS. 1C, 2C, 3C, and 4C). At least the two primary panels may be required to bend when the container is moved between the flat configuration and the box configuration.

In an embodiment, each of the primary-link hinges 111, 211, 311, 411 and the link-link hinges 113, 213, 313, 413 (and any other hinge mentioned throughout this description including, for example, panel hinges 103, 203, 303, 403) comprises an item selected from the group consisting of a perforation, a crease, a score, a bend, a section with less thickness than surrounding material, a section with less density than surrounding material, and a combination thereof.

In an embodiment, the container 100, 200, 300, 400 lies substantially in a single plane when the container is in the flat configuration (e.g., FIGS. 1D, 1G, 2D, 2G, 3D, and 4D).

In an embodiment, the container 100, 200, 300, 400 is assembled from a single sheet of material (e.g., FIGS. 1A, 2A, 3A and 4F).

In an embodiment, the container 400 is assembled from a plurality of sheets of material (e.g., FIGS. 4F, 4G, and 4H). An interlock mechanism 460 may optionally be an add-on coupled (e.g., attached) to the container 400.

In an embodiment, the container 100, 200, 300, 400 is biased towards the flat configuration, towards the box configuration, or towards both the flat configuration and the box configuration. Biasing towards the box configuration may be provided by the elastic energy generated by bending portions of the container when the container is moved from the flat configuration to the box configuration. On the other hand, biasing towards the flat configuration may be provided by the elastic energy generated by bending portions of the container when the container is moved from the box configuration to the flat configuration.

Main Link Part

In an embodiment, the main link part 110, 210, 310, 410 is folded onto the two primary panels 101, 201, 301, 401 via the primary-link hinges 111, 211, 311, 411 when the container is in the flat configuration (e.g., FIGS. 1G, 2G, 3C, and 4C).

In an embodiment, the at least three link portions 112, 212, 312, 412 are folded onto each other via at least one of the link-link hinges 113, 213, 313, 413 when the container is in the flat configuration (e.g., FIGS. 1G, 2G, 3C, and 4C).

In an embodiment, at least one 114*a*, 114*b*, 214, 314*a*, 314*b*, 414*a*, 414*b* of the at least three link portions forms, at least partly, a base panel of the container when the container is in the box configuration (e.g., FIGS. 1B, 2B, 3B, and 4B).

In an embodiment, a terminal portion 115, 215*a*, 215*b*, 315*a*, 415 of the at least three link portions and an adjacent primary panel 101, 201, 301, 401 lie substantially in a single plane when the container is in the box configuration (e.g., FIGS. 1B, 2B, 3B, and 4B).

In an embodiment, the terminal portion 415 of the at least three link portions overlaps the adjacent primary panel 401 when the container is in the box configuration (e.g., FIG. 4B).

In an embodiment, the main link part 310, 410 is movably coupled to one of the two secondary panels 302, 402 via a secondary-link hinge 316, 416 (e.g., FIGS. 3A and 4A).

In an embodiment, the main link part 310, 410 is folded onto one of the two secondary panels 302, 402 via the secondary-link hinge 316, 416 when the container is in the flat configuration (e.g., FIGS. 3A and 4A).

In an embodiment, the main link part 310 is movably coupled to the two secondary panels 302 via secondary-link hinges 316 (e.g., FIG. 3A).

In an embodiment, the main link part 110, 210, 310, 410 lies above a lowest edge of the two primary panels 106, 206, 306, 406 when the container is in the flat configuration (e.g., FIGS. 1D, 2D, 3D, and 4D).

Top Flap

In an embodiment, the container 100, 200, 300, 400 further comprises at least one primary top flap 121, 221, 321, 421 movably coupled to at least one of the two primary panels 101, 201, 301, 401 via at least one primary-top hinge 123, 223, 323, 423 (e.g., FIGS. 1A, 2A, 3A, and 4A).

In an embodiment, the container 100, 200, 300, 400 further comprises at least one secondary top flap 122, 222, 322, 422 movably coupled to at least one of the two secondary panels 102, 202, 302, 402 via at least one secondary-top hinge 124, 224, 324, 424 (e.g., FIGS. 1A, 2A, 3A, and 4A).

Bottom Flap

In an embodiment, the container 300 further comprises a primary bottom flap 331 movably coupled to a first of the two primary panels 301 via a primary-bottom hinge 333 (e.g., FIG. 3A).

In an embodiment, the primary bottom flap 331 is placed against the main link part 310 when the container is in the box configuration (e.g., FIG. 3B).

In an embodiment, the primary bottom flap 331 is adjacent to a terminal portion 315*b* of the at least three link portions when the container is in the box configuration, and thereby capable of at least partly maintaining the container in the box configuration (e.g., FIG. 3B).

In an embodiment, the primary bottom flap 331 is adjacent to one of the two secondary panels 302 when the container is in the box configuration, and thereby capable of at least partly maintaining the container in the box configuration (e.g., FIG. 3B).

In an embodiment, the primary bottom flap 331 is adjacent to a second of the two primary panels 301 when the container is in the box configuration, and thereby capable of at least partly maintaining the container in the box configuration (e.g., FIG. 3B).

In an embodiment, the primary bottom flap 331 may interlock with the main link part 310 when the container is in the box configuration. For example, the interlock may be enabled by a slit in the main link part 310 where a portion of the primary bottom flap 331 may be inserted. Alternatively, the interlock may be enabled by a friction-fit of the primary bottom flap 331 against the opposing primary panel of the two primary panels 301 and/or against the terminal portion 315*b*.

In an embodiment, the container 100, 200 further comprises at least one secondary bottom flap 132, 232 movably coupled to at least one of the two secondary panels 102, 202 via at least one secondary-bottom hinge 134, 234 (e.g., FIGS. 1A and 2A).

In an embodiment, the at least one secondary bottom flap 132, 232 is placed against the main link part 110, 210 when the container is in the box configuration (e.g., FIGS. 1B and 2B).

In an embodiment, the at least one secondary bottom flap 132, 232 is adjacent to the two primary panels 101, 201 when the container is in the box configuration, and thereby capable of at least partly maintaining the container in the box configuration (e.g., FIGS. 1B and 2B).

In an embodiment, the at least one secondary bottom flap 132, 232 may interlock with the main link part 110, 210 when the container is in the box configuration. For example, the interlock may be enabled by a slit in the main link part 110, 210 where a portion of the at least one secondary bottom flap 132, 232 may be inserted. Alternatively, the interlock may be enabled by a friction-fit of the at least one secondary bottom flap 132, 232 between the two primary panels 101, 201, between the terminal portion 115 and the opposite primary panel 101, and/or between terminal portions 215*a*, 215*b*.

Additional Link Part

In an embodiment, the container 400 further comprises an additional link part 450 movably coupled to the two primary panels 401 via additional primary-link hinges 451. The additional link part 450 comprises at least three additional link portions 452 movably coupled to each other via additional link-link hinges 453 (e.g., FIG. 4A).

In an embodiment, a first link portion 414*a* of the at least three link portions is movably coupled to a first of the two secondary panels via a secondary-link hinge 416. A second link portion 414*b* of the at least three link portions is movably coupled to a first of the two primary panels 401 via one of the primary-link hinges 411. A first additional link portion 454*a* of the at least three additional link portions is movably coupled to a second of the two secondary panels 402 via an additional secondary-link hinge 456. A second additional link portion 454*b* of the at least three additional link portions is movably coupled to a second of the two primary panels 401 via one of the additional primary-link hinges 451. The first link portion 414*a* of the at least three link portions is placed against the second additional link portion 454*b* of the at least three additional link portions when the container is in the box configuration (e.g., FIGS. 4A and 4B).

In an embodiment, a first link portion 414*a* of the at least three link portions is movably coupled to a first of the two secondary panels via a secondary-link hinge 416. A second link portion 414*b* of the at least three link portions is movably coupled to a first of the two primary panels 401 via one of the primary-link hinges 411. A first additional link portion 454*a* of the at least three additional link portions is movably coupled to a second of the two secondary panels 402 via an additional secondary-link hinge 456. A second additional link portion 454*b* of the at least three additional link portions is movably coupled to a second of the two primary panels 401 via one of the additional primary-link hinges 451. The second link portion 414*b* of the at least three link portions is placed against at least one of the first additional link portion 454*a* of the at least three additional link portions or the second additional link portion 454*b* of the at least three additional link portions, when the container is in the box configuration (e.g., FIGS. 4A and 4B).

In an embodiment, the main link part 410 interlocks with the additional link part 450 via an interlock mechanism 460 when the container is in the box configuration (e.g., FIGS. 4A, 4B, 4F, 4G, and 4H).

Exemplary Methods

Figure 5:
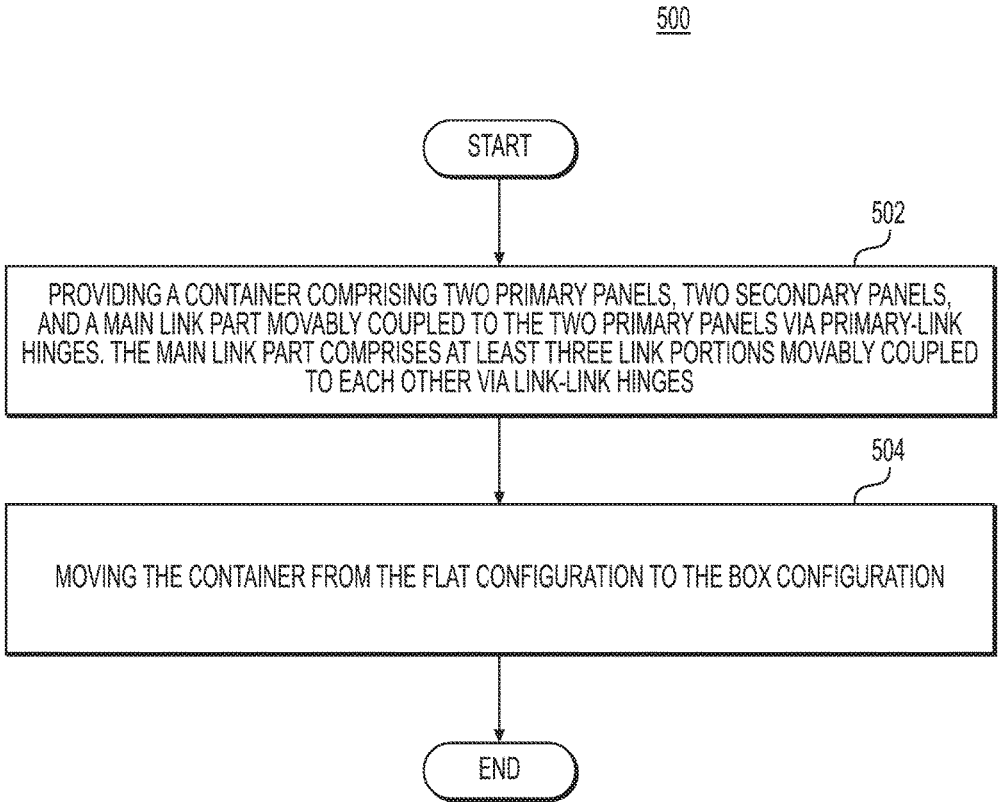
FIG. 5 is a flowchart illustrating an embodiment of a method of using a container.

Embodiments are also directed to a method of using a container that is movable between a flat configuration and a box configuration different from the flat configuration. FIG. 5 is a flowchart illustrating an embodiment of a method 500 of using a container. The method 500 comprises providing a container comprising two primary panels, two secondary panels, and a main link part movably coupled to the two primary panels via primary-link hinges, wherein the main link part comprises at least three link portions movably coupled to each other via link-link hinges (block 502). The method also comprises moving the container from the flat configuration to the box configuration (block 504), wherein the two primary panels move away and sideways from each other. The two primary panels face each other across a gap, and the two secondary panels face each other across the gap, when the container is in the box configuration.

In an embodiment, each of the two primary panels is movably coupled to the two secondary panels via panel hinges.

In an embodiment, the step of moving comprises applying pressure (i.e., inward or outward pressure) to at least one of the panel hinges.

In an embodiment, the step of providing further comprises assembling the container from a single sheet of material.

In an embodiment, the main link part is folded onto the two primary panels via the primary-link hinges when the container is in the flat configuration.

In an embodiment, the at least three link portions are folded onto each other via at least one of the link-link hinges when the container is in the flat configuration.

In an embodiment, a base panel of the container is formed, at least partly, using at least one of the at least three link portions when the container is in the box configuration.

In an embodiment, the main link part is movably coupled to one of the two secondary panels via a secondary-link hinge. The main link part is folded onto one of the two secondary panels via the secondary-link hinge when the container is in the flat configuration.

In an embodiment, the main link part is movably coupled to the two secondary panels via secondary-link hinges. The main link part is folded onto the two secondary panels via the secondary-link hinges when the container is in the flat configuration.

In an embodiment, the container further comprises a primary bottom flap movably coupled to one of the two primary panels via a primary-bottom hinge.

In an embodiment, the method further comprises placing the primary bottom flap against the main link part.

In an embodiment, the primary bottom flap is used to maintain, at least partly, the container in the box configuration.

In an embodiment, the method further comprises interlocking the primary bottom flap with the main link part.

In an embodiment, the container further comprises at least one secondary bottom flap movably coupled to at least one of the two secondary panels via at least one secondary-bottom hinge.

In an embodiment, the method further comprises placing the at least one secondary bottom flap against the main link part.

In an embodiment, the at least one secondary bottom flap is used to maintain, at least partly, the container in the box configuration.

In an embodiment, the method further comprises interlocking the at least one secondary bottom flap with the main link part.

In an embodiment, the container further comprises an additional link part movably coupled to the two primary panels via additional primary-link hinges, wherein the additional link part comprises at least three additional link portions movably coupled to each other via additional link-link hinges.

In an embodiment, a first link portion of the at least three link portions is movably coupled to a first of the two secondary panels via a secondary-link hinge, wherein a second link portion of the at least three link portions is movably coupled to a first of the two primary panels via one of the primary-link hinges, wherein a first additional link portion of the at least three additional link portions is movably coupled to a second of the two secondary panels via an additional secondary-link hinge, wherein a second additional link portion of the at least three additional link portions is movably coupled to a second of the two primary panels via one of the additional primary-link hinges, and wherein the step of moving further comprises placing the first link portion of the at least three link portions against the second additional link portion of the at least three additional link portions.

In an embodiment, a first link portion of the at least three link portions is movably coupled to a first of the two secondary panels via a secondary-link hinge, wherein a second link portion of the at least three link portions is movably coupled to a first of the two primary panels via one of the primary-link hinges, wherein a first additional link portion of the at least three additional link portions is movably coupled to a second of the two secondary panels via an additional secondary-link hinge, wherein a second additional link portion of the at least three additional link portions is movably coupled to a second of the two primary panels via one of the additional primary-link hinges, and wherein the step of moving further comprises placing the second link portion of the at least three link portions against at least one of the first additional link portion of the at least three additional link portions or the second additional link portion of the at least three additional link portions.

In an embodiment, the step of moving further comprises interlocking the main link part with the additional link part via an interlock mechanism.

In an embodiment, the method further comprises moving the container from the box configuration to the flat configuration, wherein the two primary panels are moved towards each other.

Figure 6A:
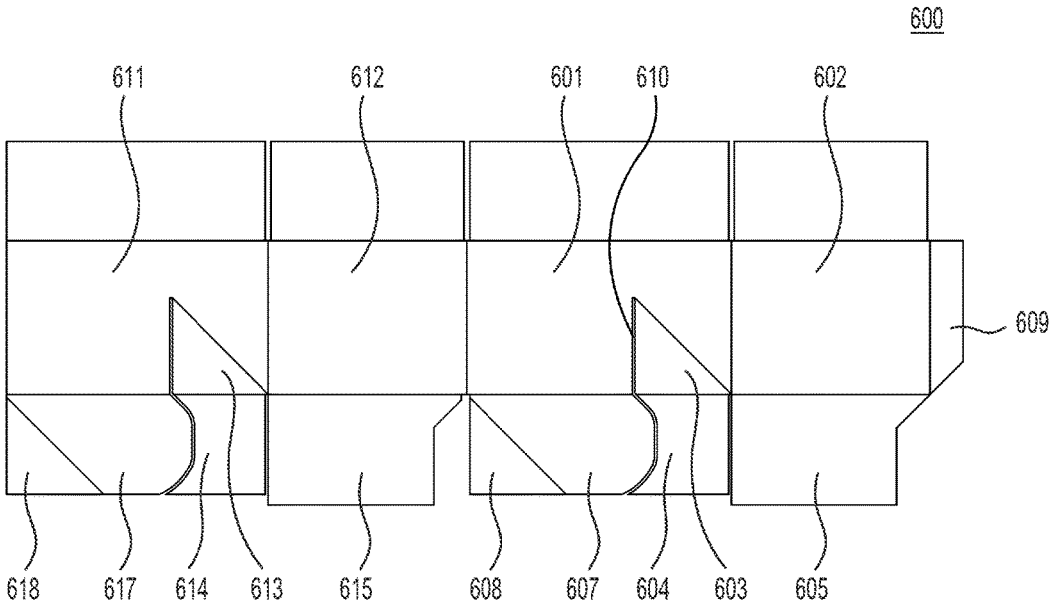
FIG. 6A is a diagram illustrating a plan view of an embodiment of a blank used for making a container. The blank comprises a primary panel and a secondary panel, which are hingedly coupled to each other. The primary panel is hingedly coupled to a terminal portion, wherein the terminal portion is hingedly coupled to a terminal flap. The primary panel is hingedly coupled to a primary flap. An attachment portion is hingedly coupled to the primary flap. The secondary panel is hingedly coupled to a secondary flap. The primary panel is hingedly coupled to a second secondary panel. A second secondary flap is hingedly coupled to the second secondary panel. An end flap is hingedly coupled to the secondary panel.

FIG. 6A is a diagram illustrating a plan view of an embodiment of a blank 600 used for making a container. The blank comprises a primary panel 601 and a secondary panel 602, which are hingedly coupled to each other. The primary panel 601 is hingedly coupled to a terminal portion 603, wherein the terminal portion 603 is hingedly coupled to a terminal flap 604. The primary panel 601 is hingedly coupled to a primary flap 607. An attachment portion 608 is hingedly coupled to the primary flap 607. The secondary panel 602 is hingedly coupled to a secondary flap 605. The primary panel 601 is hingedly coupled to a second secondary panel 612. A second secondary flap 615 is hingedly coupled to the second secondary panel 612. An end flap 609 is hingedly coupled to the secondary panel 602.

Figure 6B:
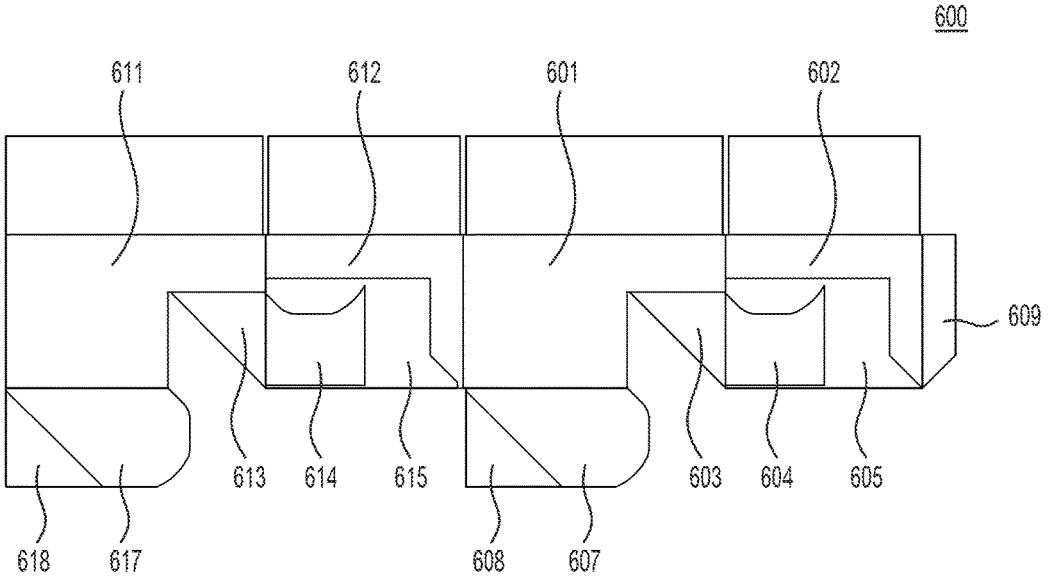
FIG. 6B is a diagram illustrating a plan view of the blank shown in FIG. 6A, wherein the secondary flap is folded towards the secondary panel. The terminal portion is folded towards the primary panel. The terminal flap is connected to the secondary flap.

FIG. 6B is a diagram illustrating a plan view of the blank 600 shown in FIG. 6A, wherein the secondary flap 605 is folded towards the secondary panel 602. The terminal portion 603 is folded towards the primary panel 601. The terminal flap 604 is connected to the secondary flap 605.

Figure 6C:
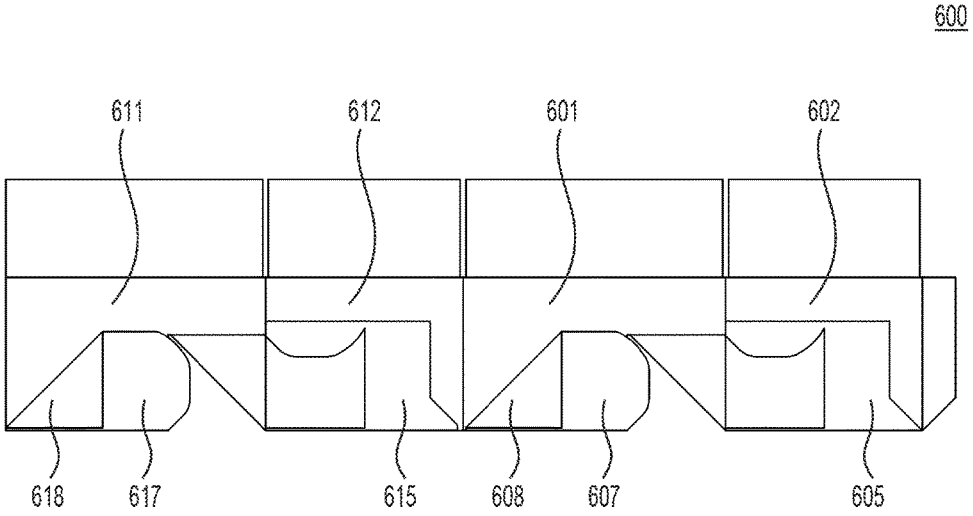
FIG. 6C is a diagram illustrating a plan view of the blank shown in FIG. 6A, wherein the primary flap is folded towards the primary panel. The attachment portion is folded towards the primary flap.

FIG. 6C is a diagram illustrating a plan view of the blank 600 shown in FIG. 6A, wherein the primary flap 607 is folded towards the primary panel 601. The attachment portion 608 is folded towards the primary flap 607.

Figure 6D:
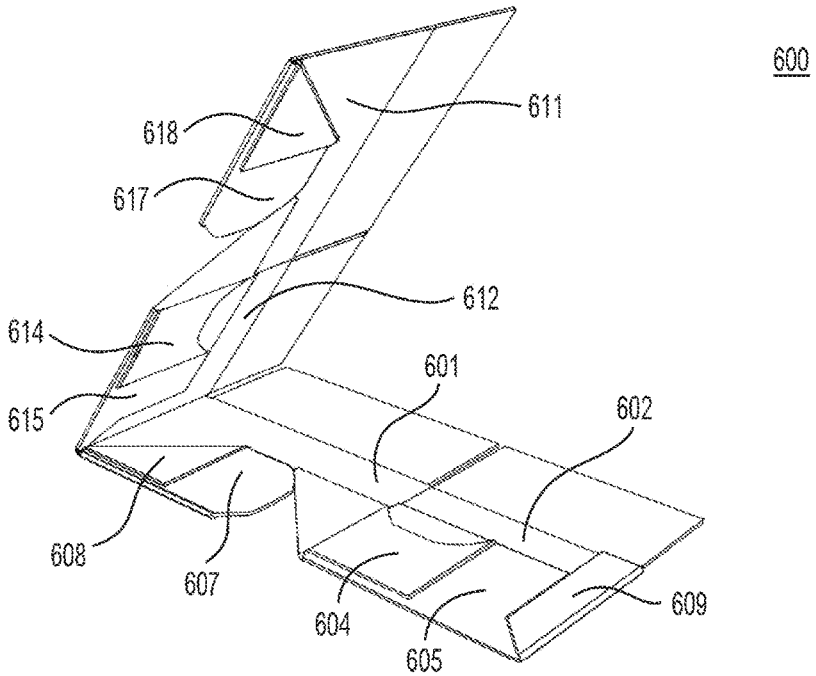
FIG. 6D is a diagram illustrating a perspective view of the blank shown in FIG. 6A, wherein the second secondary flap is folded towards the second secondary panel. The end flap is folded towards the secondary panel. The second secondary panel is folding towards the primary panel.

FIG. 6D is a diagram illustrating a perspective view of the blank 600 shown in FIG. 6A, wherein the second secondary flap 615 is folded towards the second secondary panel 612. The end flap 609 is folded towards the secondary panel 602. The second secondary panel 612 is folding towards the primary panel 601.

Figure 6E:
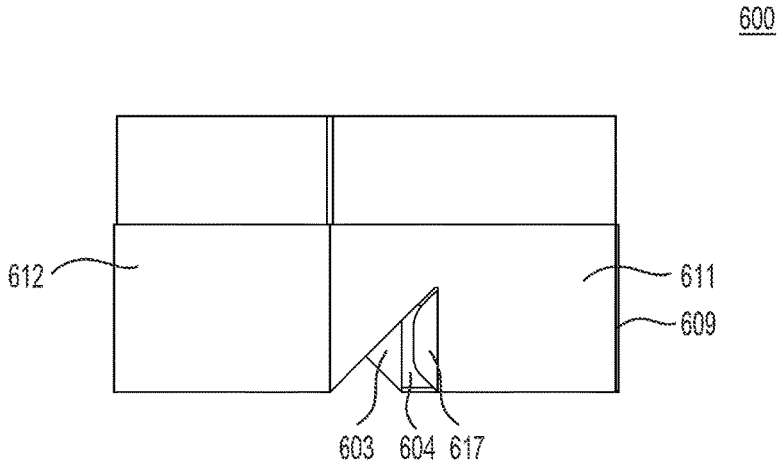
FIG. 6E is a diagram illustrating a plan view of a flat configuration of the container made from the blank shown in FIG. 6A. The second secondary panel is folded towards the primary panel (not visible). The second secondary flap (not visible) is folded towards the second secondary panel. The attachment portion (not visible) is folded towards the primary flap (not visible). The attachment portion (not visible) is connected to the second secondary flap (not visible)

FIG. 6E is a diagram illustrating a plan view of a flat configuration of the container made from the blank 600 shown in FIG. 6A. The second secondary panel 612 is folded towards the primary panel 601 (not visible). The second secondary flap 615 (not visible) is folded towards the second secondary panel 612. The attachment portion 608 (not visible) is folded towards the primary flap 607 (not visible). The attachment portion 608 (not visible) is connected to the second secondary flap 615 (not visible).

Figure 6F:
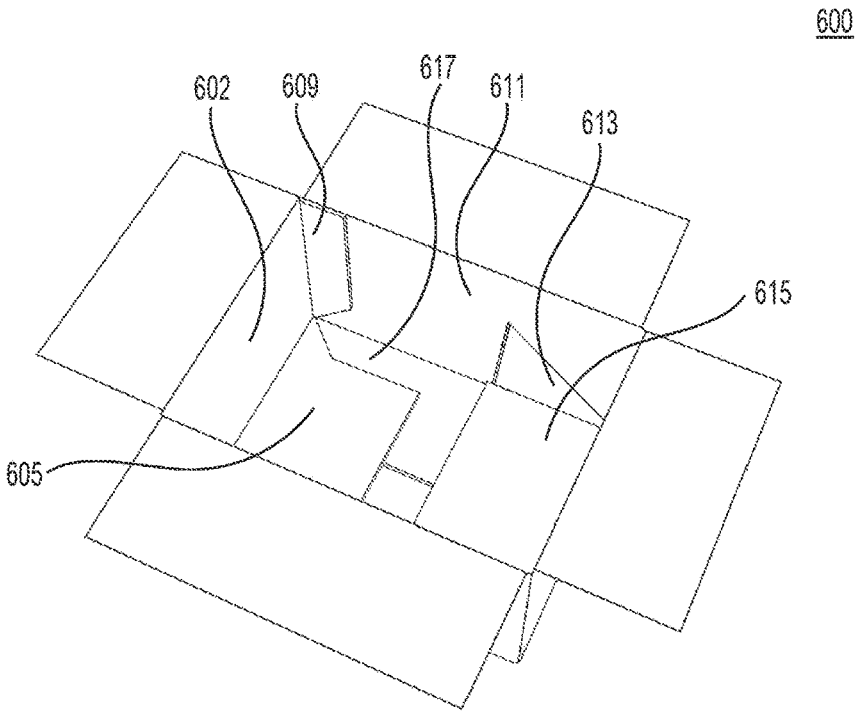
FIG. 6F is a diagram illustrating a top perspective view of a box configuration of the container made from the blank shown in FIG. 6A.

FIG. 6F is a diagram illustrating a top perspective view of a box configuration of the container made from the blank 600 shown in FIG. 6A.

Figure 6G:
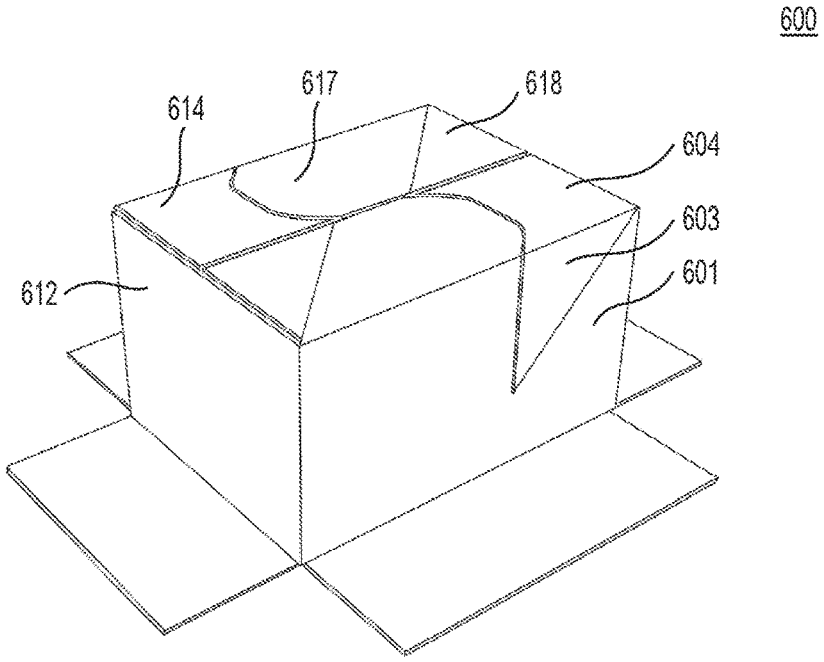
FIG. 6G is a diagram illustrating a bottom perspective view of the box configuration of the container made from the blank shown in FIG. 6A.

FIG. 6G is a diagram illustrating a bottom perspective view of the box configuration of the container made from the blank 600 shown in FIG. 6A.

With reference to FIGS. 6E-6G, the container made from the blank 600 shown in FIG. 6A moves in a similar manner as the container shown in FIGS. 4B-4E and 4I-4P and described in the corresponding description, when the container is moved from a flat configuration to a box configuration.

Figure 7A:
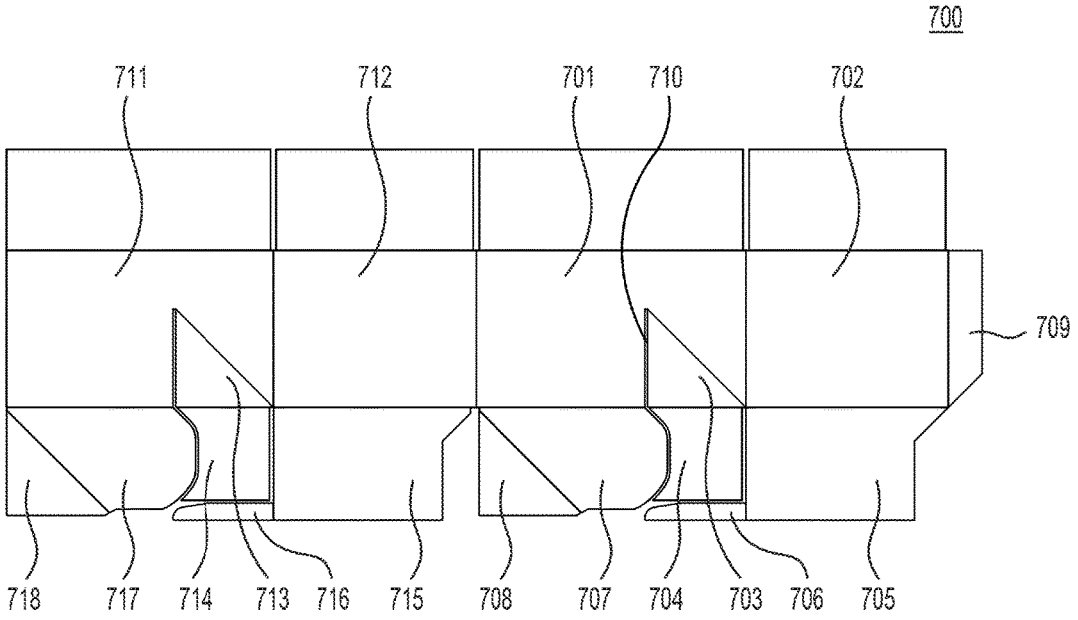
FIG. 7A is a diagram illustrating a plan view of an embodiment of a blank used for making a container. The blank comprises a primary panel and a secondary panel, which are hingedly coupled to each other. The primary panel is hingedly coupled to a terminal portion, wherein the terminal portion is hingedly coupled to a terminal flap. The primary panel is hingedly coupled to a primary flap. An attachment portion is hingedly coupled to the primary flap. The secondary panel is hingedly coupled to a secondary flap. A tab is hingedly coupled to the secondary flap. The primary panel is hingedly coupled to a second secondary panel. A second secondary flap is hingedly coupled to the second secondary panel. An end flap is hingedly coupled to the secondary panel.

FIG. 7A is a diagram illustrating a plan view of an embodiment of a blank 700 used for making a container. The blank comprises a primary panel 701 and a secondary panel 702, which are hingedly coupled to each other. The primary panel 701 is hingedly coupled to a terminal portion 703, wherein the terminal portion 703 is hingedly coupled to a terminal flap 704. The primary panel 701 is hingedly coupled to a primary flap 707. An attachment portion 708 is hingedly coupled to the primary flap 707. The secondary panel 702 is hingedly coupled to a secondary flap 705. A tab 706 is hingedly coupled to the secondary flap 705. The primary panel 701 is hingedly coupled to a second secondary panel 712. A second secondary flap 715 is hingedly coupled to the second secondary panel 712. An end flap 709 is hingedly coupled to the secondary panel 702.

Figure 7B:
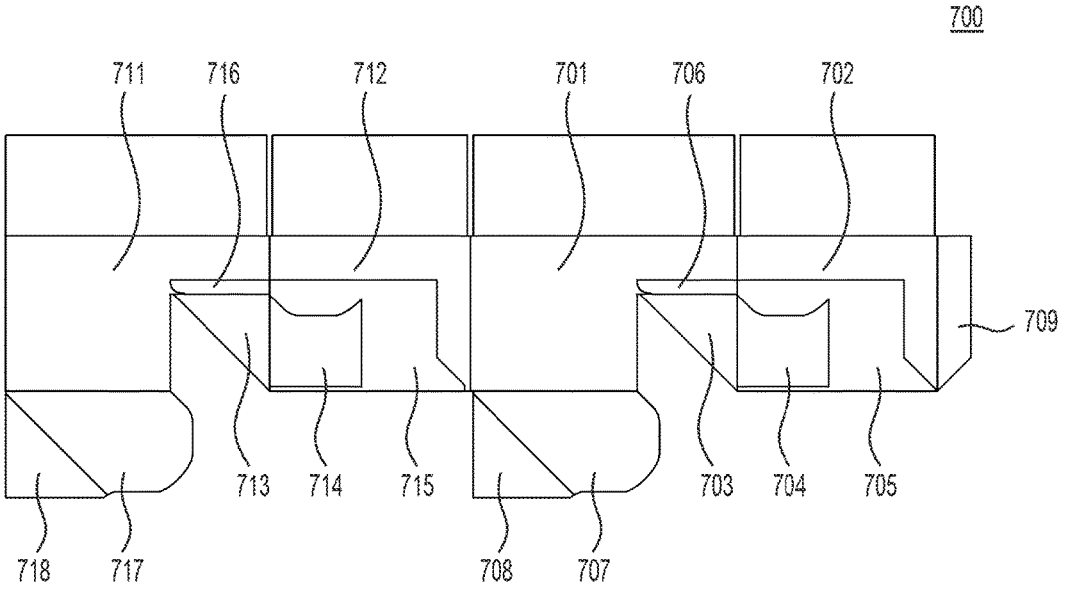
FIG. 7B is a diagram illustrating a plan view of the blank shown in FIG. 7A, wherein the secondary flap is folded towards the secondary panel. The terminal portion is folded towards the primary panel. The terminal flap is connected to the secondary flap. The tab is connected to the terminal portion.

FIG. 7B is a diagram illustrating a plan view of the blank 700 shown in FIG. 7A, wherein the secondary flap 705 is folded towards the secondary panel 702. The terminal portion 703 is folded towards the primary panel 701. The terminal flap 704 is connected to the secondary flap 705. The tab 706 is connected to the terminal portion 703.

Figure 7C:
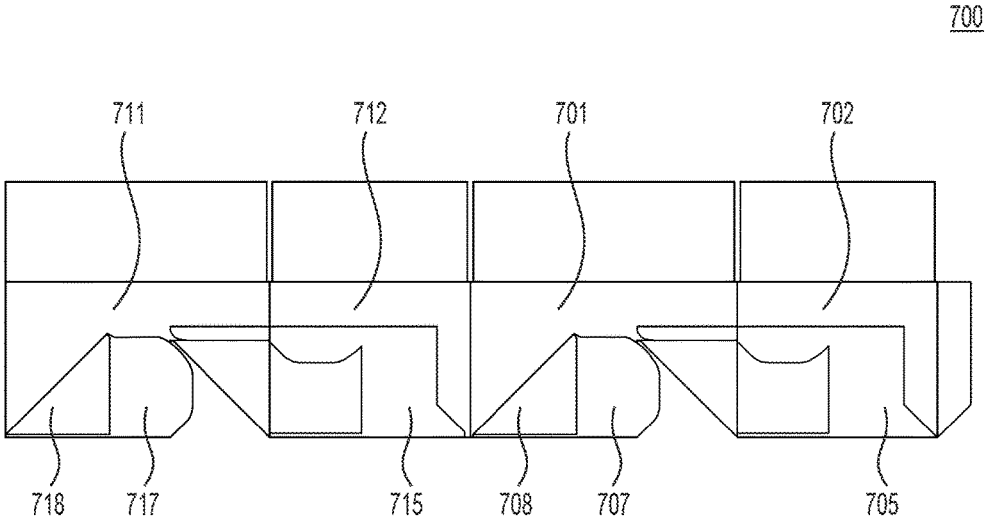
FIG. 7C is a diagram illustrating a plan view of the blank shown in FIG. 7A, wherein the primary flap is folded towards the primary panel. The attachment portion is folded towards the primary flap.

FIG. 7C is a diagram illustrating a plan view of the blank 700 shown in FIG. 7A, wherein the primary flap 707 is folded towards the primary panel 701. The attachment portion 708 is folded towards the primary flap 707.

Figure 7D:
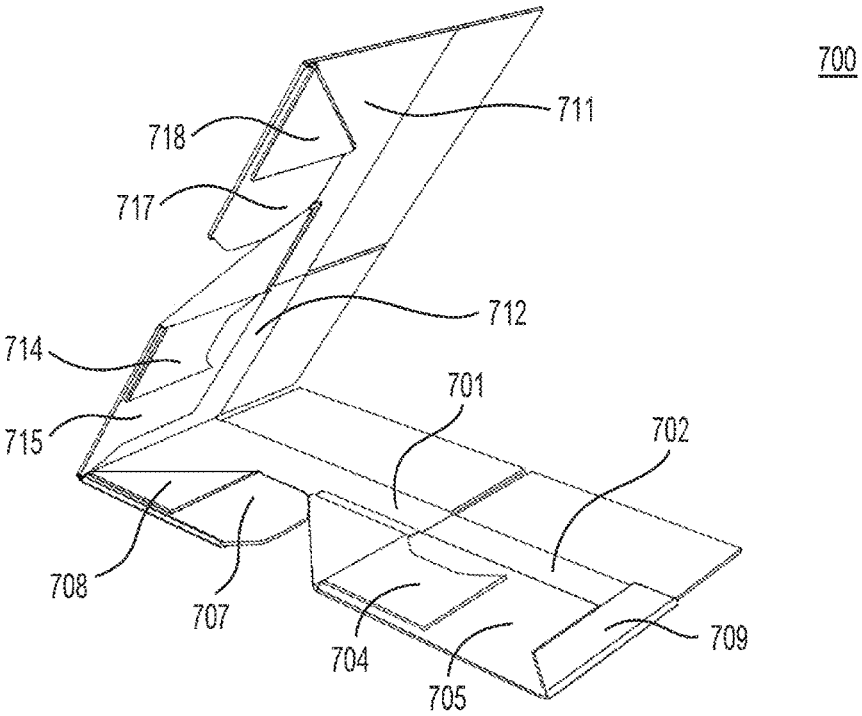
FIG. 7D is a diagram illustrating a perspective view of the blank shown in FIG. 7A, wherein the second secondary flap is folded towards the second secondary panel. The end flap is folded towards the secondary panel. The second secondary panel is folding towards the primary panel.

FIG. 7D is a diagram illustrating a perspective view of the blank 700 shown in FIG. 7A, wherein the second secondary flap 715 is folded towards the second secondary panel 712. The end flap 709 is folded towards the secondary panel 702. The second secondary panel 712 is folding towards the primary panel 701.

Figure 7E:
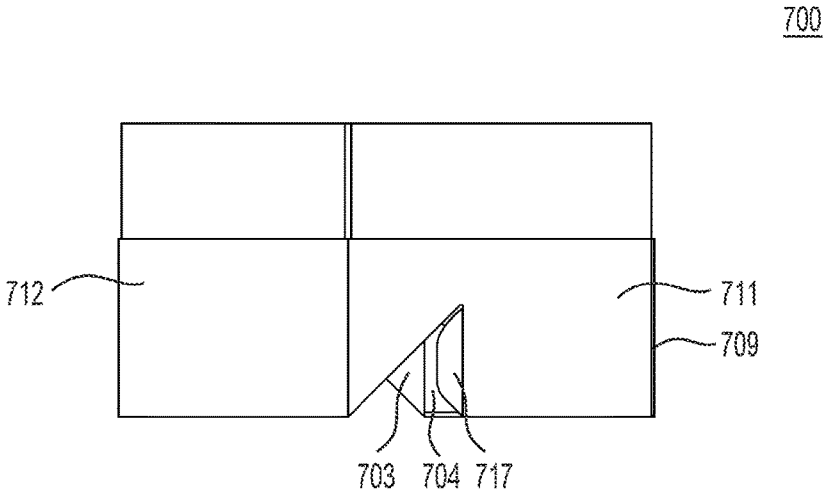
FIG. 7E is a diagram illustrating a plan view of a flat configuration of the container made from the blank shown in FIG. 7A. The second secondary panel is folded towards the primary panel (not visible). The second secondary flap (not visible) is folded towards the second secondary panel. The attachment portion (not visible) is folded towards the primary flap (not visible). The attachment portion (not visible) is connected to the second secondary flap (not visible)

FIG. 7E is a diagram illustrating a plan view of a flat configuration of the container made from the blank 700 shown in FIG. 7A. The second secondary panel 712 is folded towards the primary panel 701 (not visible). The second secondary flap 715 (not visible) is folded towards the second secondary panel 712. The attachment portion 708 (not visible) is folded towards the primary flap 707 (not visible). The attachment portion 708 (not visible) is connected to the second secondary flap 715 (not visible).

Figure 7F:
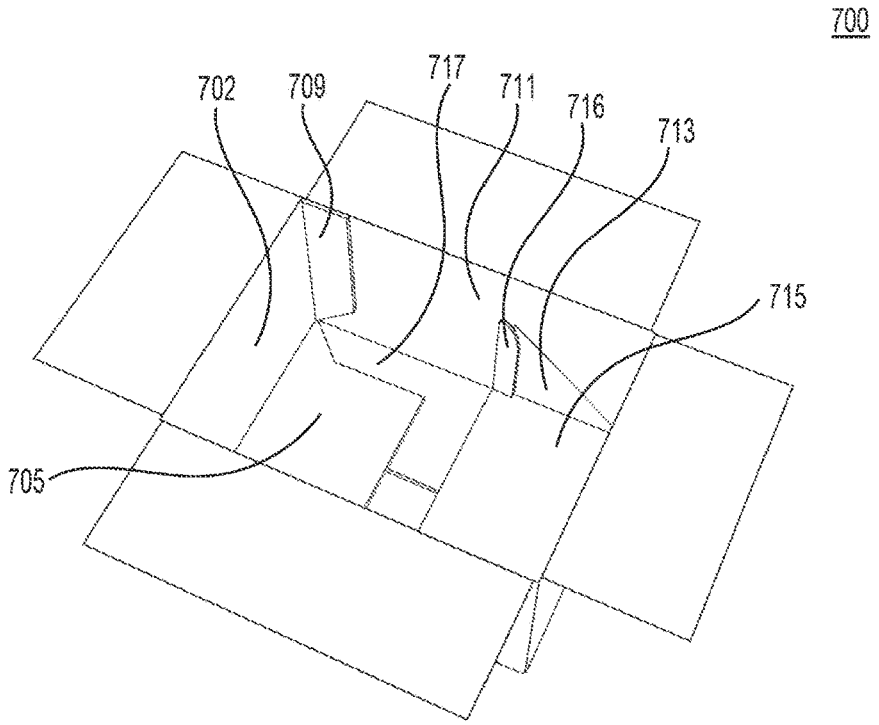
FIG. 7F is a diagram illustrating a top perspective view of a box configuration of the container made from the blank shown in FIG. 7A.

FIG. 7F is a diagram illustrating a top perspective view of a box configuration of the container made from the blank 700 shown in FIG. 7A.

Figure 7G:
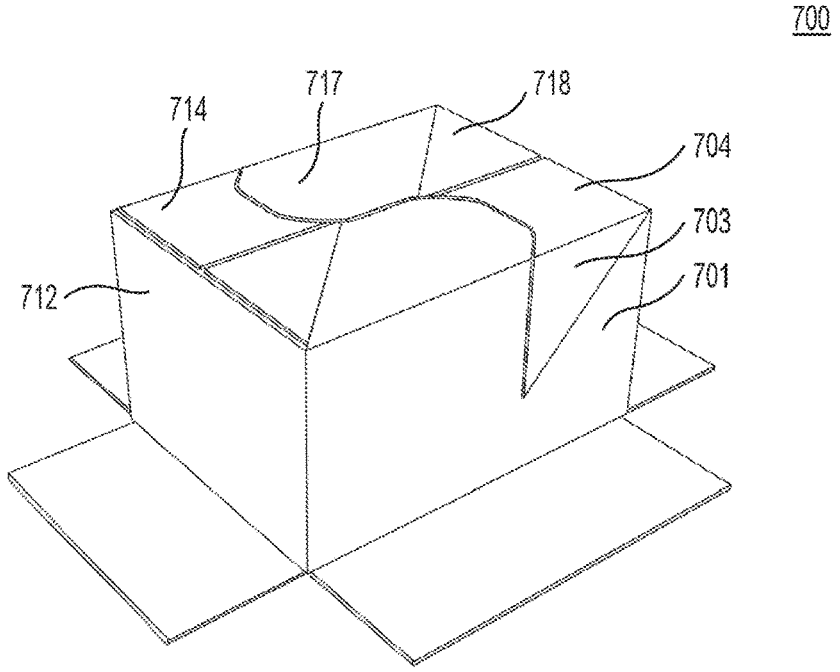
FIG. 7G is a diagram illustrating a bottom perspective view of the box configuration of the container made from the blank shown in FIG. 7A.

FIG. 7G is a diagram illustrating a bottom perspective view of the box configuration of the container made from the blank 700 shown in FIG. 7A.

With reference to FIGS. 7E-7G, the container made from the blank 700 shown in FIG. 7A moves in a similar manner as the container described in FIGS. 4B-4E and 4I-4P and described in the corresponding description, when the container is moved from a flat configuration to a box configuration.

Figure 8A:
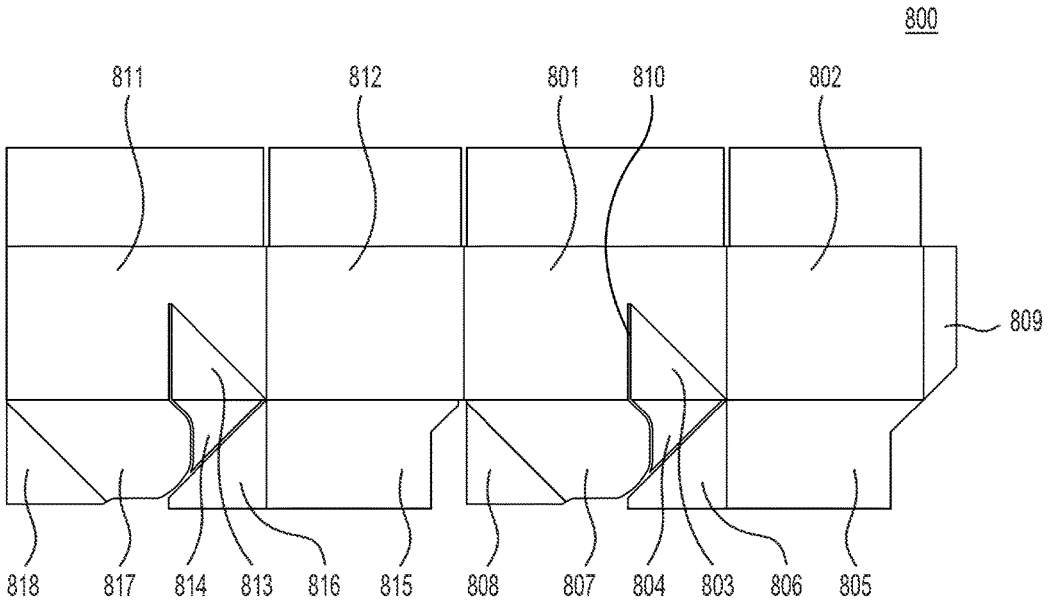
FIG. 8A is a diagram illustrating a plan view of an embodiment of a blank used for making a container. The blank comprises a primary panel and a secondary panel, which are hingedly coupled to each other. The primary panel is hingedly coupled to a terminal portion, wherein the terminal portion is hingedly coupled to a terminal flap. The primary panel is hingedly coupled to a primary flap. An attachment portion is hingedly coupled to the primary flap. The secondary panel is hingedly coupled to a secondary flap. A tab is hingedly coupled to the secondary flap. The primary panel is hingedly coupled to a second secondary panel. A second secondary flap is hingedly coupled to the second secondary panel. An end flap is hingedly coupled to the secondary panel.

FIG. 8A is a diagram illustrating a plan view of an embodiment of a blank 800 used for making a container. The blank comprises a primary panel 801 and a secondary panel 802, which are hingedly coupled to each other. The primary panel 801 is hingedly coupled to a terminal portion 803, wherein the terminal portion 803 is hingedly coupled to a terminal flap 804. The primary panel 801 is hingedly coupled to a primary flap 807. An attachment portion 808 is hingedly coupled to the primary flap 807. The secondary panel 802 is hingedly coupled to a secondary flap 805. A tab 806 is hingedly coupled to the secondary flap 805. The primary panel 801 is hingedly coupled to a second secondary panel 812. A second secondary flap 815 is hingedly coupled to the second secondary panel 812. An end flap 809 is hingedly coupled to the secondary panel 802.

Figure 8B:
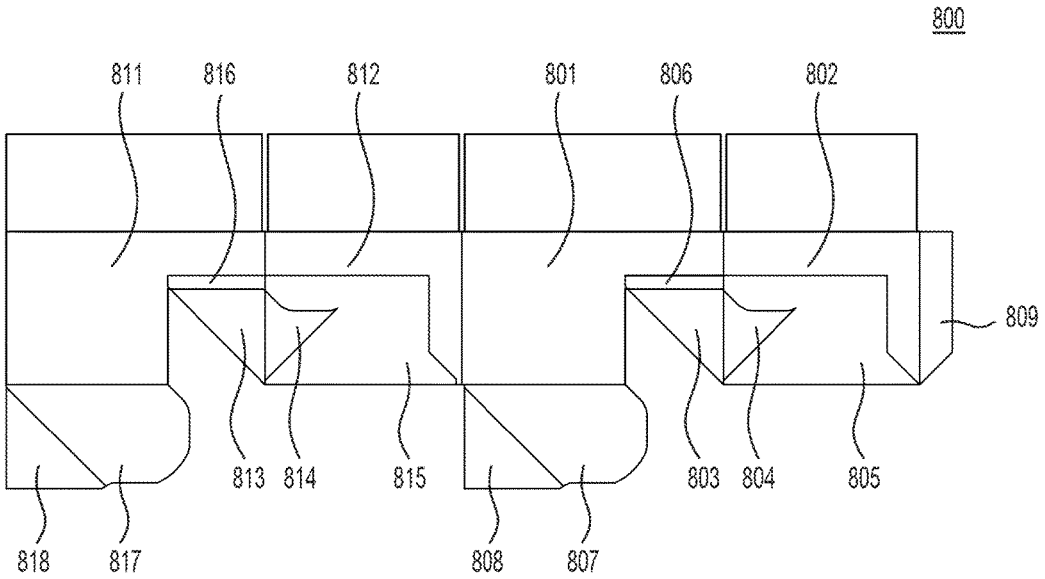
FIG. 8B is a diagram illustrating a plan view of the blank shown in FIG. 8A, wherein the secondary flap is folded towards the secondary panel. The terminal portion is folded towards the primary panel. The terminal flap is connected to the secondary flap. The tab is connected to the terminal portion.

FIG. 8B is a diagram illustrating a plan view of the blank 800 shown in FIG. 8A, wherein the secondary flap 805 is folded towards the secondary panel 802. The terminal portion 803 is folded towards the primary panel 801. The terminal flap 804 is connected to the secondary flap 805. The tab 806 is connected to the terminal portion 803.

Figure 8C:
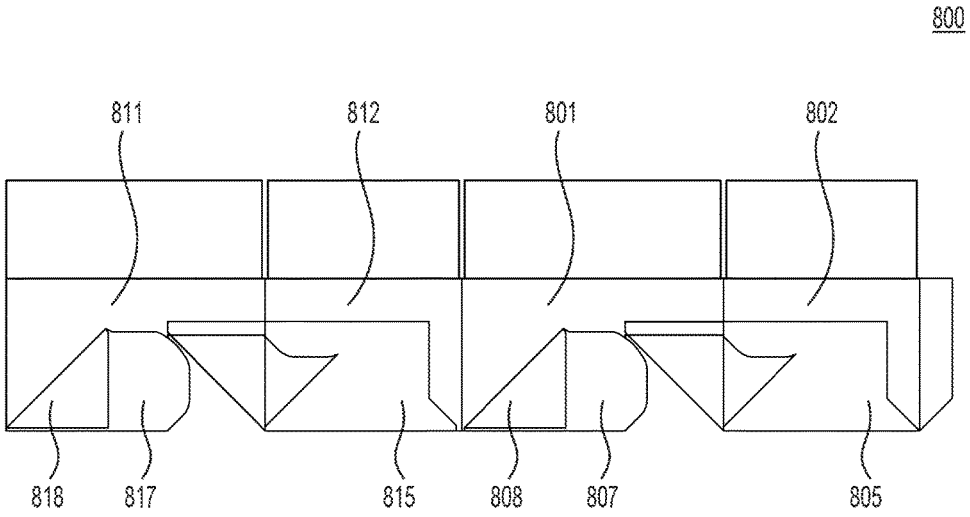
FIG. 8C is a diagram illustrating a plan view of the blank shown in FIG. 8A, wherein the primary flap is folded towards the primary panel. The attachment portion is folded towards the primary flap.

FIG. 8C is a diagram illustrating a plan view of the blank 800 shown in FIG. 8A, wherein the primary flap 807 is folded towards the primary panel 801. The attachment portion 808 is folded towards the primary flap 807.

Figure 8D:
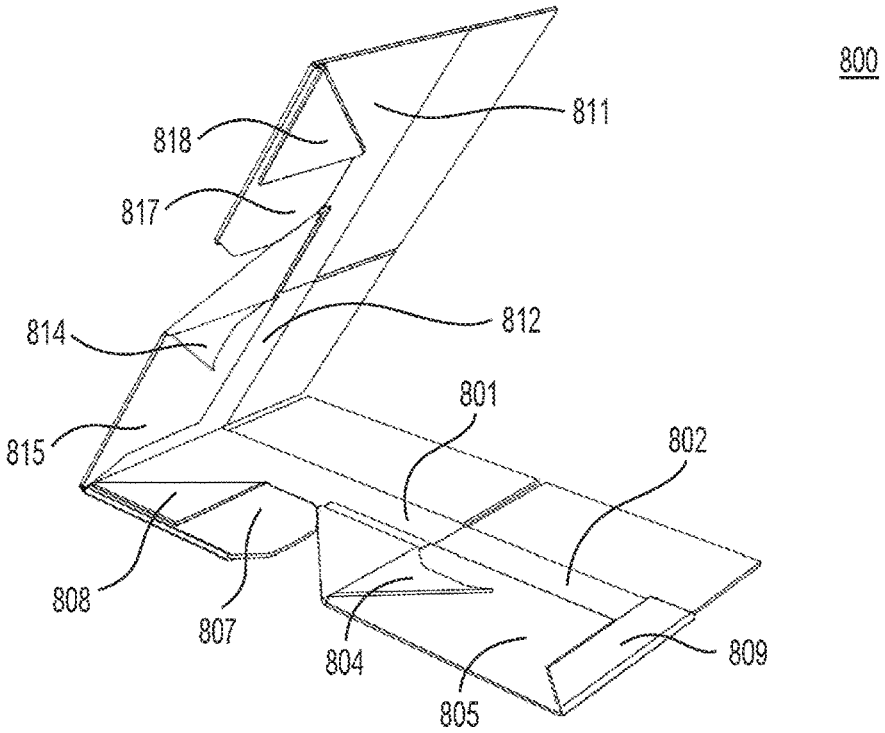
FIG. 8D is a diagram illustrating a perspective view of the blank shown in FIG. 8A, wherein the second secondary flap is folded towards the second secondary panel. The end flap is folded towards the secondary panel. The second secondary panel is folding towards the primary panel.

FIG. 8D is a diagram illustrating a perspective view of the blank 800 shown in FIG. 8A, wherein the second secondary flap 815 is folded towards the second secondary panel 812. The end flap 809 is folded towards the secondary panel 802. The second secondary panel 812 is folding towards the primary panel 801.

Figure 8E:
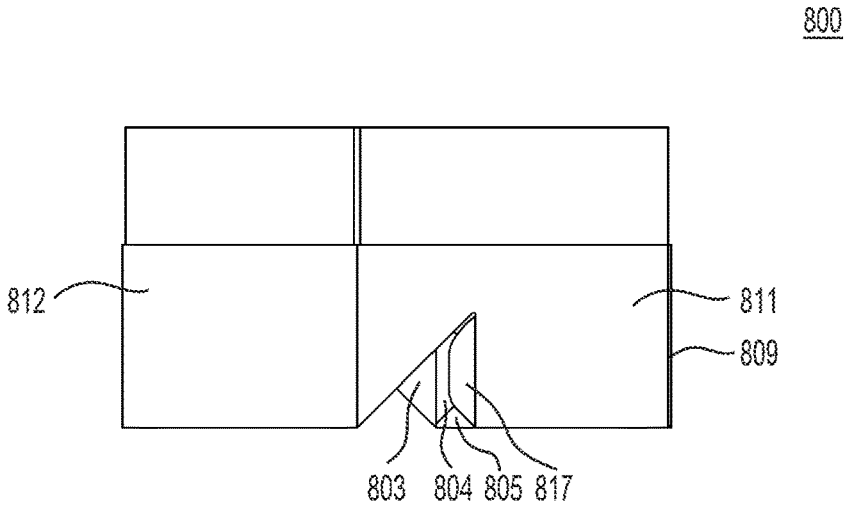
FIG. 8E is a diagram illustrating a plan view of a flat configuration of the container made from the blank shown in FIG. 8A. The second secondary panel is folded towards the primary panel (not visible). The second secondary flap (not visible) is folded towards the second secondary panel. The attachment portion (not visible) is folded towards the primary flap (not visible). The attachment portion (not visible) is connected to the second secondary flap (not visible)

FIG. 8E is a diagram illustrating a plan view of a flat configuration of the container made from the blank 800 shown in FIG. 8A. The second secondary panel 812 is folded towards the primary panel 801 (not visible). The second secondary flap 815 (not visible) is folded towards the second secondary panel 812. The attachment portion 808 (not visible) is folded towards the primary flap 807 (not visible). The attachment portion 808 (not visible) is connected to the second secondary flap 815 (not visible).

Figure 8F:
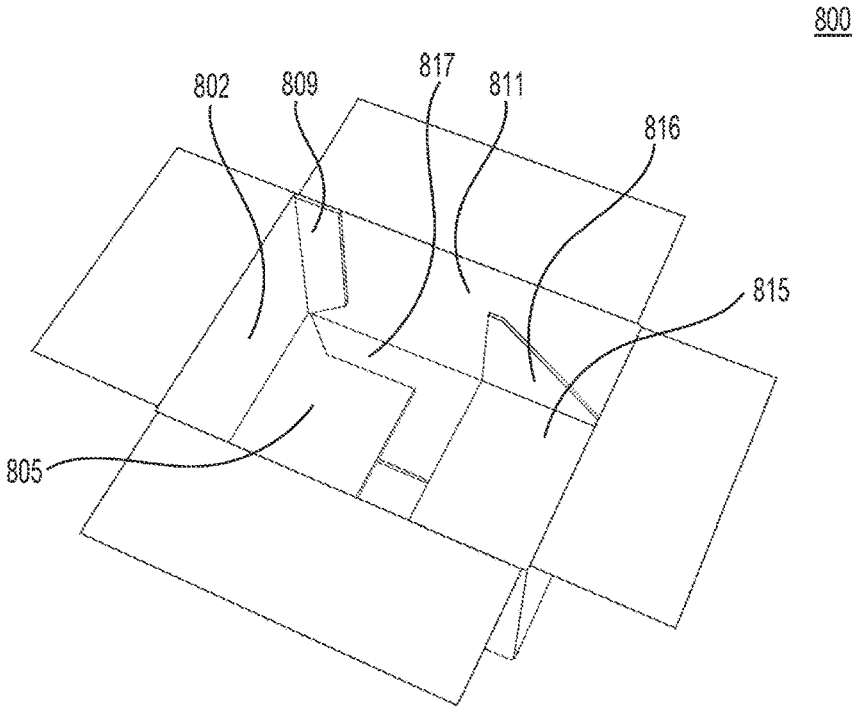
FIG. 8F is a diagram illustrating a top perspective view of a box configuration of the container made from the blank shown in FIG. 8A.

FIG. 8F is a diagram illustrating a top perspective view of a box configuration of the container made from the blank 800 shown in FIG. 8A.

Figure 8G:
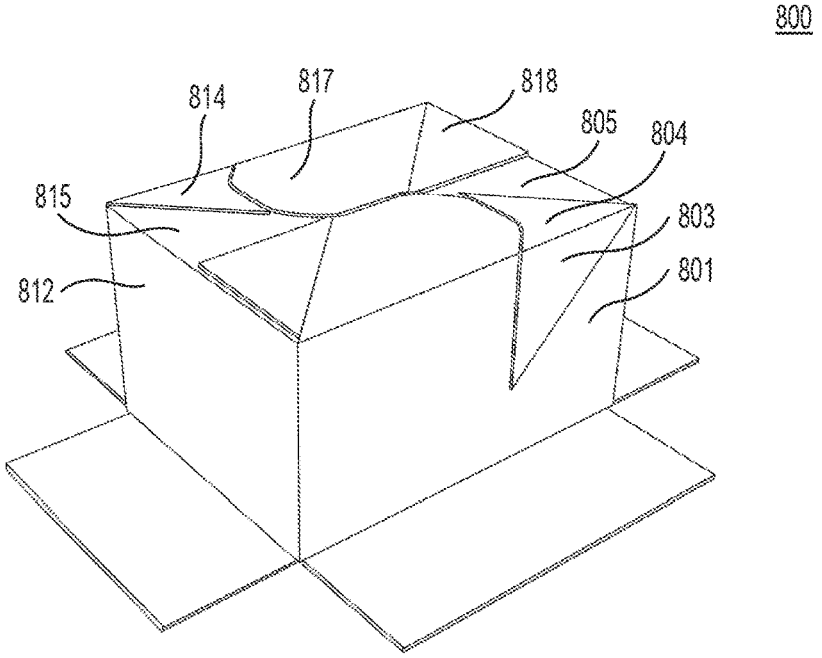
FIG. 8G is a diagram illustrating a bottom perspective view of the box configuration of the container made from the blank shown in FIG. 8A.

FIG. 8G is a diagram illustrating a bottom perspective view of the box configuration of the container made from the blank 800 shown in FIG. 8A.

With reference to FIGS. 8E-8G, the container made from the blank 800 shown in FIG. 8A moves in a similar manner as the container described in FIGS. 4B-4E and 4I-4P and described in the corresponding description, when the container is moved from a flat configuration to a box configuration.

With reference to FIGS. 6A-8G, embodiments are directed to a blank 600, 700, 800 used for making a container. The container is movable between a flat configuration (e.g., FIGS. 6E, 7E, and 8E) and a box configuration (e.g., FIGS. 6F, 7F, and 8F). The blank 600, 700, 800 comprises a primary panel 601, 701, 801 and a secondary panel 602, 702, 802. The primary panel 601, 701, 801 is hingedly coupled to the secondary panel 602, 702, 802. The primary panel 601, 701, 801 is hingedly coupled to a terminal portion 603, 703, 803. The terminal portion 603, 703, 803 is hingedly coupled to a terminal flap 604, 704, 804. The secondary panel 602, 702, 802 is hingedly coupled to a secondary flap 605, 705, 805. The secondary flap 605, 705, 805 is configured to fold towards the secondary panel 602, 702, 802. The terminal portion 603, 703, 803 is configured to fold towards the primary panel 601, 701, 801. The terminal flap 604, 704, 804 is configured to connect to the secondary flap 605, 705, 805 (e.g., FIGS. 6A, 6B, 7A, 7B, 8A, and 8B).

In an embodiment, a slit 610, 710, 810 is positioned between the primary panel 601, 701, 801 and the terminal portion 603, 703, 803 (e.g., FIGS. 6A, 7A, and 8A).

In an embodiment, a combination of the terminal portion 603, 703, 803 and the primary panel 601, 701, 801 is substantially rectangular (e.g., FIGS. 6A, 7A, and 8A).

In an embodiment, the blank 600, 700, 800 further comprises a primary flap 607, 707, 807. The primary flap 607, 707, 807 is hingedly coupled to the primary panel 601, 701, 801 (e.g., FIGS. 6A, 7A, and 8A).

In an embodiment, a side of the terminal flap 604, 704, 804 facing the primary flap 607, 707, 807 is concave (e.g., FIGS. 6A, 7A, and 8A).

In an embodiment, the terminal flap 604, 704, 804 and the secondary flap 605, 705, 805 are configured to form, at least partly, a side of the container when the container is in the box configuration (e.g., FIGS. 6G, 7G, and 8G; the secondary flap 605, 705 is not visible in FIGS. 6G and 7G).

In an embodiment, the secondary panel 602, 702, 802 is configured to fold towards the primary panel 601, 701, 801 (e.g., FIGS. 6F, 7F, and 8F).

In an embodiment, the blank 600, 700, 800 further comprises a second secondary panel 612, 712, 812 and a primary flap 607, 707, 807. The second secondary panel 612, 712, 812 is hingedly coupled to the primary panel 601, 701, 801. The second secondary panel 612, 712, 812 is hingedly coupled to a second secondary flap 615, 715, 815. The primary flap 607, 707, 807 is hingedly coupled to the primary panel 601, 701, 801. An attachment portion 608, 708, 808 is hingedly coupled to the primary flap 607, 707, 807. The primary flap 607, 707, 807 is configured to fold towards the primary panel 601, 701, 801. The attachment portion 608, 708, 808 is configured to fold towards the primary flap 607, 707, 807. The second secondary flap 615, 715, 815 is configured to fold towards the second secondary panel 612, 712, 812. The second secondary panel 612, 712, 812 is configured to fold towards the primary panel 601, 701, 801. The attachment portion 608, 708, 808 is configured to connect to the second secondary flap 615, 715, 815 (e.g., FIGS. 6D, 6E, 7D, 7E, 8D, and 8E).

In an embodiment, the blank 700, 800 further comprises a tab 706, 806. The tab 706, 806 is hingedly coupled to the secondary flap 705, 805. The tab 706, 806 is configured to connect to the terminal portion 703, 804 (e.g., FIGS. 7A, 7B, 8A and 8B).

In an embodiment, the primary panel 601, 701, 801 is a first primary panel 601, 701, 801. The blank 600, 700, 800 further comprises a second primary panel 611, 711, 811 and a second secondary panel 612, 712, 812. The second secondary panel 612, 712, 812 is hingedly coupled to the first primary panel 601, 701, 801. The second primary panel 611, 711, 811 is hingedly coupled to the second secondary panel 612, 712, 812. The second primary panel 611, 711, 811 is hingedly coupled to a second terminal portion 613, 713, 813. The second terminal portion 613, 713, 813 is hingedly coupled to a second terminal flap 614, 714, 814. The second secondary panel 612, 712, 812 is hingedly coupled to a second secondary flap 615, 715, 815. The second secondary flap 615, 715, 815 is configured to fold towards the second secondary panel 612, 712, 812. The second terminal portion 613, 713, 813 is configured to fold towards the second primary panel 611, 711, 811. The second terminal flap 614, 714, 814 is configured to connect to the second secondary flap 615, 715, 815 (e.g., FIGS. 6A, 6B, 7A, 7B, 8A, and 8B).

In an embodiment, the blank 700, 800 further comprises a second tab 716, 816. The second tab 716, 816 is hingedly coupled to the second secondary flap 715, 815. The second tab 716, 816 is configured to connect to the second terminal portion 713, 813 (e.g., FIGS. 7A, 7B, 8A, and 8B).

In an embodiment, the secondary flap 605, 705, 805 is a first secondary flap 605, 705, 805. The blank 600, 700, 800 further comprises a second primary flap 617, 717, 817. The second primary flap 617, 717, 817 is hingedly coupled to the second primary panel 611, 711, 811. A second attachment portion 618, 718, 818 is hingedly coupled to the second primary flap 617, 717, 817. The second primary flap 617, 717, 817 is configured to fold towards the second primary panel 611, 711, 811. The second attachment portion 618, 718, 818 is configured to fold towards the second primary flap 617, 717, 817. The second secondary panel 612, 712, 812 is configured to fold towards the first primary panel 601, 701, 801. The second attachment portion 618, 718, 818 is configured to connect to the first secondary flap 605, 705, 805 (e.g., FIGS. 6D, 6E, 7D, 7E, 8D, and 8E).

With reference to FIGS. 7A-8G, embodiments are directed to a blank 700, 800 used for making a container. The container is movable between a flat configuration (e.g., FIGS. 7E and 8E) and a box configuration (e.g., FIGS. 7F and 8F). The blank 700, 800 comprises a primary panel 701, 801 and a secondary panel 702, 802. The primary panel 701, 801 is hingedly coupled to the secondary panel 702, 802. The primary panel 701, 801 is hingedly coupled to a terminal portion 703, 803. The secondary panel 702, 802 is hingedly coupled to a secondary flap 705, 805. The secondary flap 705, 805 is hingedly coupled to a tab 706, 806. The secondary flap 705, 805 is configured to fold towards the secondary panel 702, 802. The terminal portion 703, 803 is configured to fold towards the primary panel 701, 801. The tab 706, 806 is configured to connect to the terminal portion 703, 803 (e.g., FIGS. 7A, 7B, 8A, and 8B).

In an embodiment, a slit 710, 810 is positioned between the primary panel 701, 801 and the terminal portion 703, 803 (e.g., FIGS. 7A and 8A).

In an embodiment, a combination of the terminal portion 703, 803 and the primary panel 701, 801 is substantially rectangular (e.g., FIGS. 7A and 8A).

In an embodiment, the blank 700, 800 further comprises a primary flap 707, 807. The primary flap 707, 807 is hingedly coupled to the primary panel 701, 801 (e.g., FIGS. 7A and 8A).

In an embodiment, the secondary panel 702, 802 is configured to fold towards the primary panel 701, 801 (e.g., FIGS. 7F and 8F).

In an embodiment, the blank 700, 800 further comprises a terminal flap 704, 804. The terminal flap 704, 804 is hingedly coupled to the terminal portion 703, 803. The terminal flap 704, 804 is configured to connect to the secondary flap 705, 805 (e.g., FIGS. 7A and 8A).

In an embodiment, the blank 700, 800 further comprises a primary flap 707, 807. The primary flap 707, 807 is hingedly coupled to the primary panel 701, 801. A side of the terminal flap 704, 804 facing the primary flap 707, 807 is concave (e.g., FIGS. 7A and 8A).

In an embodiment, the terminal flap 704, 804 and the secondary flap 705, 805 are configured to form, at least partly, a side of the container when the container is in the box configuration (e.g., FIGS. 7G and 8G; the secondary flap 705 is not visible in FIG. 7G).

In an embodiment, the blank 700, 800 further comprises a second secondary panel 712, 812 and a primary flap 707, 807. The second secondary panel 712, 812 is hingedly coupled to the primary panel 701, 801. The second secondary panel 712, 812 is hingedly coupled to a second secondary flap 715, 815. The primary flap 707, 807 is hingedly coupled to the primary panel 701, 801. An attachment portion 708, 808 is hingedly coupled to the primary flap 707, 807. The primary flap 707, 807 is configured to fold towards the primary panel 701, 801. The attachment portion 708, 808 is configured to fold towards the primary flap 707, 807. The second secondary flap 715, 815 is configured to fold towards the second secondary panel 712, 812. The second secondary panel 712, 812 is configured to fold towards the primary panel 701, 801. The attachment portion 708, 808 is configured to connect to the second secondary flap 715, 815 (e.g., FIGS. 7D, 7E, 8D, and 8E).

In an embodiment, the primary panel 701, 801 is a first primary panel 701, 801. The blank 700, 800 further comprises a second primary panel 711, 811 and a second secondary panel 712, 812. The second secondary panel 712, 812 is hingedly coupled to the first primary panel 701, 801. The second primary panel 711, 811 is hingedly coupled to the second secondary panel 712, 812. The second primary panel 711, 811 is hingedly coupled to a second terminal portion 713, 813. The second secondary panel 712, 812 is hingedly coupled to a second secondary flap 715, 815. The second secondary flap 715, 815 is hingedly coupled to a second tab 716, 816. The second secondary flap 715, 815 is configured to fold towards the second secondary panel 712, 812. The second terminal portion 713, 813 is configured to fold towards the second primary panel 711, 811. The second tab 716, 816 is configured to connect to the second terminal portion 703, 803 (e.g., FIGS. 7A, 7B, 8A, and 8B).

In an embodiment, the secondary flap 705, 805 is a first secondary flap 705, 805. The blank 700, 800 further comprises a second primary flap 717, 817. The second primary flap 717, 817 is hingedly coupled to the second primary panel 711, 811. A second attachment portion 718, 818 is hingedly coupled to the second primary flap 717, 817. The second primary flap 717, 817 is configured to fold towards the second primary panel 711, 811. The second attachment portion 718, 818 is configured to fold towards the second primary flap 717, 817. The second secondary panel 712, 812 is configured to fold towards the first primary panel 701, 801. The second attachment portion 718, 818 is configured to connect to the first secondary flap 705, 805 (e.g., FIGS. 7D, 7E, 8D, and 8E).

Figure 9A:
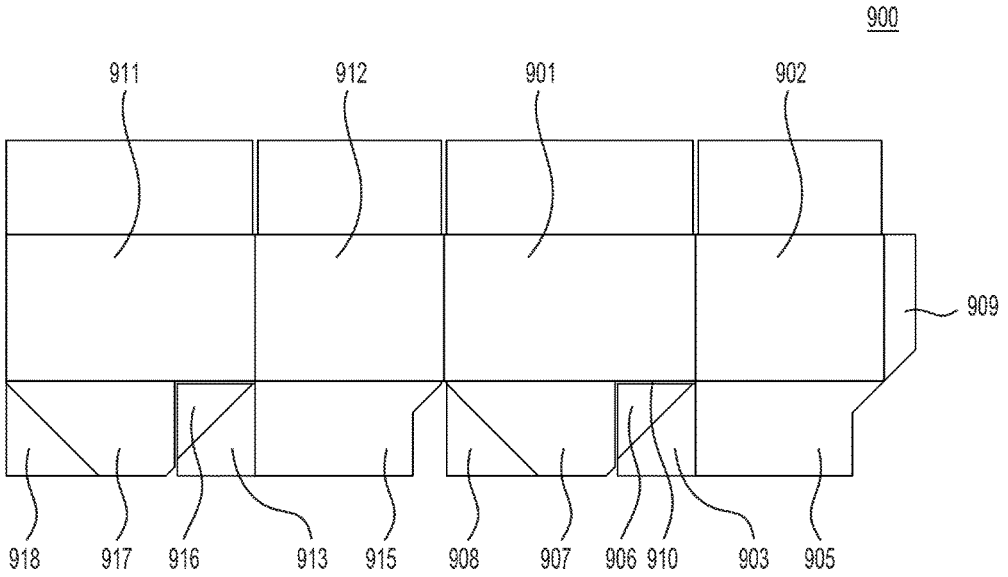
FIG. 9A is a diagram illustrating a plan view of an embodiment of a blank used for making a container. The blank comprises a primary panel and a secondary panel, which are hingedly coupled to each other. The primary panel is hingedly coupled to a primary flap. An attachment portion is hingedly coupled to the primary flap. The secondary panel is hingedly coupled to a secondary flap. A terminal portion is hingedly coupled to the secondary flap. A tab is hingedly coupled to the terminal portion. The primary panel is hingedly coupled to a second secondary panel. A second secondary flap is hingedly coupled to the second secondary panel. An end flap is hingedly coupled to the secondary panel.

FIG. 9A is a diagram illustrating a plan view of an embodiment of a blank 900 used for making a container. The blank comprises a primary panel 901 and a secondary panel 902, which are hingedly coupled to each other. The primary panel 901 is hingedly coupled to a primary flap 907. An attachment portion 908 is hingedly coupled to the primary flap 907. The secondary panel 902 is hingedly coupled to a secondary flap 905. A terminal portion 903 is hingedly coupled to the secondary flap 905. A tab 906 is hingedly coupled to the terminal portion 903. The primary panel 901 is hingedly coupled to a second secondary panel 912. A second secondary flap 915 is hingedly coupled to the second secondary panel 912. An end flap 909 is hingedly coupled to the secondary panel 902.

Figure 9B:
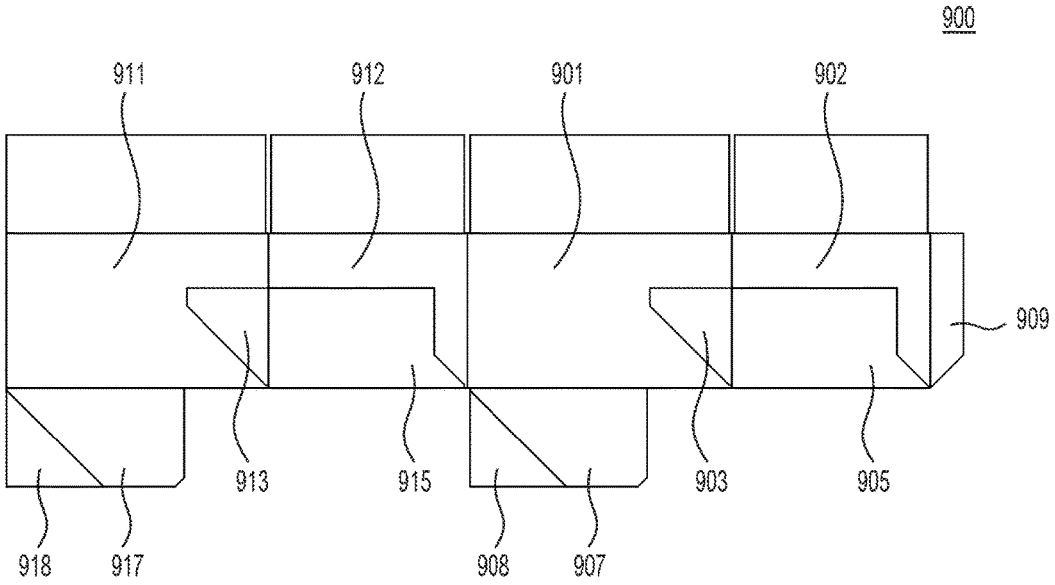
FIG. 9B is a diagram illustrating a plan view of the blank shown in FIG. 9A, wherein the tab (not visible) is folded towards the terminal portion. The secondary flap is folded towards the secondary panel. The tab (not visible) is connected to the primary panel.

FIG. 9B is a diagram illustrating a plan view of the blank 900 shown in FIG. 9A, wherein the tab 906 (not visible) is folded towards the terminal portion 903. The secondary flap 905 is folded towards the secondary panel 902. The tab 906 (not visible) is connected to the primary panel 901. The tab 906 (not visible) is positioned between the primary panel 901 and the terminal portion 903.

Figure 9C:
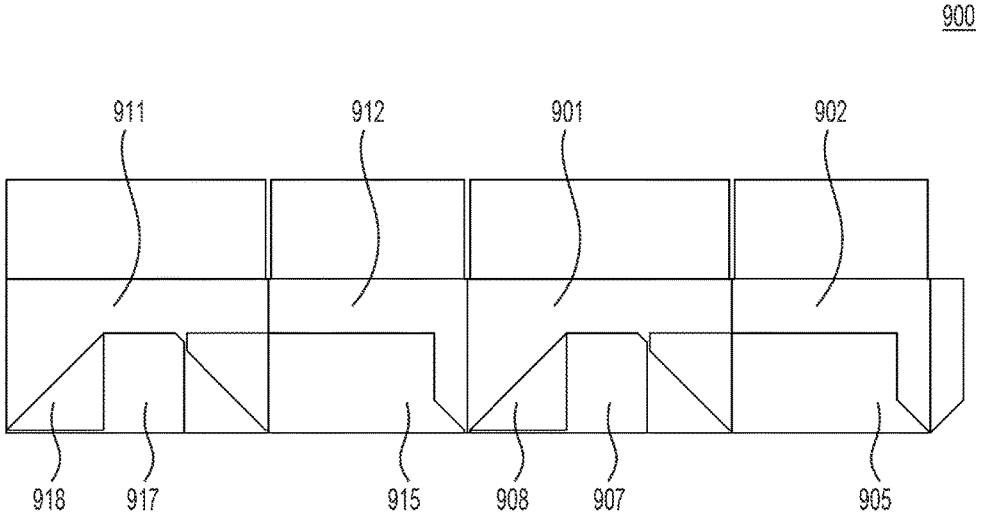
FIG. 9C is a diagram illustrating a plan view of the blank shown in FIG. 9A, wherein the primary flap is folded towards the primary panel. The attachment portion is folded towards the primary flap.

FIG. 9C is a diagram illustrating a plan view of the blank 900 shown in FIG. 9A, wherein the primary flap 907 is folded towards the primary panel 901. The attachment portion 908 is folded towards the primary flap 907.

Figure 9D:
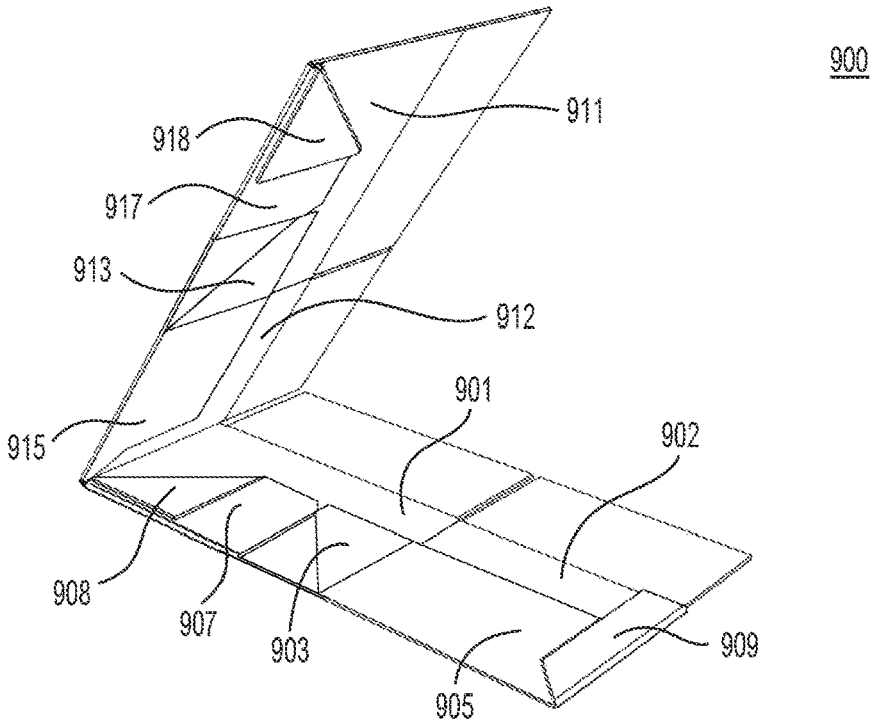
FIG. 9D is a diagram illustrating a perspective view of the blank shown in FIG. 9A, wherein the second secondary flap is folded towards the second secondary panel. The end flap is folded towards the secondary panel. The second secondary panel is folding towards the primary panel.

FIG. 9D is a diagram illustrating a perspective view of the blank 900 shown in FIG. 9A, wherein the second secondary flap 915 is folded towards the second secondary panel 912. The end flap 909 is folded towards the secondary panel 902. The second secondary panel 912 is folding towards the primary panel 901.

Figure 9E:
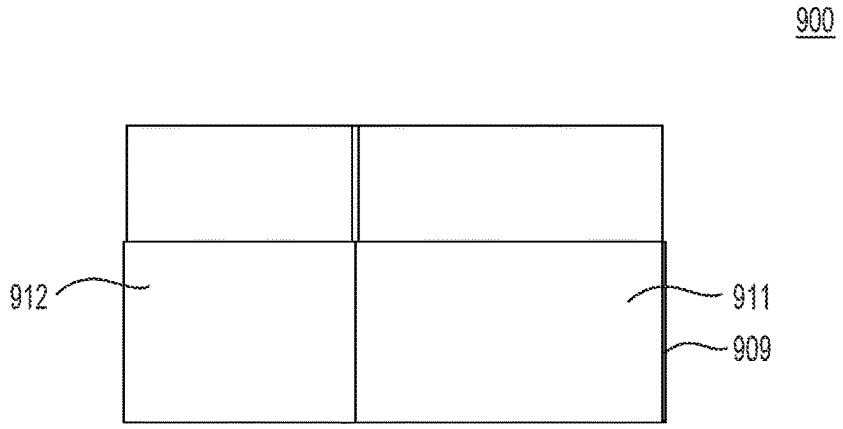
FIG. 9E is a diagram illustrating a plan view of a flat configuration of the container made from the blank shown in FIG. 9A. The second secondary panel is folded towards the primary panel (not visible). The second secondary flap (not visible) is folded towards the second secondary panel. The attachment portion (not visible) is folded towards the primary flap (not visible). The attachment portion (not visible) is connected to the second secondary flap (not visible)

FIG. 9E is a diagram illustrating a plan view of a flat configuration of the container made from the blank 900 shown in FIG. 9A. The second secondary panel 912 is folded towards the primary panel 901 (not visible). The second secondary flap 915 (not visible) is folded towards the second secondary panel 912. The attachment portion 908 (not visible) is folded towards the primary flap 907 (not visible). The attachment portion 908 (not visible) is connected to the second secondary flap 915 (not visible).

Figure 9F:
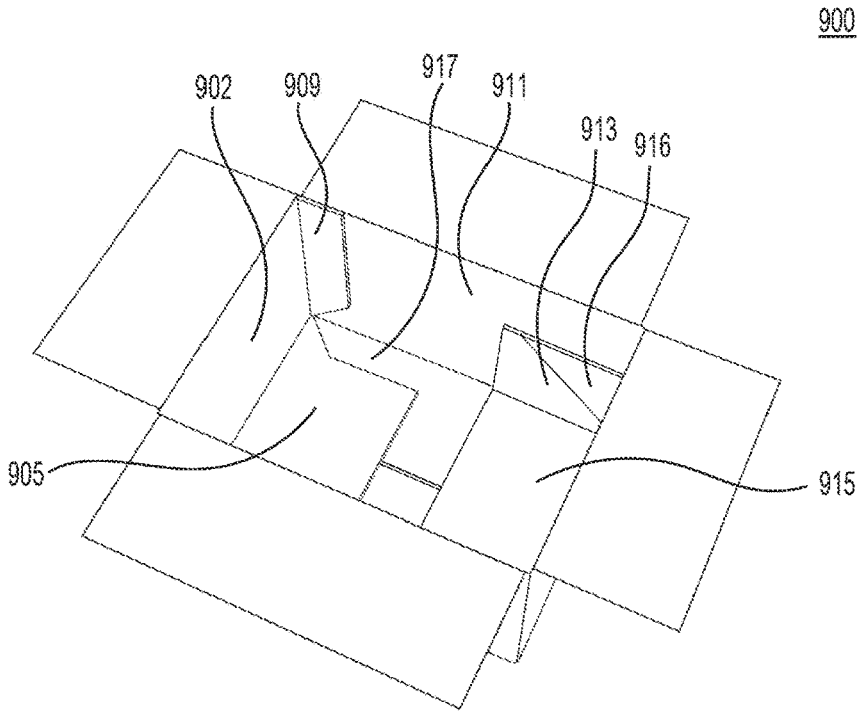
FIG. 9F is a diagram illustrating a top perspective view of a box configuration of the container made from the blank shown in FIG. 9A.

FIG. 9F is a diagram illustrating a top perspective view of a box configuration of the container made from the blank 900 shown in FIG. 9A.

Figure 9G:
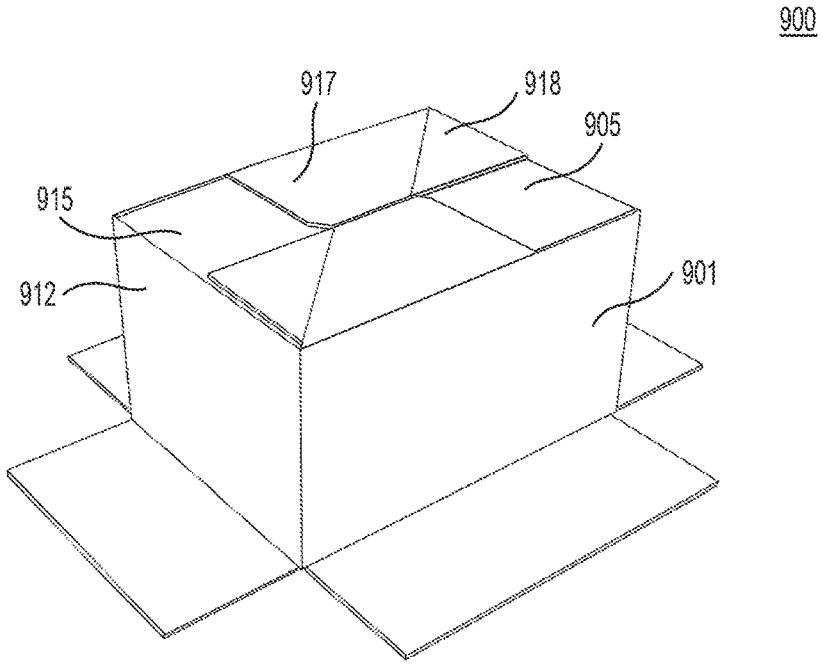
FIG. 9G is a diagram illustrating a bottom perspective view of the box configuration of the container made from the blank shown in FIG. 9A.

FIG. 9G is a diagram illustrating a bottom perspective view of the box configuration of the container made from the blank 900 shown in FIG. 9A.

With reference to FIGS. 9E-9G, the container made from the blank 900 shown in FIG. 9A moves in a similar manner as the container described in FIGS. 4B-4E and 4I-4P and described in the corresponding description, when the container is moved from a flat configuration to a box configuration.

Figure 10A:
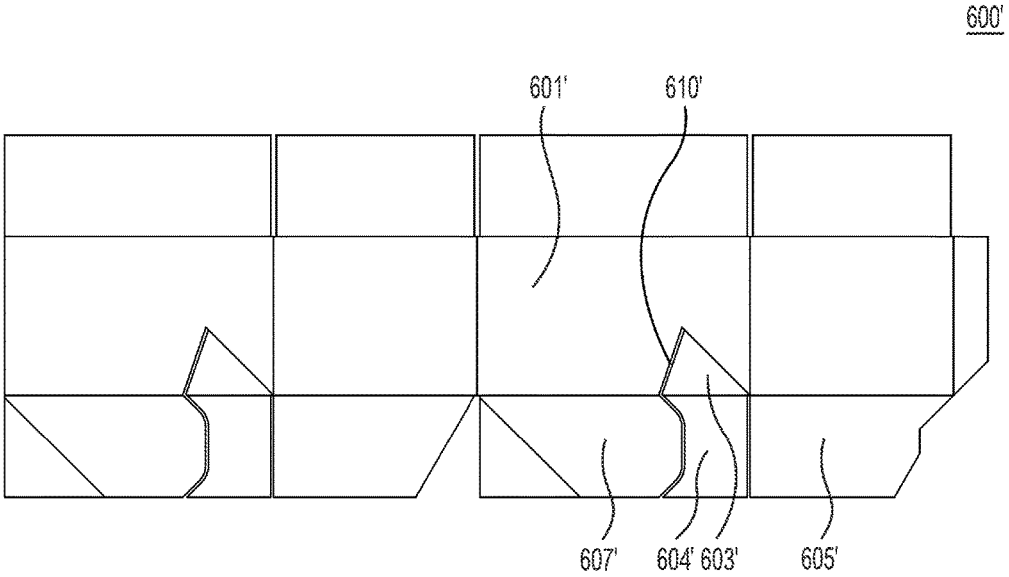
FIG. 10A is a plan view of a similar blank shown in FIG. 6A, wherein the slit positioned between the primary panel and the terminal portion is inclined. The shapes of the primary panel, terminal portion, primary flap, terminal flap, and secondary flap are modified.

FIG. 10A is a plan view of a similar blank 600' shown in FIG. 6A, wherein the slit 610' positioned between the primary panel 601' and the terminal portion 603' is inclined. The shapes of the primary panel 601', terminal portion 603', primary flap 607', terminal flap 604', and secondary flap 605' are modified.

Figure 10B:
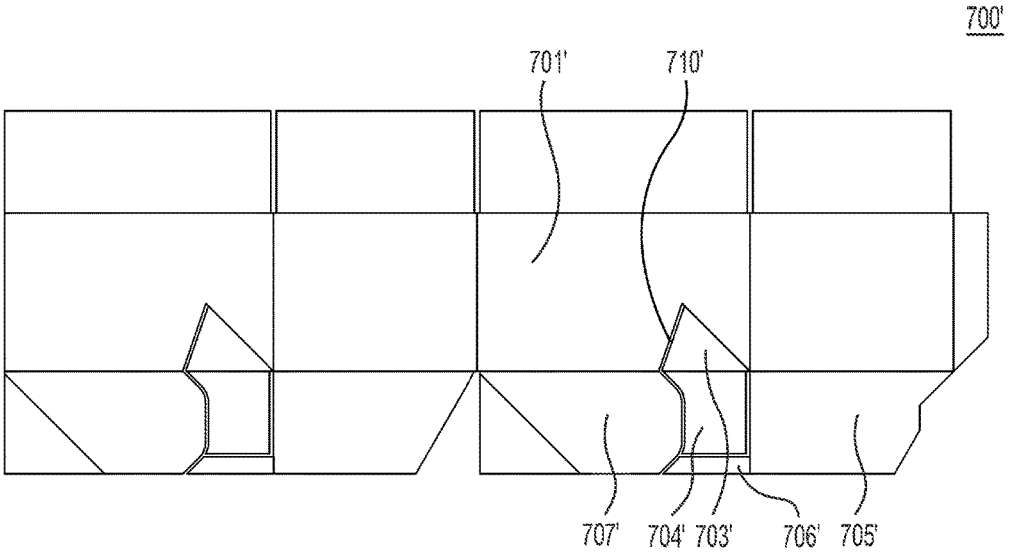
FIG. 10B is a plan view of a similar blank shown in FIG. 7A, wherein the slit positioned between the primary panel and the terminal portion is inclined. The shapes of the primary panel, terminal portion, primary flap, terminal flap, secondary flap, and tab are modified.

FIG. 10B is a plan view of a similar blank 700' shown in FIG. 7A, wherein the slit 710' positioned between the primary panel 701' and the terminal portion 703' is inclined. The shapes of the primary panel 701', terminal portion 703', primary flap 707', terminal flap 704', secondary flap 705', and tab 706' are modified.

Figure 10C:
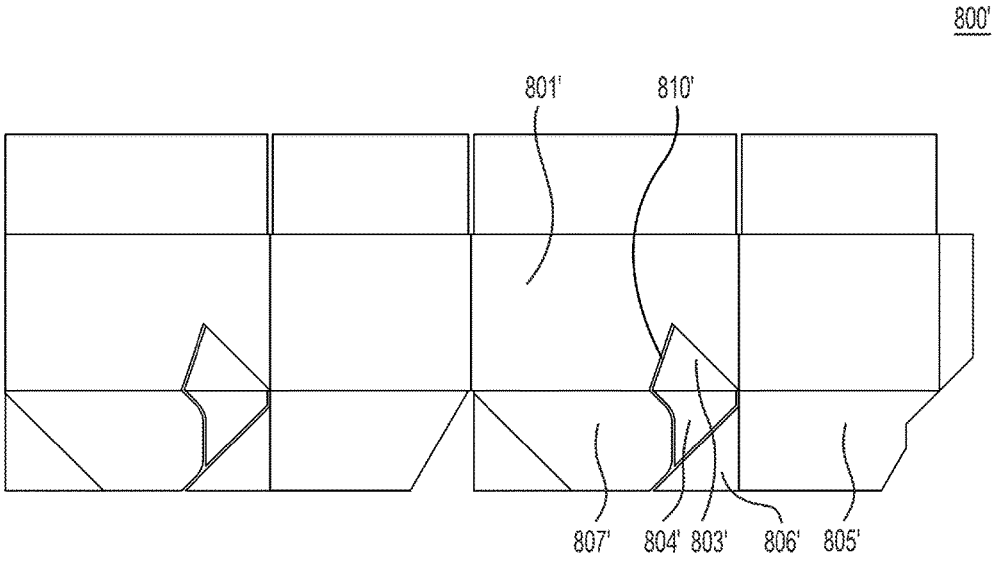
FIG. 10C is a plan view of a similar blank shown in FIG. 8A, wherein the slit positioned between the primary panel and the terminal portion is inclined. The shapes of the primary panel, terminal portion, primary flap, terminal flap, secondary flap, and tab are modified.

FIG. 10C is a plan view of a similar blank 800' shown in FIG. 8A, wherein the slit 810' positioned between the primary panel 801' and the terminal portion 803' is inclined. The shapes of the primary panel 801', terminal portion 803', primary flap 807', terminal flap 804', secondary flap 805', and tab 806' are modified.

Figure 10D:
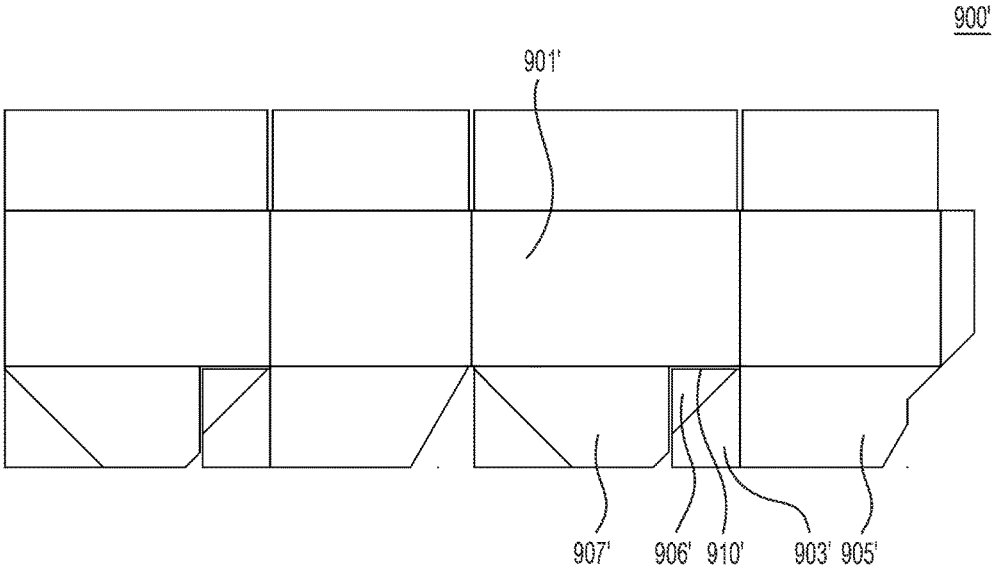
FIG. 10D is a plan view of a similar blank shown in FIG. 9A, wherein the slit positioned between the primary panel and the tab is shorter. The shapes of the terminal portion, primary flap, secondary flap, and tab are modified.

FIG. 10D is a plan view of a similar blank 900' shown in FIG. 9A, wherein the slit 910' positioned between the primary panel 901' and the tab 906' is shorter. The shapes of the terminal portion 903', primary flap 907', secondary flap 905', and tab 906' are modified.

With reference to FIGS. 9A-9G, embodiments are directed to a blank 900 used for making a container. The container is movable between a flat configuration (e.g., FIG. 9E) and a box configuration (e.g., FIG. 9F). The blank 900 comprises a primary panel 901 and a secondary panel 902, which are hingedly coupled to each other. The secondary panel 902 is hingedly coupled to a secondary flap 905. The secondary flap 905 is hingedly coupled to a terminal portion 903. The terminal portion 903 is hingedly coupled to a tab 906. The tab 906 is configured to fold towards the terminal portion 903. The secondary flap 905 is configured to fold towards the secondary panel 902. The tab 906 is configured to connect to the primary panel 901 (e.g., FIGS. 9A and 9B; the tab 906 is not visible in FIG. 9B).

In an embodiment, a slit 910 is positioned between the primary panel 901 and the tab 906 (e.g., FIG. 9A).

In an embodiment, the blank 900 further comprises a primary flap 907. The primary flap 907 is hingedly coupled to the primary panel 901 (e.g., FIGS. 9A and 9B).

In an embodiment, the secondary flap 905 is configured to form, at least partly, a side of the container when the container is in the box configuration (e.g., FIGS. 9F and 9G).

In an embodiment, the secondary panel 902 is configured to fold towards the primary panel 901 (e.g., FIG. 9F).

In an embodiment, the blank 900 further comprises a second secondary panel 912 and a primary flap 907. The secondary panel 912 is hingedly coupled to the primary panel 901. The second secondary panel 912 is hingedly coupled to a second secondary flap 915. The primary flap 907 is hingedly coupled to the primary panel 901. An attachment portion 908 is hingedly coupled to the primary flap 907. The primary flap 907 is configured to fold towards the primary panel 901. The attachment portion 908 is configured to fold towards the primary flap 907. The second secondary flap 915 is configured to fold towards the second secondary panel 912. The second secondary panel 912 is configured to fold towards the primary panel 901. The attachment portion 908 is configured to connect to the second secondary flap 915 (e.g., FIGS. 9D and 9E).

In an embodiment, the primary panel 901 is a first primary panel 901. The blank 900 further comprises a second primary panel 911 and a second secondary panel 912. The second secondary panel 912 is hingedly coupled to the first primary panel 901. The second primary panel 911 is hingedly coupled to the second secondary panel 912. The second secondary panel 912 is hingedly coupled to a second secondary flap 915. The second secondary flap 915 is hingedly coupled to a second terminal portion 913. The second terminal portion 913 is hingedly coupled to a second tab 916. The second tab 916 is configured to fold towards the second terminal portion 913. The second secondary flap 915 is configured to fold towards the second secondary panel 912. The second tab 916 is configured to connect to the second primary panel 911 (e.g., FIGS. 9A and 9B; the second tab 916 is not visible in FIG. 9B).

In an embodiment, the secondary flap 905 is a first secondary flap 905. The blank 900 further comprises a second primary flap 917. The second primary flap 917 is hingedly coupled to the second primary panel 911. A second attachment portion 918 is hingedly coupled to the second primary flap 917. The second primary flap 917 is configured to fold towards the second primary panel 911. The second attachment portion 918 is configured to fold towards the second primary flap 917. The second secondary panel 912 is configured to fold towards the first primary panel 901. The second attachment portion 918 is configured to connect to the first secondary flap 905 (e.g., FIGS. 9D and 9E).

Additional Description

Although embodiments are described above with reference to a container, wherein the two primary panels are moved clockwise as the container transitions from the flat configuration to the box configuration, the two primary panels described in any of the above embodiments may alternatively move counter-clockwise as the container transitions from the flat configuration to the box configuration. This may be achieved by changing the orientation of the primary-link hinges and of the link-link hinges, and/or providing a reverse configuration of any other portion (or all portions) of the container as compared to those described in any of the above embodiments. Such alternatives are considered to be within the spirit and scope of the present invention, and may therefore utilize the advantages of the configurations and embodiments described above.

In addition, although embodiments are described above with reference to a container, wherein the two primary panels and the two secondary panels are positioned as the side panels of the container when the container is in the box configuration, the two primary panels (or alternatively the two secondary panels) described in any of the above embodiments may alternatively be positioned as the top and bottom panels of the container (e.g., if the container is rotated sideways), whereby an opening to the interior of the container is on a side of the container when the container is in the box configuration. Such alternatives are considered to be within the spirit and scope of the present invention, and may therefore utilize the advantages of the configurations and embodiments described above.

Further, although embodiments are described above with reference to a container, wherein the main link part forms, at least partly, a base panel that is positioned at the bottom of the container when the container is in the box configuration, the main link part described in any of the above embodiments may alternatively form a base panel having a different positioning (e.g., the main link part may form a top base panel if the container is flipped upside down) or the base panel may be suspended at a position between a bottom and top of the container (e.g., if the main link part forms a base panel that is positioned above a lowest edge of the two primary panels when the container is in the box configuration). Such alternatives are considered to be within the spirit and scope of the present invention, and may therefore utilize the advantages of the configurations and embodiments described above.

Yet further, although embodiments are described above with reference to a container, wherein the distance between the two primary panels is smaller than the distance between the two secondary panels when the container is in the box configuration, the distance between the two primary panels described in any of the above embodiments may alternatively be larger than or equal to the distance between the two secondary panels when the container is in the box configuration. The main link part may connect the two facing panels with the shorter distance between each other, or alternatively may connect the two facing panels with the greater distance between each other. Such alternatives are considered to be within the spirit and scope of the present invention, and may therefore utilize the advantages of the configurations and embodiments described above.

Yet further, although embodiments are described above with reference to a container, wherein the two primary panels and the two secondary panels have equal height, the two primary panels and the two secondary panels described in any of the above embodiments may alternatively have different heights (e.g., the two secondary panels may be shorter than the two primary panels). In another alternative, the height of one primary panel may be different than the other. In yet another alternative, the height of one secondary panel may be different than the other). Such alternatives are considered to be within the spirit and scope of the present invention, and may therefore utilize the advantages of the configurations and embodiments described above.

Yet further, although embodiments are described above with reference to a container, wherein the two primary panels are identical (e.g., with the same size, dimensions, thickness, shape, and weight) and the two secondary panels are identical (e.g., with the same size, dimensions, thickness, shape, and weight), the two primary panels described in any of the above embodiments may alternatively be non-identical (e.g., with different size, dimensions, thickness, shape, and/or weight). Similarly, the two secondary panels described in any of the above embodiments may alternatively be non-identical (e.g., with different size, dimensions, thickness, shape, and/or weight). Portions or all of the container may be configured based on the desired size, dimensions, thickness, shape, and/or weight of the two primary panels and/or of the two secondary panels. Such alternatives are considered to be within the spirit and scope of the present invention, and may therefore utilize the advantages of the configurations and embodiments described above.

Yet further, although embodiments are described and/or shown above with reference to a container, wherein the shape defined by the two primary panels and the two secondary panels is rectangular when the container is in the box configuration, the shape defined by the two primary panels and the two secondary panels described and/or shown in any of the above embodiments may alternatively have other shapes when the container is in the box configuration (e.g., trapezoid, parallelogram, hexagonal, etc.). The main link part and the various hinges (and/or other portions or all portions of the container) may be configured based on the desired shape defined by the two primary panels and the two secondary panels when the container is in the box configuration. Such alternatives are considered to be within the spirit and scope of the present invention, and may therefore utilize the advantages of the configurations and embodiments described above.

Yet further, although embodiments are described and/or shown above with reference to a container, wherein the shape defined by the two primary panels, the base panel, and the top of the container is rectangular when the container is in the box configuration, the shape defined by the two primary panels, the base panel, and the top of the container described and/or shown in any of the above embodiments may alternatively have other shapes when the container is in the box configuration (e.g., trapezoid, parallelogram, hexagonal, etc.). The main link part and the various hinges (and/or other portions or all portions of the container) may be configured based on the desired shape defined by the two primary panels, the base panel, and the top of the container when the container is in the box configuration. Such alternatives are considered to be within the spirit and scope of the present invention, and may therefore utilize the advantages of the configurations and embodiments described above.

Yet further, although embodiments are described and/or shown above with reference to a container, wherein the shape defined by the two secondary panels, the base panel, and the top of the container is rectangular when the container is in the box configuration, the shape defined by the two secondary panels, the base panel, and the top of the container described and/or shown in any of the above embodiments may alternatively have other shapes when the container is in the box configuration (e.g., trapezoid, parallelogram, hexagonal, etc.). The main link part and the various hinges (and/or other portions or all portions of the container) may be configured based on the desired shape defined by the two secondary panels, the base panel, and the top of the container when the container is in the box configuration. Such alternatives are considered to be within the spirit and scope of the present invention, and may therefore utilize the advantages of the configurations and embodiments described above.

Yet further, although embodiments are described above with reference to a container, wherein the angle between the primary-link hinges and the panel hinges is either 45° or 90°, the angle between the primary-link hinges and the panel hinges described in any of the above embodiments may alternatively have different values. The main link part and the link-link hinges (or any other portion or all portions of the container) may be configured based on the desired angle between the primary-link hinges and the panel hinges. Such alternatives are considered to be within the spirit and scope of the present invention, and may therefore utilize the advantages of the configurations and embodiments described above.

Yet further, although embodiments are described above with reference to a container, wherein the angle between the link-link hinges and the two primary panels is 0°, 45°, or 90° when the container is in the box configuration, the angle between the link-link hinges and the two primary panels described in any of the above embodiments may alternatively have different values when the container is in the box configuration. The main link part and the primary-link hinges (or any other portion or all portions of the container) may be configured based on the desired angle between the link-link hinges and the two primary panels when the container is in the box configuration. Such alternatives are considered to be within the spirit and scope of the present invention, and may therefore utilize the advantages of the configurations and embodiments described above.

Yet further, embodiments are described above with reference to a container, wherein the manufacturing and assembly processes may vary based on the dimensions, thickness, shape, composition, weight, and features of the container and portions of the container. The container in any of the above embodiments may be produced using any suitable manufacturing and assembly process, method, technique, or strategy. Such alternatives are considered to be within the spirit and scope of the present invention, and may therefore utilize the advantages of the configurations and embodiments described above.

Yet further, although embodiments are described above with reference to a container, wherein the at least one primary top flap and the at least one secondary top flap are not shown or described as folded onto the two primary panels and the two secondary panels, respectively, when the container is in the flat configuration, the at least one primary top flap and/or the at least one secondary top flap described in any of the above embodiments may alternatively be folded onto the two primary panels and onto the two secondary panels, respectively, when the container is in the flat configuration. For example, the at least one primary top flap and the at least one secondary top flap may be folded inside the container (i.e., tucked in) when the container is in the flat configuration to, for example, reduce the shipping volume of flat containers. Such alternatives are considered to be within the spirit and scope of the present invention, and may therefore utilize the advantages of the configurations and embodiments described above.

Yet further, although embodiments are described above with reference to a container, wherein the two primary panels are in contact with or substantially close to each other when the container is the flat configuration, the two primary panels described in any of the above embodiments may alternatively be not in contact with nor substantially close to each other when the container is in the flat configuration (i.e., with a measurable separation provided between the two primary panels). Such alternatives are considered to be within the spirit and scope of the present invention, and may therefore utilize the advantages of the configurations and embodiments described above.

Yet further, although embodiments are described above with reference to a container, wherein the two primary panels, two secondary panels, and the at least three link portions are planar (e.g., flat, straight, etc.), one or more of these portions of the container described in any of the above embodiments may alternatively be non-planar and may comprise, for example, one or more curved (or other shape) walls, surfaces, or portions (e.g., natural curved shapes, bending shapes under stress, surfaces rigidly connected, surfaces connected by hinges, facets, or combinations thereof). Such alternatives are considered to be within the spirit and scope of the present invention, and may therefore utilize the advantages of the configurations and embodiments described above.

Yet further, although embodiments are described above with reference to a container with uniform portions (e.g., with uniform thickness), portions or all of the container described in any of the above embodiments may alternatively be non-uniform (e.g., having varying thickness, discontinuities such as holes, slits, grooves, ridges, slits, a combination thereof, etc.). Such alternatives are considered to be within the spirit and scope of the present invention, and may therefore utilize the advantages of the configurations and embodiments described above.

Yet further, portions (including, for example, various hinges) or all of the container described in any of the above embodiments maybe non-rigid and may be required to bend when the container is moved from the flat configuration to the box configuration, and/or moved from the box configuration to the flat configuration. Such alternatives are considered to be within the spirit and scope of the present invention, and may therefore utilize the advantages of the configurations and embodiments described above.

Although embodiments are described above with reference to a blank used for making a container, wherein the terminal portion is folded towards the primary panel from left to right, the terminal portion described in any of the above embodiments may alternatively be folded towards the primary panel from right to left. This may be achieved, for example, by using a mirror image of the blank described in any of the above embodiments. Such alternatives are considered to be within the spirit and scope of the present invention, and may therefore utilize the advantages of the configurations and embodiments described above.

In addition, although embodiments are described above with reference to a blank used for making a container, wherein the attachment portion is hingedly coupled to the primary flap, the attachment portion described in any of the above embodiments may alternatively be hingedly coupled to the second secondary flap. In such case, the attachment portion is configured to connect to the primary flap. Such alternatives are considered to be within the spirit and scope of the present invention, and may therefore utilize the advantages of the configurations and embodiments described above.

Further, although embodiments are described above with reference to a blank used for making a container, wherein the second attachment portion is hingedly coupled to the second primary flap, the second attachment portion described in any of the above embodiments may alternatively be hingedly coupled to the (first) secondary flap. In such case, the second attachment portion is configured to connect to the second primary flap. Such alternatives are considered to be within the spirit and scope of the present invention, and may therefore utilize the advantages of the configurations and embodiments described above.

Yet further, although embodiments are described above with reference to a blank used for making a container, wherein the terminal flap is shown positioned on the secondary flap, the secondary flap described in any of the above embodiments may alternatively be positioned on the terminal flap. Such alternatives are considered to be within the spirit and scope of the present invention, and may therefore utilize the advantages of the configurations and embodiments described above.

Yet further, although embodiments are described above with reference to a blank used for making a container, wherein the terminal portion is shown positioned on the tab, the tab described in any of the above embodiments may alternatively be positioned on the terminal portion. Such alternatives are considered to be within the spirit and scope of the present invention, and may therefore utilize the advantages of the configurations and embodiments described above.

The method steps in any of the embodiments described herein are not restricted to being performed in any particular order. Also, structures mentioned in any of the method embodiments may utilize structures mentioned in any of the device embodiments. Such structures may be described in detail with respect to the device embodiments only but are applicable to any of the method embodiments.

Features in any of the embodiments described in this disclosure may be employed in combination with features in other embodiments described herein, such combinations are considered to be within the spirit and scope of the present invention.

The contemplated modifications and variations specifically mentioned in this disclosure are considered to be within the spirit and scope of the present invention.

More generally, even though the present disclosure and exemplary embodiments are described above with reference to the examples according to the accompanying drawings, it is to be understood that they are not restricted thereto. Rather, it is apparent to those skilled in the art that the disclosed embodiments can be modified in many ways without departing from the scope of the disclosure herein. Moreover, the terms and descriptions used herein are set forth by way of illustration only and are not meant as limitations. Those skilled in the art will recognize that many variations are possible within the spirit and scope of the disclosure as defined in the following claims, and their equivalents, in which all terms are to be understood in their broadest possible sense unless otherwise indicated.

The invention claimed is:

1. A blank used for making a container, wherein the container is movable between a flat configuration and a box configuration different from the flat configuration, the blank comprising:

a primary panel;

a secondary panel;

wherein the primary panel is hingedly coupled to the secondary panel;

wherein the secondary panel is hingedly coupled to a secondary flap, wherein the secondary flap is hingedly coupled to a terminal portion via a first hinge, and wherein the terminal portion is hingedly coupled to a tab via a second hinge;

wherein the first hinge and the second hinge are at an acute angle with each other; and wherein the tab is configured to fold towards the terminal portion, wherein the secondary flap is configured to fold towards the secondary panel, and wherein the tab is configured to connect to the primary panel.

2. The blank of claim 1, wherein a slit is positioned between the primary panel and the tab.

3. The blank of claim 1 further comprising a primary flap, wherein the primary flap is hingedly coupled to the primary panel.

4. The blank of claim 1, wherein the secondary flap is configured to form, at least partly, a side of the container when the container is in the box configuration.

5. The blank of claim 1, wherein the secondary panel is configured to fold towards the primary panel.

6. The blank of claim 1 further comprising a second secondary panel and a primary flap, wherein the second secondary panel is hingedly coupled to the primary panel, wherein the second secondary panel is hingedly coupled to a second secondary flap, wherein the primary flap is hingedly coupled to the primary panel, and wherein an attachment portion is hingedly coupled to the primary flap;

wherein the primary flap is configured to fold towards the primary panel, wherein the attachment portion is configured to fold towards the primary flap, wherein the second secondary flap is configured to fold towards the second secondary panel, wherein the second secondary panel is configured to fold towards the primary panel, and wherein the attachment portion is configured to connect to the second secondary flap.

7. The blank of claim 1, wherein the primary panel is a first primary panel, wherein the blank further comprises a second primary panel and a second secondary panel, wherein the second secondary panel is hingedly coupled to the first primary panel, wherein the second primary panel is hingedly coupled to the second secondary panel, wherein the second secondary panel is hingedly coupled to a second secondary flap, wherein the second secondary flap is hingedly coupled to a second terminal portion, and wherein the second terminal portion is hingedly coupled to a second tab;

wherein the second tab is configured to fold towards the second terminal portion, wherein the second secondary flap is configured to fold towards the second secondary panel, and wherein the second tab is configured to connect to the second primary panel.

8. The blank of claim 7, wherein the secondary flap is a first secondary flap, wherein the blank further comprises a second primary flap, wherein the second primary flap is hingedly coupled to the second primary panel, and wherein a second attachment portion is hingedly coupled to the second primary flap;

wherein the second primary flap is configured to fold towards the second primary panel, wherein the second attachment portion is configured to fold towards the second primary flap, wherein the second secondary panel is configured to fold towards the first primary panel, and wherein the second attachment portion is configured to connect to the first secondary flap.

* * * * *